US006085630A

United States Patent [19]

Manis

[11] Patent Number: 6,085,630

[45] Date of Patent: Jul. 11, 2000

[54] FIREARMS

[76] Inventor: John R. Manis, 17320 Meridian Blvd., Hudson, Fla. 34667-4937

[21] Appl. No.: 09/168,323

[22] Filed: Aug. 26, 1998

Related U.S. Application Data

[63] Continuation of application No. 08/592,575, Jan. 26, 1996, Pat. No. 5,841,058.

[51] Int. Cl.[7] ..... F41F 1/00; F41A 21/00; F42B 3/00; F42B 14/00

[52] U.S. Cl. ..... 89/8; 42/78; 42/76.01; 89/14.05; 102/430; 102/524

[58] Field of Search ..... 89/8, 14.05, 14.3, 89/14.4; 102/433, 434, 430, 524, 525, 526, 527; 42/78, 76.01

[56] References Cited

U.S. PATENT DOCUMENTS

| | | | |
|---|---|---|---|
| H167 | 12/1986 | Forester et al. | 102/524 |
| 478,020 | 6/1892 | Pollard | 102/526 |
| 847,149 | 3/1907 | Barlow | 102/524 |
| 1,450,558 | 4/1923 | Maze | 89/14.05 |
| 1,529,664 | 3/1925 | Moriarty | 102/526 |
| 2,454,801 | 11/1948 | Himmer | 102/526 |
| 2,759,421 | 8/1956 | Sublette | 102/526 |
| 3,059,367 | 10/1962 | Rosebush | 42/76.01 |
| 3,154,016 | 10/1964 | Frey | 102/501 |
| 3,441,403 | 11/1968 | Rodenberger . | |
| 3,459,101 | 8/1969 | Scanlon, Jr. et al. . | |
| 3,465,638 | 9/1969 | Canning . | |
| 3,482,516 | 12/1969 | Farmer et al. | 102/430 |
| 3,483,794 | 12/1969 | Packard | 42/78 |
| 3,528,187 | 9/1970 | Harrell | 102/430 |
| 3,575,112 | 4/1971 | Farmer | 102/430 |
| 3,705,549 | 12/1972 | Quinlan et al. | 102/430 |
| 4,176,487 | 12/1979 | Manis | 42/78 |
| 4,197,801 | 4/1980 | LaFever et al. | 102/430 |
| 4,296,893 | 10/1981 | Ballmann | 102/520 |
| 4,379,531 | 4/1983 | Manis | 42/78 |
| 4,527,348 | 7/1985 | Brennan | 42/78 |
| 4,552,071 | 11/1985 | Horais et al. | 102/527 |
| 4,587,905 | 5/1986 | Maki | 102/430 |
| 4,590,842 | 5/1986 | Goldstein . | |
| 4,665,825 | 5/1987 | Pettersson | 102/430 |
| 4,691,638 | 9/1987 | Meyer et al. | 102/430 |
| 4,712,465 | 12/1987 | Macdonald | 42/78 |
| 4,782,758 | 11/1988 | Washburn | 102/430 |
| 4,802,415 | 2/1989 | Clarke et al. | 102/434 |
| 4,846,068 | 7/1989 | Zedrosser | 102/430 |
| 4,938,145 | 7/1990 | Martwick | 102/434 |
| 4,953,440 | 9/1990 | Moscrip . | |
| 4,982,647 | 1/1991 | Hertzberg et al. . | |
| 5,016,537 | 5/1991 | Pinson | 102/443 |
| 5,029,530 | 7/1991 | Martwick et al. . | |
| 5,042,388 | 8/1991 | Warren et al. | 102/434 |
| 5,048,422 | 9/1991 | Northrup et al. | 102/434 |
| 5,048,423 | 9/1991 | Garrett | 102/434 |
| 5,069,137 | 12/1991 | Martwick | 102/434 |
| 5,309,842 | 5/1994 | Matysik et al. | 102/430 |
| 5,322,002 | 6/1994 | Miskelly, Jr. et al. | 89/8 |
| 5,355,765 | 10/1994 | Rogers | 89/14.4 |
| 5,631,436 | 5/1997 | Brown et al. . | |
| 5,677,505 | 10/1997 | Dittrich | 102/430 |
| 5,841,058 | 11/1998 | Manis | 89/8 |

*Primary Examiner*—Theresa M. Wesson
*Attorney, Agent, or Firm*—Nikolai, Mersereau & Dietz, P.A.

[57] ABSTRACT

The construction and arrangement of the projectile bearing surface interfaces rearward and forward of a recessed surface chamber of the projectile interface conjointly with the interfaces of bore wall areas segmented by recessed bore chambers which in conjunction effect the deployment/transport/dispersement/development/modulation and transformation of explosive propellant charges sequentially primed and activated rearward and forwardly of the projectile along the bore and in bore wall chambers captively converting high static gas pressure to expansively relieved dynamic propellant gas pressure directly at the projectile reducing firearm barrel recoil while energizing projectile movement along the bore in a closed-system of thermodynamic propellant energy for free flight purposes.

37 Claims, 10 Drawing Sheets

FIREARMS

This application is a Continuation of application Ser. No. 08/592,575, filed Jan. 26, 1996 now U.S. Pat. No. 5,841,058.

FIELD OF THE INVENTION

My invention relates to improvements in coefficient ballistic efficiencies of the movements of projectiles in the barrels of firearms with particular references to arms of minor caliber, although the principles and elements of the invention are applicable to gun projectiles and barrels of any justifiable size in accordance to any practical objectives for their intended targeted use.

BACKGROUND OF THE INVENTION

The firearm barrels and projectiles of this invention function together in conjoint-action to form transiently captive environments in a series of recessed chambers of the bore walls by the interacting transitional interfacing functions of the projectile's lubricated bearing surfaces, furnished with a recessed co-chamber, and sequentially bearing against the caliber sized annularly segmented bore wall bearing surface interfaces and passing the mouths of explosively charged annular bore wall propellant gas-relief chambers, the said projectiles bearing surface interfaces thereby also functioning as quick-acting valves in combination with the annular segmented bore wall bearing surface interfaces as the projectile passes each said charged annularly recessed bore chamber's mouth; the said bore wall chambers becoming filled with explosive propellant charge portions forced from a propellant charge unconfined in the bore column in front of the projectile, and the said charge quickly sealed therein the said chambers by the projectile bore obturating body are ignited to explosively burn confined for short periods of time.

To avoid deleterious forces from acting on the barrel structure the mass of each charge portion impacting into bore wall chambers is preferably kept small, and the impaction fores widely distributed over as broad and shallow a longitudinal surface of a bore chamber's wall structure as practical to minimize said force of impaction and also naturally provides easy access to the chamber's structure when cleaning the bore after firing when necessary.

The said interfacing valving functions of the conjoint-action of the bearing surfaces of the projectile and segmented bore walls, in relative conjunction of structural configuration of their chambers, transiently create a series of small individual transitory constructed special captively sealed and confined explosively developing propellant environmental entities withing each of the said chambers recessed into the segmented bore walls of the firearm barrel shared by the said in transit captive co-chamber of the projectile; and these chambers of the bore and projectile can be put to use to cooperate in various ways and methods to meet the requirements of various firearms of particular ballistic character to create an efficient propellant property by the explosive development of high pressure propellant gases forming in and then suddenly relieved to expand out of said chambers directly at the projectile body which propel the projectile along the bore and may also act to impart a particular rotational movement to the projectile while resisting reactive recoiling forces acting on the firearm barrel.

In a particular alternative combination of a firearm barrel and a projectile with a front charge, the rearward chambers of the bore wall may be charged by the projectile and the forward chambers of the bore may be left devoid of charges, by early depletion of the projectile's front charge, and thereby the forward chambers only used as bore column gas expansion chambers to bring about reduction of bore column pressure while bore column expansive gas pressure still actively energizes the projectile movement along the bore, but with a relatively reduced muzzle blast as the projectile exits the barrel.

It is brought out that the plug of air contained in the front of projectiles in the bores of firearm barrels of known conventional construction is normally highly compressed and thereby heated in front of a speeding projectile fired along the bore in which the projectile acts as an obturator. This plug of air somewhat resists the projectile's progress and contributes heat transfer to the firearm barrel.

The phenomenon of this said highly compressed and heated plug of air in the bore is reduced in the firearm barrels of this invention and therefore relieves, to a certain degree, air resistance and its heat transfer to the barrel because as the projectile passes the mouths of the bore wall chambers the plug of air being compressed in front of the projectile in the bore is, before becoming highly compressed and heated, progressively passed captively into the series of said segmented bore wall chamber's mouths, being wedged therein by the projectile along with and between the grains of the front propellant charge of the projectile.

It is known that most modern smokeless gunpowders burn slowly when not confined relative to the explosive rate at which they burn when highly confined in the closed systems of the bore of a firearm barrel wherein the projectile body acts as a bore obturator to the expansive escape of the gaseous products of combustion of the gunpowder, and thereby the rising heat and pressure of the confined developing gases forces, with greater and greater efficiency, more and more heat into the remaining unburned gunpowder grains and causes them to burn more and more explosively as additional explosive propellant gases develop, and as the confined heat and pressure of the gases becomes higher and higher until eventually the projectile's inertia is overcome and moves substantially forward along the bore relieving its breech charge from high confinement.

These burning characteristics of smokeless gunpowder are taken and used to advantage by structures of the firearm barrels and projectiles of this specification.

In the firearms of known conventional closed-system structures that use a single or even multiple propellant charges in the chamber of the breech area of the barrel there is a rapid rate of increasing entropy where the expanding explosive force of the charge or charges becomes less and less efficient to act on the diametric short axis of the projectile thereto to push the projectile forwards as it speeds away from the breech in its course along the bore of a firearm barrel, because theoretically in accordance to certain laws of thermodynamics, hot propellant gases under pressure do not easily expand faster than the speed of sound and therefore the conventional firearms described in this paragraph do not have the potential to shoot projectiles much faster than 1.25 miles per second from the force of expanding propellant gases initiated from the chamber of the breech. That is, theoretically, once the projectile is traveling at its potential limit of 1.25 miles per second in the barrel the propellant gases no longer have the potential to expand any more rapidly from the barrel's explosive chamber of the breech end than the forwarded speed of the projectile they were expanding against, and therefore, kinetic energy is no longer available to be absorbed from the propellant gases by the projectile.

Prior inventions have introduced some closed structure firearm systems employing multiple charges in wells of the bore walls in attempts to reduce entropy, but the charges of these bore structures are shown not to be precisely controlled, modulated or otherwise structurally governed for exact timed development and finely tuned relief by and directly at the body of the projectile to energize its movement along the bore.

SUMMARY OF THE INVENTION

In this invention of propellant energizing of projectiles in firearms, high pressure propellant wave fronts of expansion are in sequential intermittent sequence, created as high propellant gas flow from bore chambers directly at the projectile body by being initiated by the projectile structure and to occur at the projectile body at preferred oblique to substantially right angles to the projectiles's longitudinal axis whereat propellant gases developed under high static pressure by the projectile, being suddenly relieved by the projectile, undergo an increase in pressure at the point of dynamic expansive relief at the diametric perimeter of the projectile caliber where these high velocity expanding gases preceded by a shock-wave front of increased pressure are turned along the rearward longitudinal axis of the projectile's transit body at chambers along the bore wall as the projectile's conical and/or helically vaned notched rear area passes these high pressure chambers where high kinetic energy absorptions thereby are caused to occur directly from the propellant gases to the projectile by conversion of the static high pressure gases captively developed in a bore wall chamber by the projectile into dynamic pressure of these gases relieved initially directly at the projectile body, and complemented by jet-reaction and turbine force effects that occur as the gases expansively drop in pressure into lower pressure of the column of gases confined in the bore rearward of the projectile thereby reducing entropy of the thermodynamic system of the firearm barrel, and cause the said projectile to have a final greater potential muzzle velocity greater than 1.25 miles per second.

To acquire these efficiencies of expansion and kinetic energy absorption of the propellant gases directly by the projectile, it is possible to have an unconfined smokeless gunpowder propellant that could be initiated or primed to begin to burn slowly unconfined in front of the projectile and the said front gunpowder propellant then immediately be forced by the projectile, along with yet an unburned portion, into segmented bore wall chambers wherein the primed propellant becomes highly confined, and its confinement causing it to then explosively burn generating high propellant gas pressure within the active environment of said chambers, and relieved a moment later rearwardly directly at the projectile, and the degree of the magnitude of high pressure within the said chambers being relieved at the projectile being determined by the manner of efficiently priming the charge and the particular character of component chemical interactions of the propellant, the correlative lengths of the bearing surfaces of the barrel and projectile, the combined volumes and existing pressure and heat of the segmented bore wall chambers corresponding with the co-chamber of the projectile, and the rate of speed of travel of the projectile past the mouths of the said bore wall chambers correlated to the length of each said chamber's mouth, all other factors of interior ballistics being relevant.

In this instance, the bore wall chambers could have higher potentials of captive generated gas pressure within them than the coefficient of potential propellant gas pressure as contained in the column of propellant gases within the bore behind the projectile, and therefore, as the bearing surface of the projectile passes the mouth of a bore wall chamber, the higher pressure propellant gases developed within the said bore wall chambers are relieved to invade and turbulently mix with the much lower pressure of the column of propellant gases of the bore behind the projectile creating a higher pressure wave front of turbulent propellant gases directly at the projectile then the overall bore column propellant gas pressure; and these pulses of increased pressure of the chambers also acting to push the projectile forward with greater force than the much lower pressure of the bore column of propellant gases. These said forces acting along the length of the firearm's barrel being so great that such a barrel housing these bore wall chambers would be required to have a sufficiently strong construction along its entire length to contain these pulses of high pressure. It is pointed out, however that the overall coefficient of pressures thereby used in this specification could be kept much lower than conventional while obtaining high muzzle velocities.

In conventional firearms that fire breech charges it is known that their propellant gas flow is streamlined and not turbulent along their bores.

The turbulent violent mixture of propellant gases as disclosed in this invention cause any burned portions of their powder grains in the said turbulent mixture to burn even more explosively with greater efficiency within the entire system of the firearm's barrel.

Also it can be seen that the inclined form of the projectile's ogively pointed front end and also its inclined rearward end keeps the projectile's body from being upset by pressure of its forward charge or being upset by the high pressure gases at the mouths of said bore wall chambers; the said propellant wave front of high pressure tending to favorably apply a compressive force to the body of the projectile rather than an upsetting force; including bore column gas pressure.

A peculiar phenomenon of most smokeless gunpowders is that they require, as aforesaid, high confinement in order to explosively burn; and when unconfined will only burn slowly like the igniting and burning of a kitchen match head. And these characteristics of smokeless powder burning are used to an efficient advantage in this invention.

There are many kinds and types of gunpowders now available on the open market. Each has its own characteristic peculiarities for use in firearms under varying conditions.

A particularly favorable group of gunpowders that would meet the particular integrity of coefficient ballistics requirements of the firearm barrel and projectile structures of this specification would be the use of a group of the more stable smokeless powders that do not contain nitroglycerin in them such as are particularly available within the single base group of gunpowders which therefore are less sensitive to being ignited by friction or shock and therefore more tolerant of the impacting action of the projectile deploying its front charge into the firearm's bore wall chambers as later fully described. But also as later described a small proportion of nitroglycerin may be used as a coating for gunpowder grains that otherwise do not contain nitroglycerin.

As aforesaid certain types of single base gunpowders require high confinement of their charges to burn explosively which characteristic is desired and put to efficient use together within further consideration of controlling sequentially balanced burning rates of the gunpowder in accordance to grain size and structural configuration, web thickness and coatings applied to the grains of the gunpowder, and when taken together with the inherent burning characteristics within the main body of the said grains of each powder type, itself, all contributing to an overall given efficient balanced burning rate for an individual gunpowder type or types that will be employed for a particular firearm type or types as illustrated and described and pointed out in this specification.

A basic method of making gunpowders as exemplified below is by first making a chemical compound called guncotton, or in another term the guncotton is called nitrocellulose. This compound is formed by action of nitric and sulphuric acids on cotton, or any other kind of cellulose. Hence, often the term for the end product is "nitrocellulose" instead of "guncotton" but the nitrocellulose does not contain nitroglycerin so the term "guncotton" is preferred for use in this specification to avoid confusion. The guncotton is then dissolved in a mixture of ether and alcohol, thus forming a mass called a colloid having very much the same consistency as melted glue. This colloid is squeezed out into tubes like macaroni out of a press and these tubes are cut into short lengths after which the ether and alcohol used to dissolve the guncotton are evaporated off leaving a hard substance something like dried glue. This dried-out colloid of guncotton is basically of the group of gunpowders of the single base types that do not contain nitroglycerin.

Nitroglycerin is made by reaction of glycerol with nitric and sulphuric acids in a process similar to that of guncotton, and if nitroglycerin is included to be mixed within the guncotton (nitrocellulose) it then becomes a double-base gunpowder called a nitroglycerin gunpowder. And generally "nitrocellulose" is accepted as a public term in reference to single-base gunpowders.

And an especially versatile gunpowder called Ball powder would be particularly also favorable as it can be manufactured without nitroglycerin; or can be simply coated with a very small proportion of nitroglycerin, or any other explosive substance sensitive to friction that would ignite them, and also a deterrent coating can be applied over the nitroglycerin coating and these coatings can serve the broad coefficient ballistics requirements of the structures of this invention brought about by computation and trial in various combinations for gunpowder use; some being exemplified here by first the deterrent coating resisting, or momentarily delaying, ignition if included and/or the nitroglycerin coating providing for especially the pre-ignition means of igniting the gunpowder charge of the projectile by impaction and/or frictional forces acting on the gunpowder.

Ball powder is unique in its manufacturing process of smokeless gunpowder having individual grains in the form of little balls, and the ballistic characteristics of this powder are partially determined by the size of the individual balls of grain. Everything being equal the small diameter balls of the grain results in a faster burning powder. And differing sizes of the balls of grain can be mixed to adjust the gunpowder's burning characteristics. The final grain ball product contains no nitroglycerin and in that state can be used like a single-base gunpowder; but the gunpowder can go through several further stages of operations of applying coatings to its balls of grain for bringing about a wide variation in means of controlling a desired final ballistic characteristic of the gunpowder. As further exemplified here in that one coating can be of nitroglycerin and another deterrent coating can be also applied. The nitroglycerin coating does not require high confinement in order to burn explosively and burns off very quickly and raises the potential energy in the remaining main body of the slower burning grain portion that burns explosively only when highly confined, and because of nitroglycerin's sensitivity to friction and impacts can provide for the means of pre-igniting the front gunpowder charge of the projectile within its course along the firearm barrel when the said gunpowder charge is unconfined in front of the projectile. The deterrent coating further delays the surface burning of the balls of grain under its coating so that although the front charge grain surfaces are ignited the main inner bulk of the charge grains burn even more slowly unconfined in front of the projectile until highly confined within a segmented bore wall chamber of the firearm barrels of this specification.

It being further brought out here that some minute particles of the gunpowder grains will be sloughed off the front charge of the projectile and wedged in highly confined between the bearing surfaces of the projectile and the smooth segmented bore walls of the firearm barrel where between frictional heat and/or impact forces cause these minute gunpowder particles either of a pure single-base gunpowder or one especially treated with nitroglycerin to explosively burn generating explosive gases to form between these said bearing surfaces and thereby providing an explosive lubricant keeping these bearing surfaces apart especially when the projectile has proceeded further along the bore at a higher velocity. And therefore ball powder preferably can provide these two additional ballistic functions of providing the means of pre-igniting the projectile's front charge and the means by which the projectile's bearing surfaces are lubricated. And therefore in this specification the gunpowders used in this manner are termed by the inventor as pre-igniting-explosive-lubricant gunpowders.

And with or without the said explosive-lubricant other means of lubrication may be used such as petrolatum.

Considering further that while the ball gunpowder can be used with or without coatings; a wide variation of coatings can be used still further exemplified by sequentially reversing the order of the application of deterrent and nitroglycerin coatings thereby reversing their ballistic coefficients in the firearm barrel, or even additional coatings applied in various combinations such as either a deterrent coatings or a nitroglycerin coating used alone, or a nitroglycerin coating sandwiched between two deterrent coatings, or further variations might be made to come to a proper balance of ignition and burning rates to meet particular ballistic requirements.

Further, too, is the consideration of some deformation of the form of the ball gunpowder's individual grains by wedging action of the projectile upon its front charge, which deformation may or may not occur in accordance to the degree of the profile of the form of the projectile's frontal ogive point and the hardness and ball size of the gunpowder's grains, and also in accordance to a choice of departing from the usual grain forms such as balls, rods and flakes and developing a form of grain of gunpowder suited to the above stated purpose of grain fracturing and/or crushing; that is to say the choice for the powder grains to be formed and organized to be crushed in a certain limited manner as the front charge portions are deployed into the firearm barrel's bore wall chambers by the nose of the projectile; including the choice of designing and formulating the gunpowder to be subjected to little or no significant grain break-up.

The projectiles illustrated herein in their cartridge powder cases are provided with preferably only a very small rear charge of gunpowder which is ignited by the usual means of a conventional primer to get the projectile started out of its cartridge case at a very low developed breech propellant gas pressure as the projectile's large main front propellant charge is then deployed into segmented bore wall chambers, as the projectile moves along the bore, by the front charge into the firearm barrel's segmented bore wall chambers wherein the charge portions are ignited sequentially to generate propellant gases explosively to higher pressures than the bore column pressure behind the projectile, and interfaces of the bearing surfaces of the projectile interacting with bearing surfaces of the caliber sized segmented smooth bore wall areas, which a moment later releases the high pressure propellant gases of the segmented bore wall's charge chambers sequentially rearwardly along the projectile and turbulently into the bore column gases while said means of said bearing surfaces interfacing interactions also provides the means of a bore obturation by the projectile to block the escape of the said charges propellant gases from issuing forward into the bore past the projectile; except for a slight release of gases in certain embodiments used for pre-igniting portions of the projectile's front charge deployed as described into the bore chambers and which by aforesaid means the projectile is fired efficiently by its propellant charges in attaining its high muzzle velocity in a system of successively developed and rearward relieved high pressure propellant gases in the firearm barrel which reduce recoil of the firearm.

The front charge of the projectile can be deployed into the bore wall chambers in several different ways as shown in several structural embodiments. In one embodiment as the projectile is fired and started along the bore by low propellant gas pressure of its rear small charge the large front charge in contact with the front ogive surface of the projectile is pushed along the bore by the projectile to be deployed into bore wall's chambers preferably being as aforesaid pre-ignited by means of tapping of the generated pressure and heat of propellant gases of the fired rear small charge either by the projectile's annular surfaced co-chamber, and/or by means of first stage bore wall gas-channels.

In another embodiment a small portion of propellant gas pressure and heat is tapped from the projectile's rear charge momentarily released past the projectile, the said gases having a forwarded speed greater than the projectile's forwarded speed in the first stages of the projectile's movement along the bore. And this said spurt of rear charge's gases ignites and somewhat scatters the projectile's front charge forwardly along the bore ahead of the projectile, and a moment later the projectile overtakes and gathers the unconfined slowly burning charge grains together and forces portions of the successively pushed laterally into the bore wall's chambers where thus the said charge's grains being now confined burn explosively to a high magnitude of static gas pressure and heat which is dynamically relieved from the bore chamber a moment thereafter rearwardly directly at the projectile causing a great part of the dynamic conversion of the kinetic power of the gases to be absorbed by the projectile, forcing the projectile forward, and the residual pressure and heat of these said propellant gases after their above actions on the projectile then turbulently contained in the rear column of bore gases that are themselves contained in the firearms' barrel under much lower pressure, and with the said bore column gases slowly rising in pressure; but the bore wall chamber's developed gas pressure always being much higher in pressure and heat when relieved rearwardly in and contributing some of their residual energy into the lower pressure bore column gases.

The known rifling used in firearms barrels impart a mechanical twist to a projectile while it is contained in the bore. The object of the initial twist in the bore is to create high rate of residual kinetic spin to the projectile after it has left the muzzle of the firearm. The rotation of the projectile in free flight enable gyro-dynamic force to stabilize the projectile's trajectory in order that the projectile may be accurately aimed at a given target.

Although the rifling as used obtains the objective of rotation of the projectile in free flight there are many unwanted effects on the projectile and on the firearm barrel used to fire the projectile when using the lands of the rifling of the bore wall to impart the twist such as deformation of the streamlined bearing surface of the projectile due to the land's indentation and the great magnitude of high frictional force on the bearing surfaces of the projectile and bore wall as the projectile is forced to twist along the rifling, and which rifling limits means of reaching the greatest potential velocity of the projectile at the muzzle in accordance to the tensile strength of its bearing surfaces to resist being torn and stripped by the lands of the rifling and the obstructive frictional resistance thereof its forwarded movement by the energy expended by the firearm's propellant to overcome these forces of friction.

From the stand point of interior ballistics it is desirable for a firearms's barrel to have as little frictional restriction of the forward passage of a projectile along the bore as is possible while functioning to impart the twist and safely contain substantially the full volume of high pressure propellant gases directly at and behind the projectile whereby with reduced friction the gunpowder gases may safely propel the projectile to the greatest advantage. A particularly ideal condition in firing a projectile in a firearm's barrel is to have the pressure of the propellant gases initially rise very moderately to gently start the projectile in motion along the bore and then to deploy additional propellants along the bore to continue to rise in gas pressure directly at the projectile to cause positive high acceleration of the projectile all the way to the muzzle while reducing or neutralizing the reactive recoil and muzzle blast effects on the firearm by the projectile; and which foregoing principles and elements are objective of this invention.

Also from the stand point of exterior ballistics it is desirable to have a projectile which is not deformed by the bore and which affords a streamlined free flight structure especially at very high velocities. With propellants made available along the bore directly at the projectile with reduced bearing surface friction a much higher magnitude of kinetic energy can be safely absorbed from the propellant charge gases as sequentially developed directly at the projectile and relieved at the projectile along the barrel's bore by the projectile in this invention resulting in acquiring a higher magnitude of muzzle velocity and/or muzzle energy and a long accurate range with the projectile in free flight having been afforded with great speed and energy and with great resistance to gravitational force resulting in a flatly acquired and accurate trajectory to the target. All of the above being objectives of this invention.

A particular objective is that if ultra-high muzzle velocities are not required for a particular firearm in accordance to its kinetic energy requirements in foot pounds at the muzzle, then at the lower muzzle velocities and energies using the principles and elements of ballistic efficiencies of this invention, then the length of the firearm's barrel and its bore can be less, and the weight of the propellant charge and/or its cartridge powder case can be less while still obtaining muzzle velocities and stored kinetic energy of the projectile at the muzzle in keeping with those as obtained by various known conventional firearms popularly now in use that use propellants less efficiently and therefore require greater bore lengths and weights of charges and/or weights of the cartridge powder case.

Other objectives will be brought out or be apparent within the course of the following disclosure of the construction, arrangement and combination of elements as fully described hereafter and pointed out in the claims forming a part of the specification.

Some of the drawings of this invention do not show the front propellant charge of the projectile for sake of clarity of structural illustration.

Practical embodiments of the invention are illustrated in the accompanying drawings whereby:

DESCRIPTION OF THE PREFERRED ELEMENTS

Figure 11:
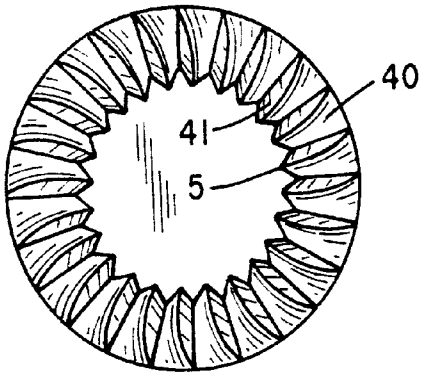
FIG. 11 is a rear view of the projectile of FIG. 12.
Figure 12:
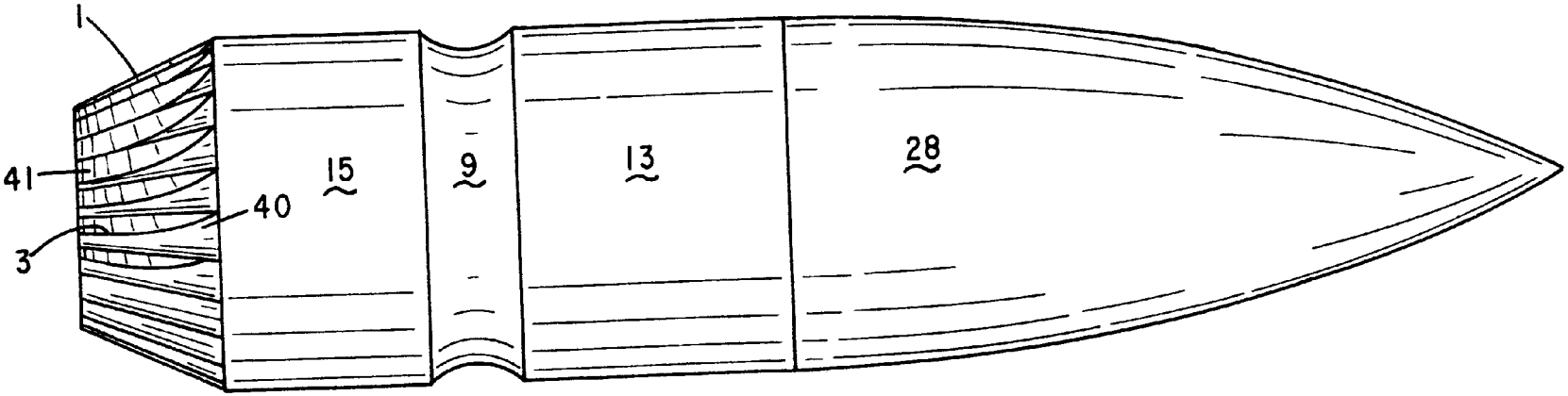
FIG. 12 is a view of a firearm projectile in side elevation.
Figure 16:
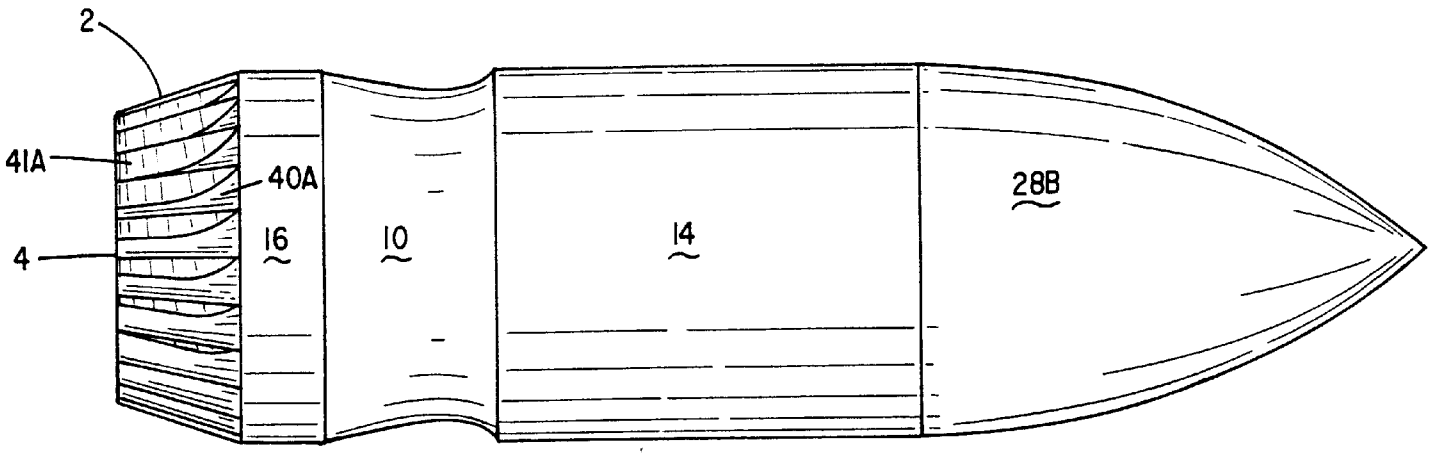
FIG. 16 is another embodiment of a firearm projectile in side elevation.
Figure 17:
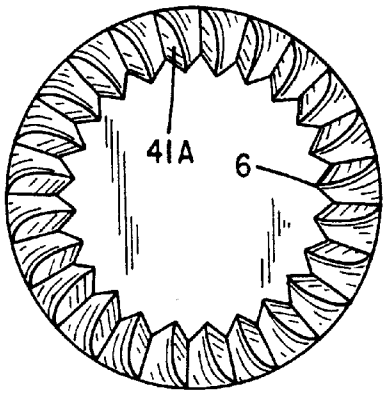
FIG. 17 is a rear view of the projectile of FIG. 16.

In the present embodiments of the helicoidal projectile the tensile and compressive strengths of the structures of these projectile helicoid-heels are improved structurally by means shown in the rearview of FIGS. 11 and 17, by having the plane sides, as at 41 and 41A, respectively of their helicoid notches as also illustrated in side elevation in FIGS. 12 and 16, as at 41 and 41A respectively obliquely inclined from the radial short axis of the projectiles, thereby providing a larger body of metal forming the individual helicoidally notched escarpments giving additional support to the individual helicoid sides, as at 40A in FIGS. 11, 12, 16 and 17 respectively, and said plane wall also providing an improved angle of resistance to the force vector line of the impinging propellant gases.

Figure 9:
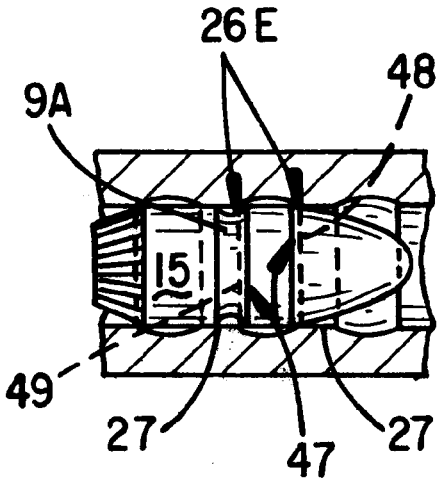
FIG. 9 is an alternate embodiment of a firearm projectile having a shortened front bearing surface.
Figure 22:
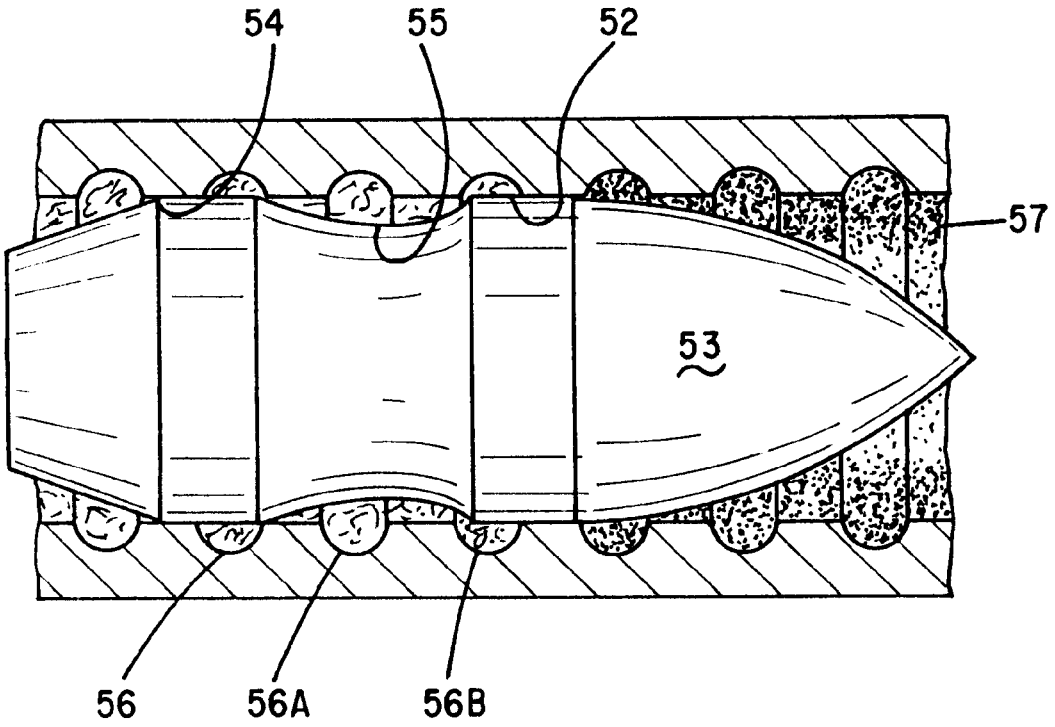
FIG. 22 is another alternate projectile and barrel embodiment shown piece-meal in a broken-away sectional view.

These projectiles for use in the firearm barrels are of overall preferable configurations of structures as illustrated in the drawings in large side elevations and rear views as shown in FIGS. 11 and 12, and FIGS. 16 and 17 respectfully. And other embodiments are shown in FIGS. 9 and 22. These projectiles are formed with taper-heel and/or helicoidally notched areas as at 1 and 2, which do not upset in the bore of the firearm's barrel by force of propellant gas pressure because the gas pressure tends to try and wedge itself between the tapered end of the bore obturating projectile and the bore wall, and in doing so the bore's propellant gas pressure tends to have a compressive force rather than an upsetting force that acts on the projectiles. And the front areas of the projectiles are preferably formed with ogively curved or inclined surface areas ending preferably pointed to provide streamlined surfaces for exterior free flight. Additionally, the front form of the projectile first functions interiorly in the firearm barrel's bore to provide a wedging surface for its front charge; whereby onto which said charge the projectile provides an efficient lateral force which forces portions of the said charge to upset into the segmented bore wall chambers of the barrel. Therefore the charge does not tend to upset the projectile's structure because of the compressive wedging action of the charge on the inclined front surface area of the projectile.

Figure 15:
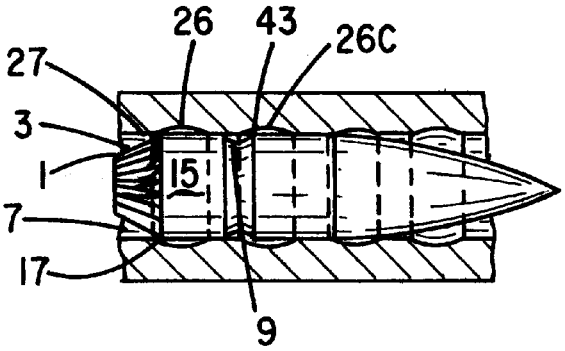
FIG. 15 is a further broken-away sectional view of the firearm barrel with some structural bore components superimposed with its fired projectile progressed to a still further transitional stage along its bore.
Figure 20:
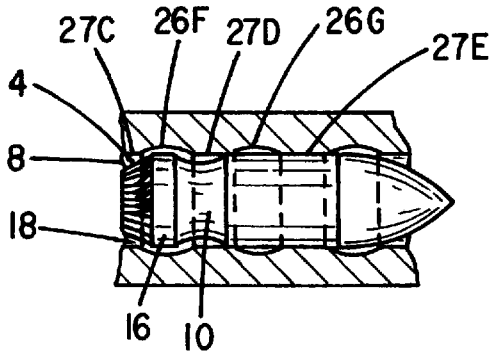
FIG. 20 is another further broken-away sectional view of the firearm barrel with some bore structural components superimposed with its fired projectile progressed to another transitional stage along its bore.

And as aforesaid the inclined taper-heels of the projectiles are formed with helicoidal notches as shown in other views, as at 3 and 4, FIGS. 12 and 16, and as at 5 and 6, FIGS. 11 and 17, and the inclined taper-heels together with their helicoidal-notches, and the projectile's bearing surfaces transiently form a closed-system of sequentially activated nozzle orifices, as at 17 and 18, FIGS. 15 and 20, respectively, and nozzle passageways, as at 8 and 7, when conjointly cooperating interactively with the barrel's segmented smooth bore walls bearing surfaces, and its segmented bore wall chambers.

Figure 19:
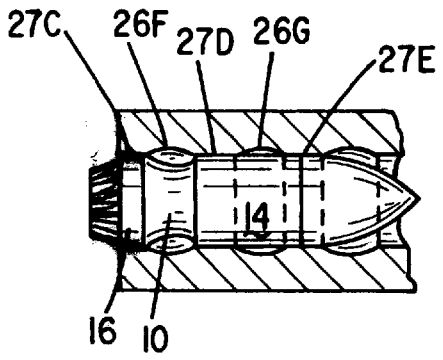
FIG. 19 is another broken-away sectional view of the firearm barrel with some bore structural components superimposed with its projectile progressed to a further transitional stage along its bore.

Also the projectiles are preferably formed to include co-chambers in their structures formed as annular recessed surfaces or grooved areas, as at 9 and 10, FIGS. 12 and 16, from and around the projectiles bearing surfaces, as at 15 and 13, FIG. 12, and as at 16 and 14, FIG. 16, which elements also transiently forms a closed-system of projectile co-chambers, as at 9, FIG. 15, and as at 10, FIG. 19, when they also conjointly cooperate interactively with the barrel's segmented smooth bore walls bearing surfaces segmented with recessed bore wall chambers.

Figure 10:
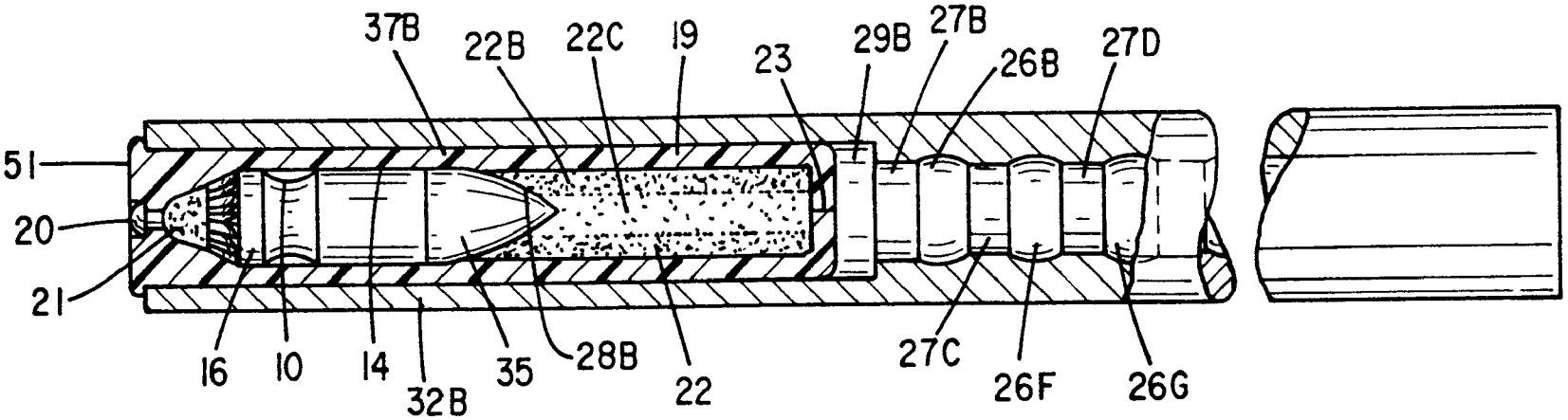
FIG. 10 is a partial sectional view of another embodiment of the firearm barrel with a sectional view of a cartridge in its chamber of the breech.

In FIG. 10, the projectile, as at 35, is shown seated inside a cartridge case, as at 19, in the chamber of the breech 29B, of an embodiment of a firearm's barrel, as at 32B. The said cartridge case 19, is fitted with a conventional primer, as at 20, and propellant charges placed rearwardly, as at 21, and forwardly, as at 22, of the projectile in the case with the frontal area of the case, as at 23, crimped and folded closed over to enclose the front charge and the front of the case to thereby seal in the case's contents. The rear charge 21, in the case is preferably much smaller, and potentially is much less powerful, and develops a much lower propellant gas pressure than portions of the projectile's forward charge, as at 22, when confined in bore wall chambers. The front charge may consist of one homogeneous charge, as at 22A, FIG. 3, including a lubricating element, or may be made up of different types of two or more lubricated, layered or stacked charges, as at 22B, and 22C, of charge 22 of FIG. 10, with each layer of propellant charges having different compositions and/or grain and web characteristics thereby to provide differences of each layer of propellant charges in reaching their time of full explosive development of expansive energy potential correlated so as to therefore be arranged to be ignited to burn and generate propellant gases differently for particular requirements of a particular firearm in order thereby to provide more efficient stages for the proper kinetic conversion of the energy of propellant to kinetic energy of the projectile along the bore.

Several optional cartridge powder case types are made available for the projectile; and the projectile is itself also shown in several embodiments. Particular combinations of projectiles and their cartridge cases either provide positive seals 36, 37, to contain rear charges developing propellant gases against escaping entirely past the projectile; or the case is allowed to expand or has gas-channels formed into its wall, as at 24 FIG. 5, to allow a precisely limited small partial forward flow of propellant gases past the projectile's rear bearing surface to fill and pressurize the projectile's co-chambers 9 and 10, and/or in other embodiments, as at 25, FIG. 7, allowing a small precisely limited spurt of propellant gases to flow forward to the front charge of the projectile to disperse the said charge scattering it out somewhat ahead of the projectile as it ignites it, and together these variations and modifications of structural configurations of the cartridge and its firearm barrel are correlated to respectively provide various efficient methods of deploying and/or pre-igniting the cartridge's frontal charge to control its efficient employment along the bore of the barrel ahead of and at the projectile for explosive development of propellant gases to high pressure and heat within the firearm's segmented smooth bore wall recessed chambers, as at 26 FIG. 3 to meet a wide variety of specialized objectives of the use of any particular firearm's barrel structured to use the principles and elements as herein stated; as within certain preferred embodiments the segmented bore wall chambers, as at 26, cooperate with the annular pocketed areas of the projectile which act as transient precise charge igniting co-chambers, as at 9 and 10, as particularly illustrated in FIGS. 9, 15 and 21 of the projectile which ignites charges in the segmented bore wall chambers into which precise portions of the front charge, as at 22A and 22 of FIG. 3 and 10, of the projectile are forced into, and which bore wall chambers together with the co-chambers of the projectile generate controlled high magnitudes jumps in the rise of propellant gas pressure provided by means of the interfacing actions of the forward and rearward bearing surfaces of the projectile, as at 15, 13 and 16, 14 of FIGS. 12 and 16, respectively interacting with the bearing surfaces of the segmented smooth bore walls, as at 27 and 27A FIG. 3, whereby the developing high propellant gas pressure is made captive in the said chambers as it reaches its intended maximum static pressure then expansively relieved and dynamically develops a magnitude of pressure directly at the body of the projectile where precedes the expansive gas flow that occurs sequentially at each succeeding bore wall chamber along the length of the bore to accelerate the projectile to an efficient high velocity all the way to the muzzle while imparting a stabilizing twist.

Figure 3:
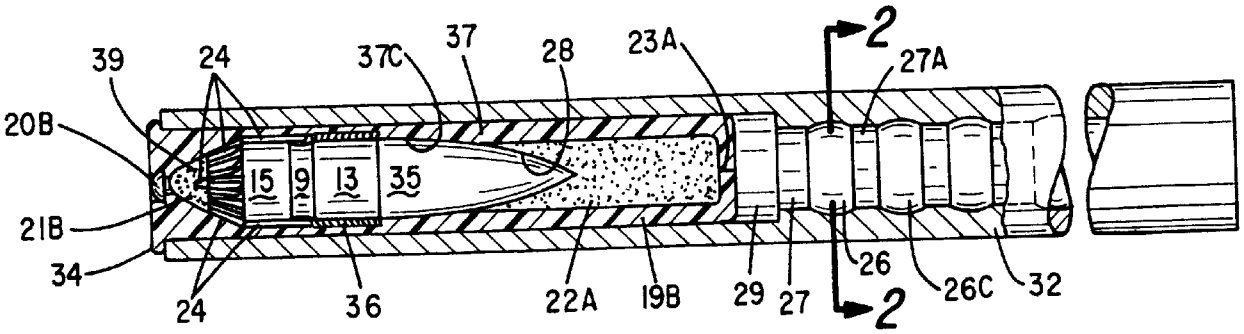
FIG. 3 is a partial sectional view of the firearm barrel illustrating a particular partial sectional view of the firearm's breech cartridge and bore structure configuration.

Further, more specifically, these ballistic steps provide methods of imparting a rotational motion to the helicoidal projectile in the firearm's barrel having a smooth annular caliber sized bore, as at 27, FIG. 3, segmented by annular chambers recessed from the bore's walls, as at 26 FIG. 3, by the expansive flow of propellant gases relieved from the said bore wall chambers 26, and turned along helical surfaces of a rear helicoidal area of the projectile, as at 1, 2, 3, 4, 5 and 6, as respectfully shown in FIGS. 11, 12, 16 and 17, while also substantially increasing the projectile's forwarded velocity when fired along the bore in which the projectile's body acts as an interfacing obturator of the smooth main bore's caliber sized wall segments, as at 27, FIG. 3, and segmented bore wall chambers, as at 26, FIG. 3, wherein propellant gases under preferred low pressure in the column of gases held behind the projectile in the bore and acting on the rear of the projectile are subjected to a precisely limited transient expansive relief of the heat and pressure of a small portion of their gases, of either the bore column of gases and/or transferred from the projectile's bore gas pressurized co-chambers 9 and 10, FIGS. 12 and 16, which pre-ignites a portion of the main propellant charge located in front of the projectile, as at 22A and 22, FIGS. 3 and 10, after that said charge portion is forcibly deposited by the charge upsetting wedging action of the front ogive surface form of the projectile, as at 28 and 28B FIGS. 12 and 16, surface form of the projectile, as at 28 and 28B FIGS. 12 and 16, upsetting and wedging a front charge portion into a captive closed environment of a recessed bore wall chamber opening into the main bore clearly exemplified in embodiments as shown in FIGS. 13, 14, 15 and FIGS. 19, 20, 21 and FIG. 22, made captive after the forward and rearward bearing surfaces of the projectile are passing the forward and rearward adjacent caliber sized bearing surfaces of the smooth bore wall segments which then act as segmented bore wall obturating interfaces of the projectile and its transient co-chambers 9 and 10.

Wherein the captively enclosed propellant charge of a bore wall chamber explosively burns generating a volume of gases under high static pressure and high heat, and which a moment later are suddenly relieved to expand dynamically at ultra-high velocity from the said chamber at and along the rearward helicoidal area of the projectile in the form of expanding high pressure and heat in a jet stream of propellant gases by way of a widening nozzle orifice and nozzle passageway formed transiently as the rear end of the projectile's rear bearing surface passes a rear opening point of junction of a segmented bore wall chamber with a rise in pressure at the point of sudden relief at the said nozzle orifice in the form of a shock-wave front of increased pressure which immediately precedes the sudden ultra-high velocity expansive flow of propellant gases to and from nozzle orifice 17, which drop in pressure behind their said shock-wave front of increased pressure, as at 17, FIG. 15, and as at 18, FIG. 20, along with also gas pressure subsequently relieved through another nozzle orifice, as at 43 FIG. 15, of the projectile's co-chamber as at 9, formed as the said co-chamber begins to pass and relieve its charge primer gas pressure into a succeeding subsequently charged bore wall chamber, as at 26C, to in sequence ignite that said chamber's charge to explosively energize the said chamber with high pressure propellant gases for relief at the projectile.

Figure 21:
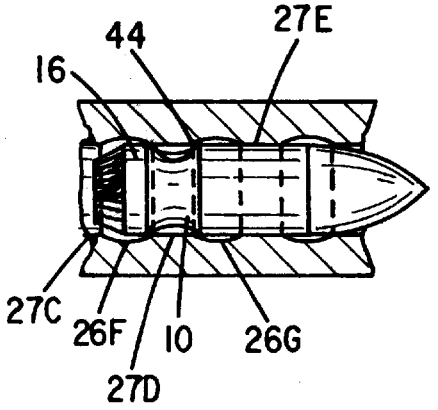
FIG. 21 is another further broken-away sectional view of the firearm barrel with some bore structural components superimposed with its fired projectile progressed to another transitional stage.

An alternate embodiment of a projectile co-chamber, as at 10, FIG. 16, opening at a bore wall chamber is exemplified, as at 44, FIG. 21. And which actions accelerates the forward movement of the projectile with a rearward relieved portion of gases of the jet stream issuing from a bore wall chamber immediately turned by the helicoidal rear area of the projectile thereby, too, absorbing kinetic energy from the gases increasing the overall forwarded movement of the projectile while also to impart an obliquely directed tangential turbine force by the said gases imparting a rotational movement to the said. projectile; and then too, also at the same moment a portion of the said jet stream's expansive reactive force provides a forwarding force of higher pressure in sequence to act on the forward wall of each bore wall chamber of the firearm's barrel to reduce or neutralize reactive rearward recoil forces of the propellant gases acting on the breech face of the barrel. And these said gases as relieved from said captive environment of a bore wall chamber turbulently receding rearwardly of the projectile to become a part of the column of gases in the main bore and the residual energy of the gases of said captive environment of a fired charge of the bore wall chamber not absorbed by the projectile or barrel becoming a part of the total energy in the column of gases in the main bore. The method including repeating steps of firing a charge in each succeeding segmented bore wall chamber along the length of the barrel's bore while substantially contain propellant gases within the firearm barrel until the projectile leaves it.

Several embodiments of the firearm's barrel and its ammunition are shown in varying combinations.

Figure 4:
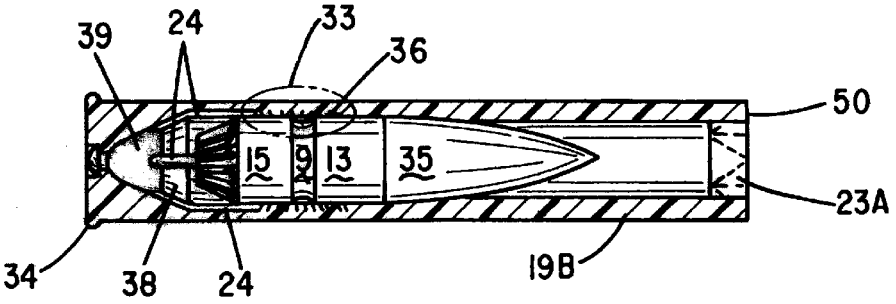
FIG. 4 is a sectional view of the cartridge case of FIG. 3, being fired with its projectile in a forwardly moved position.
Figure 5:
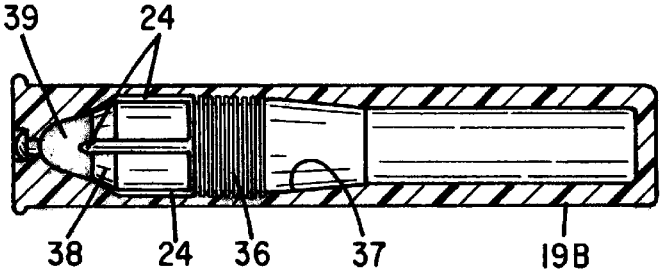
FIG. 5 is a sectional view of the empty cartridge case of FIGS. 3 and 4, illustrating its interior structural configuration.
Figure 6:
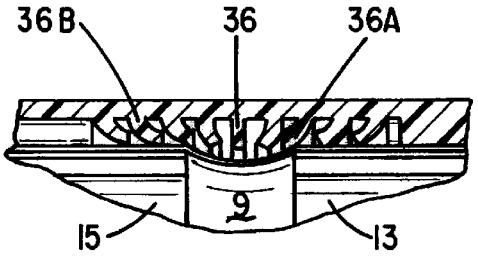
FIG. 6 is an enlarged broken-away sectional view of the fired cartridge as respectively encircled within the long and short broken line 33, of FIG. 4.

The cartridge case 19B, as in FIG. 5, is formed of any suitable resiliently flexible plastic and/or paper material with a compressible thickened wall area starting as at 37, being of a reduced caliber size to its forward end, and rearwardly of said thickened wall area series of resiliently flexible integrally formed case sealing rings that project from the case wall as at 36, FIGS. 3, 4 and 5. And FIG. 6, shows an enlarged area view of said sealing rings 36, as encircled with short and long broken lines 33, of FIG. 4. The said rings 36, as shown in FIG. 5, in their unflexed state form annular openings of a reduced caliber size through which the full caliber size of the bearing surfaces of the projectile 35, when inserted into the case are forced, and forces said rings 36, to flex rearwardly resiliently pressed tightly to the said bearing surfaces of the projectile as shown in FIG. 3, after first having inserted an explosive charge. The projectile 35, caliber also having been forced through the cartridge case's compressible and resiliently flexible thickened and reduced caliber sized wall area as at 37, and seated in the said cartridge case 19B, as in FIG. 3, against case seat area as illustrated, as at 38, FIG. 5. The rearward end of the cartridge case's thickened wall area is gradually reduced of its thickness complementary to the profile of the ogive front form of the seated projectile being then in snug contact with this said complementary gradually thickened wall area of the case. And the said resilient flexible sealing rings 36, and case's compressible thickened wall area 37, together forming positive sealing of the rear propellant charge's explosive gases against forward passage of the said gases past the forward bearing surface of the projectile.

Cartridge case gas channels as at 24 of FIGS. 3, 4 and 5, are formed equidistantly leading from the cartridge case's rear gunpowder chamber 39 of FIG. 3, and ending at the rearmost ring of sealing rings 36. A rear gunpowder charge as at 21B of FIG. 3, for starting movement of the projectile is first preferably deposited into said rear gunpowder chamber 39, before projectile 35, is inserted and seated into cartridge case 19B, and then after said projectile is seated a larger main charge of gunpowder as at 22A, which becomes the prime mover of the projectile is deposited into said cartridge case in front of said projectile 35, and the cartridge case then crimped and folded closed as at 23A, at this front end over said front charge 22A, (the open form of the said case crimp is exemplified as at 23A of FIG. 4) and sealing it in together with all of the interior cartridge case's components with the exterior of the cartridge case being in conventional appearance. The cartridge case employs the use of an ordinary primer of known construction in the base for use in firing is its rear charge of propellant. And the overall construction of said cartridge case 19B, lends itself to be constructed and assembled by adapting known methods and facilities as used in the fabrication, construction and assembly of conventional shotgun shells or cartridge cases in general, including the installation of conventional primers into the metallic base of cases as at 46 of FIG. 8, and also including the method of crimping and folding the front of the case closed in a known manner as done for most conventional shotgun shells.

In the manufacturing processes of cases using plastics or other easily moldable mediums the configuration of the structures of these cartridge cases will allow for each case to be molded as a single integral piece. And due to the very small rear charge to be fired in the case at very lowly developed propellant gas pressure that each case must only withstand will allow a broad choice of moldable materials to choose from for use in the molding processes to produce the cases preferable as single units for firearms that would not require a metal reinforced base as would be arrived at in accordance to the magnitude of pressure developed by the rear charge and/or in some primers at the case's base; and also when in consideration of rapid fire automatic firearms metal reinforcing of the base and especially at the rim of the case may be required to withstand the force of ejection on the rim of the cartridge case by the firearm's ejection action. And it being further brought out that the overall pressure of the bore column gases remains low after all jumps of high propellant gas pressure are relieved from all of the bore wall chambers and hence the chamber of the breech area, including the constant cross-sectional dimension of its breech face area, is never subjected to high gas pressure (which low pressure on the breech face area minimizes rearward recoil of the firearm) so neither will be the cartridge case's primer sup, or in shotgun terminology the "Battery Cup" that holds the primer mixture, but if the primer cup is to be installed in a case without the case having a base reinforced with metal and the reinforcing metal including a metal primer pocket and flash hole for a primer not used, then the primer cup itself may be required to be made with its walls made of a metal sufficient strength or thickness of metal great enough to self contain the pressure of its ignited primer explosive to be relieved only through the flash hole of the case without the cup structure itself being effected to be upset by its explosive charge, which charge itself may be made to avoid excessive explosive gas pressure by being made up of an available conventional LE type of explosive which is a relatively slow burning low explosive that can be set off by heat or friction and which LE type of explosive would be preferred to be used in place of the high explosive types of primer mixtures. The LE type of primer being especially practical due to the small amount of gunpowder of the rear charge of the case it is used to prime to ignite; and in some cases the LE primer may be all that would be required to develop enough propellant gas pressure from its primer mixture to get the projectile started out of the cartridge case without a gunpowder charge in the rear chamber of the case.

And in any foreseen circumstance the primer cup may be secured into the primer pocket of a case by the usual known methods and available facilities of metal reinforcement of the case's base which would include a primer pocket in which to secure the primer; or as in some firearms the primer cup can be installed in the case's base in a manner as to allow rearward movement of the primer cup form the case's primer pocket after the primer is fired to use the rearward recoiling movement of the primer cup as a force to operate some conventional recoil-operated actions of some particular firearms.

FIG. 5, clearly illustrates the empty cartridge case's 19B, means of configuration of construction for pre-igniting a portion of the front charge and sealing back rear charge propellant gases by the sealing rings as at 36, and thickened compressible case wall area as at 37.

The assembled cartridge 34, shown in FIG. 3, is as illustrated in FIG. 4, fired to start the projectile 35, out of its case 19B, and along the firearm's barrel 32, described below.

The firearm barrels of the specification as exemplified in the firearm barrel as at 32, FIG. 3, are provided with a cartridge chamber as at 29, opening at the breech end, and the caliber of the main bore is smooth and segmented as at 27, for preferably its entire length by shallow and wide annular recessed bore wall chambers as at 26. And the shallowness and long length of each one of the bore wall chambers as at 26, along the longitudinal axis of the barrel's bore allow proper time for lateral upset thin layering forcement of portions of the front charge as at 22A, by the projectile into the said bore wall chambers.

Figure 13:
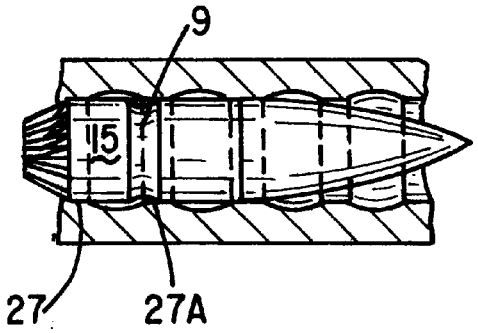
FIG. 13 is a broken-away sectional view of the firearm barrel of FIG. 3 with its bore structural configuration partially superimposed through its projectile in a first stage of fired transition along the bore.

All of the bore wall chambers as at 26 of FIG. 3, are especially structured so that the full volume of said chamber as at 26, can be safely completely filled by a charge portion and highly confined therein by the lateral upset wedging action of the projectile's front surface force on this front charge, and the said charge being transiently kept confined in the bore wall chamber by the transit forward and rearward bearing surfaces of the projectile illustrated as at 15 and 13 of FIG. 13, interfacing with the caliber of the bore's segmented bearing surfaces as at 27 and 27A, that are forward and rearward of the said bore wall chamber, and the said charge portion in the said chamber being fired by priming action of the projectile providing primer means of its co-chamber having hot gases under pressure relieved to ignite the front charge portion deposited in the bore wall chamber, and the gases of the said ignited charge portion explosively developing to a safe limit of high gas pressure in the bore wall chamber by also expanding to increase in pressure within the conjoined volume of space provided by the said co-chamber 9, of the projectile that initially ignited the said bore chamber charge; and in this manner fail-safe loading and firing of the bore wall chambers is brought about which thereby cannot be "over-filled" with a propellant charge, and therefore cannot cause deleteriously high rises in gas pressures to develop within the firearm barrel.

And this form of coefficient ballistic interaction structuring of the said bore wall chambers and the projectile and its chamber also provides natural cleaning of the bore wall chambers by the turbulent scrubbing action of the burning propellant charge grains. And the shallowness of the bore wall chambers being structured in close proximity with the segmented caliber sized smooth bore wall areas also provides too for practical access of the overall configuration of the bore structure for inspection and additional cleaning when required by use of a simple cleaning rod (not shown) that may be inserted into the muzzle and along the bore of the firearm barrel in the same manner as used to inspect and clean a conventional refiled bore. And under combat conditions the firearm barrels of this invention having a bore with relief areas provided by the bore wall chambers are less likely to bust or become ruined by obstructions in the bore.

Figure 1:
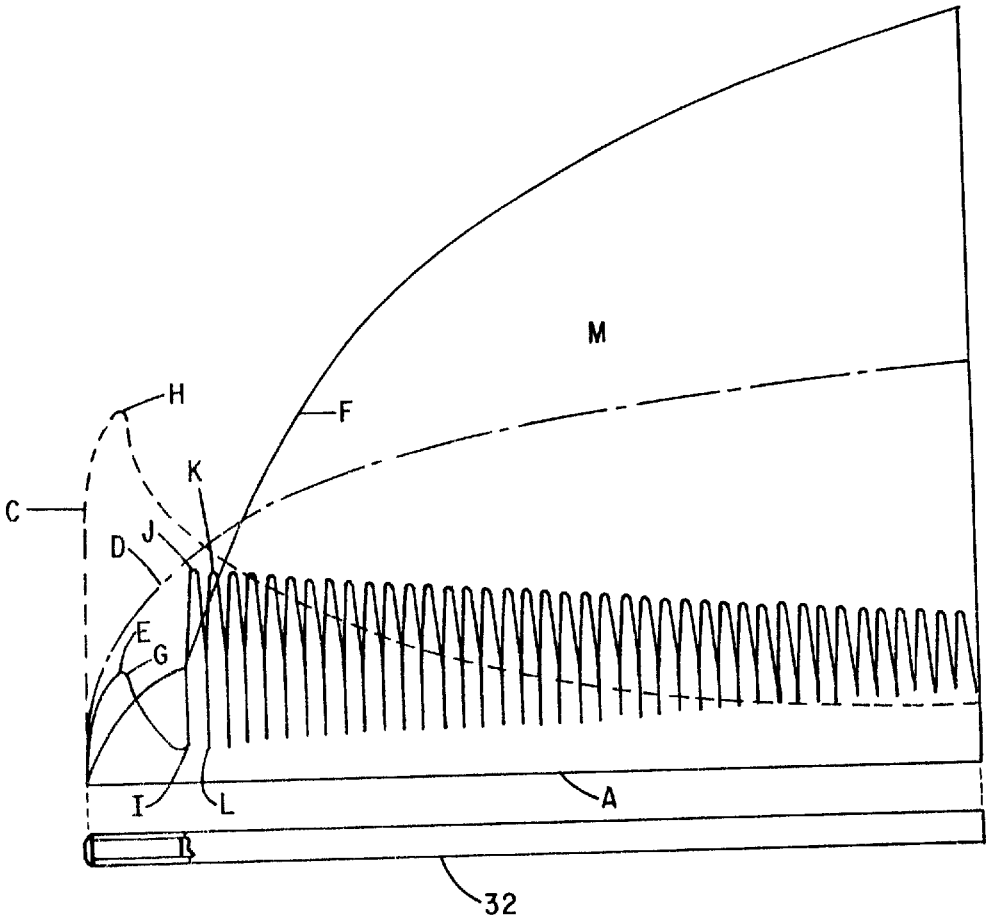
FIG. 1 is a small view of the firearm barrel partially cut-away in side elevation; included is a diagrammatic comparison view for approximately representing certain features with relation to the usual gas-pressure and projectile-velocity curves or diagram.

For more fully indicating the foregoing explanation FIG. 1, shows a gas-pressure and projectile-velocity diagram M, drawn in a known manner with the base-line A, thereof alongside of the firearm barrel 32, shown in a reduced scale. In this diagram the pressure and velocity curves as at C and D, respectively shown as broken curved lines are of a form representing results such as commonly obtained in some conventional military firearms. And the solid lines of the pressure and velocity curves respectively shown as at E and F, approximately represent ballistic results to be obtained with the structures of this invention.

The cartridge as at 34, FIG. 3, shown seated in the cartridge chamber 29, of the firearm barrel 32, when fired by any known action device preferably employing a firing pin for indenting a conventional primer as at 20B, fires said primer which ignites a small rear gunpowder charge as at 21B, which generates only preferably low pressure propellant gases peaking as at G of FIG. 1, of diagram M, or to any given pressure that would be normal to the charge, as compared to a conventional breech pressure peaking as at H, with said started out of the cartridge case 19B, and initially along the bore of the firearm barrel, but as the projectile's inertia is being overcome these said rear charge generated propellant gases first travel along the cartridge powder case's rear gas channels structure as at 24 of FIG. 3, and as more clearly illustrated as at 24 of FIG. 5, from the rear charge chamber 39, to and pressurizing the projectile's co-chamber 9 with a portion of said drear charge gases, and the cartridge case's spaced resiliently rearwardly flexed sealing rings, as at 36 FIGS. 3, 4 and 5, and as shown enlarged in FIG. 6, respective of the portion 33 of FIG. 4, prevent the said rearward charge gases from passing the projectile's forward bearing surface, as at 13, and hence the propellant gases are kept away from reaching the cartridge's large forward propellant charge 22A of FIG. 3, (the said charge not shown in FIG. 4, for sake of illustration of the opened crimp as at 23A) and the gas sealing rings as at 36, FIG. 3, and as clearly shown in the enlarged view in FIG. 6, are forced tightly in contact with the projectile's bearing surfaces and keep the co-chamber 9, of the projectile pressurized with rear charge gases, the said sealing rings 36, capturing the higher end of the magnitude of the rear charge developing gas pressure because as the projectile moves forwardly along the interior of the cartridge case the sealing rings as at 36A, which block gas pressure from expanding past the forward bearing surface 13, of the projectile then sequentially flex inward into the space provided by the projectile's co-chamber 9, and then each sealing ring 36, in sequence is forced to flex forwardly bent against the rear bearing surface 15, of the projectile as at 36B of FIG. 6.

In this resilient flexing action of the said sealing rings the said rear gas pressure can pass forward as at 36B of FIG. 6, into the co-chamber 9, of the projectile by forcing the said rings 36B, situated at the rear bearing surface 15, to flex forwardly outward away from the said rear bearing surface of the projectile, but as the explosive chamber 39 gases rearward of the sealing rings begins to drop lower than the gas pressure forward of the said rings, the higher gas pressure forward of the rings forces the rearward rings as at 36B of FIG. 6, to flex rearwardly inward against the rear bearing surface as at 15, rearward of the projectile's co-chamber 9, and in the same manner the forward sealing rings as at 36A are forced forwardly inward against the forward bearing surface 13, of the projectile forward of the projectile's co-chamber 9, and thereby portions of these gases become sealed within the said sealing rings and the projectile's in transit co-chamber 9. Then the forward bearing surface 13 of the projectile is forced along the thickened compressible wall area as at 37, of the cartridge case compressing the wall to form a forward secondary positive sealing area of the case's wall pressed tightly against the caliber of the in transit projectile's forward and rearward bearing surfaces 13 and 15 thereby further keeping gas pressure sealed within the in transit co-chamber 9 of the projectile.

As the projectile moves forward and compresses the case wall 37 and moves against it front charge 22A which forces open the crimped end as at 23A of the case some minute particles of the front charge 22A will be forced between the forward bearing surface 13 of the projectile and the compressible case wall 37 (especially in the crimp indents left in the case's opened crimp end 23A) and these charge particles will eventually be exposed to the projectile's co-chamber 9 that contains captured gas pressure at high heat wherein these minute front charge particles will be confined and burning explosively somewhat increasing the overall gas pressure and heat of said co-chamber enclosed by the confining sealing action of the compressible case wall 37, as the projectile begins to pass from the cartridge case into the caliber sized bore area as at 27 of FIG. 3, and thereat the wall of the cartridge case compressed by the projectile causes some forward bulging of the case's opened rim end as at 50 of FIG. 4, forming a tight seal against the right angled front end of the cartridge chamber 29 in juncture with the main bore keeps gas pressure sealed into co-chamber 9 while the front ogive area of the projectile laterally upsets and wedges a portion of the front charge 22A of the projectile to be forced into a bore wall chamber 26 that is subsequently sealed by the projectile's bearing surface, as the co-chamber 9 of the said projectile then initially opens at the bore wall chamber 26 and the hot gases of the co-chamber 9 expand and prime the bore wall chamber's confined charge while the bore column propellant gas pressure behind the projectile at that moment having dropped very low as at I of FIG. 3 of diagram M, and at the same moment the said confined bore chamber's ignited charge portion then explosively burns generating propellant gases and heat which increases peaking in pressure as at J (or to any pressure normal to particular gunpowders used in combination with particular embodiments of projectiles and/or cartridge cases as brought out in this specification) well above the overall bore column gas pressure as at L.

Figure 14:
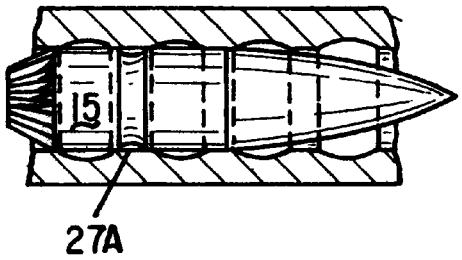
FIG. 14 is another broken-away sectional view of the firearm barrel with some structural bore components superimposed with its fired projectile progressed to a further transitional stage along its bore.

As the said bore wall chamber remains confined by the rear bearing surface as at 15 of the projectile as shown in FIG. 14, as then also the said bore wall chamber recharges the co-chamber by increasing its gas pressure as the said projectile's co-chamber by increasing its gas pressure as the said projectile's co-chambers transiently passes the said bore wall chamber and its explosive gases, and which transient said co-chamber a moment later, as it continues to move further becomes confined and momentarily held independently captured at a succeeding caliber sized segmented bore wall as at 27A of FIG. 14, between the first and second bore wall chambers, and then the end of the projectile's rear bearing surface 15 is about to begin moving past said first bore wall chamber 26 the projectile's co-chamber 9 opens at the succeeding second bore wall chamber as at 26C of FIG. 15 wherein said co-chamber expansively relieved the heat and energy of its high pressure primer gases and pre-ignites that bore wall chambers 26C captured charge portion while the heat and pressure of the propellant gases generated from the preceding bore wall chamber's 26 burning charge are suddenly relieved rearwardly, as shown in FIG. 15, directed at the projectile's helicoidal heel area 3 through another orifice created as at 17 by the juncture of heel 3 with the rear end of the projectile's bearing surface 15 opening at the juncture of the caliber sized segmented smooth bore wall area as at 27 with said bore wall chamber 26 and the large portion of said bore chamber gases relieved through said orifice 17, which orifice's axis is preferably obliquely aligned to the projectile's heel, the direction of these said relieved expanding gases then being immediately turned by the projectiles helicoidally curved surface area as clearly illustrated enlarged as at 40 of FIG. 12, of the projectile's helicoidally notched heel. A portion of the kinetic energy of the said gases is tangentially absorbed by the projectile and imparting a stabilizing turbine twisting force thereat to the projectile for free flight purposes while at the same time these gases are being turned rearwardly against and along said helicoidally curved area 40 and thereby also push the projectile forward increasing its overall forwarded velocity and which forwarded projectile velocity is also increased by the pressure at the point of relief of said propellant gases at orifice 17 created and shared by the projectile and the recessed bore wall chamber because when a gas that is under static pressure is suddenly relieved there is a rise in pressure at the point of relief in the form of a shock-wave front of increased pressure which immediately precedes the sudden ultra-high velocity expansive flow of propellant gases from nozzle orifice 17, and along a divergent nozzle passageway 7, dropping in pressure behind said shock-wave front of increased gas pressure, and this said shock-wave front rise in gas pressure initiated at the said propellant orifice shared by the projectile and firearm barrel acts to push the projectile forward while also applying a rearward recoil force onto the barrel.

However, the incline of the projectile's heel area as at 1 of FIGS. 12 and 15, cooperating with a smooth bore wall segment 27 form a divergent nozzle passageway 7 which enhances expansion of the gases with a drop in pressure from orifice 17 which a jet stream jet-reactionary propulsive forwarding force on the barrel cancels to some degree the rearward recoiling force on the barrel caused by gas pressure acting on the constant cross-section dimension of the breech face area of the cartridge chamber at the breech end of the firearm barrel, and also resists the recoil forces caused by the said shock-wave front rises in gas pressure that travel rearward from said orifice openings of the barrel's bore wall chambers as, thereby resists too, the reactive recoil effect of the muzzle blast force.

This sequence of events starting within the cartridge demonstrates the first steps of acquiring pressurization of the projectile's co-chamber while the said co-chamber is in the cartridge case for priming the ignition of a charge portion within the first chamber of the bore wall as shown in FIG. 13, then afterwards all the bore wall chambers are primed to burn explosively by the projectile pre-ignited sequentially in succession in the same manner but now by propellant gas pressure generated in the first bore wall chamber and transiently within each preceding bore wall chamber and simultaneously sharing developed propellant gas pressure within the in transit co-chamber of the projectile as shown in FIG. 13, with said in transit co-chamber then a moment later independently splitting away from each bore wall chamber by means of the structural interfacing interactions of each of the segmented smooth bore wall bearing surfaces interfacing with conjoining interface bearing surfaces of the in transit projectile captively confining high gas pressure in the projectile's co-chamber, as shown in FIG. 14, and a moment later these said transient interfacing bearing surfaces of the caliber sized segmented bore wall areas interacting in sequence with those interfaces of the in transit bearing surfaces of the projectile which structurally configured sequentially to form and act as quick acting valves to relieve the co-chamber's hot high pressure gases into each succeeding segmented bore wall chamber as shown in FIG. 15, to thereby sequentially prime each of the said bore wall chamber's charge portions to burn explosively as confined by the projectile, and then relieved rearward from the projectile which sequence of steps for positive acceleration of the projectile are repeated with the projectile in its course along the bore at each segmented bore wall's bearing surface and bore wall chamber segments along the length of the bore. And each time the high pressure gas of a projectile's co-chamber is relieved into a succeeding bore wall chamber the said co-chamber gases undergo a rise in pressure at the said point of relief in the form of a shock-wave front of increased pressure which immediately precedes the sudden ultra-high velocity expansive flow of the projectile co-chamber's high pressure gases into each bore wall chamber and these rises in propellant gas pressure also contributes to increase the overall forwarded velocity of the projectile along the bore of the firearm barrel.

It can be envisioned from the aforesaid that the series of ballistic events occurring inside of the firearm barrel will accelerate the projectile to very high velocities, and to avoid the build-up of frictional forces from impeding the projectile's high positive acceleration, especially at its higher velocities along the bore, the wedging effect of the projectile onto its front propellant charge causes minute particles of that charge to be forced between the hard bearing surface of the projectile and the segmented caliber sized smooth bore wall's bearing surfaces and whereat these said propellant's minute particles of proper explosively sensitive composition are ignited by frictional heat and pressure exerted by these bearing surfaces and explosively burns between them generating explosive gases to provide an explosively gaseous lubricant between said bearing surfaces. For explosive-lubricating purposes the projectile's forward gunpowder charge grains may be coated or powdered with an explosive compound having a higher frictional sensitivity and rate of burning than the charge grains. A simpler method to bring about this means of explosive-lubrication would be to powder the charge grains with a fine powder made up from the same gunpowder compound as are the grains of the front charge of the projectile with the great multitude of the said fine particles of the said explosive powder being exposed to more friction and heat, hence burn at a higher rate than the charge grains they cover; and which explosive fine particle powder would also be means by which the larger charge grains may be more efficiently pre-ignited by hot charge primer gases that issue from the projectile's co-chamber.

It is shown in diagram M of FIG. 1, that the bore wall chamber charge when ignited and confined develops a high gas pressure as peaking in the first bore wall chamber, as at J, and thereafter as also shown in diagram M each succeeding bore chamber's rise in propellant gas pressure as indicated as at K, of the second chamber is less due to the increasing velocity of the projectile which increased projectile velocity reduces the time of confinement of an ignited charge to develop propellant gases, and the slowly increasing back pressure of bore column gases somewhat reduces the released velocity of the bore chamber gases and hence the efficiency of increasing the forwarded velocity of the projectile that may be reduced as shown in velocity curve F, so the inventor has shown in diagram M the least optimistic view of the potential of each succeeding bore wall chamber to produce propellant gas pressure and forwarded velocity often projectile.

When, however in consideration by computation and trials of various mediums of propellant charges each succeeding bore wall chamber may be brought up to a more efficient level of producing propellant gas pressure in consideration that the shallowness and length of the bore wall chambers allows ample time for the projectile to laterally layer a charge portion into each succeeding chamber at increased velocity, because as the forwarded velocity of the projectile increases so does the lateral forced wedging action acting on its front charge increase to upset the charge into each succeeding bore wall chamber. And in consideration too of reaction time for gas to expand when relieved from under high pressure, and that although the charge in each succeeding bore wall chamber has less time to burn to produce propellant gases, each succeeding bore wall chamber may have a more powerful charge deposited, as further described below, and will open more quickly to accomplish a wider opening of the bore wall chamber's orifice at the projectile for entrance of initially a larger expansive volume of charge primer gases that provide a greater quantity of the said hot gases in less time that will enter a bore wall chamber to reach and ignite in less time a greater quantity of gunpowder charge grains in said bore wall chamber to thereby ignite the said charge grains more efficiently and then when the propellant gas pressure developed by said charge is relieved from its chamber at the projectile the increased velocity of the said projectile will also decrease the time required for creating a larger orifice opening to relieve said chamber gas pressure respective to its reactive time of expansion, and therefore each succeeding chamber's orifice will open wider by the time gas pressure had time to expansively react and to flow thereat through said orifice, and the volume of expansive flow of gases under pressure being relieved out of each succeeding bore wall chamber will be more efficient, and these increased coefficient of ballistics of ignition and burning of charges and then expansive propellant gas flow into succeeding bore wall chambers, and ignition and burning of those charges with the coefficient ballistics of the expansive volume of flow of propellant gases out of said bore wall chambers overcomes in great part the entropy of decreasing confinement of each succeeding ignited bore wall charge to generate a high propellant gas pressure.

Then, too, a method is shown in FIG. 10, of the projectile having its front charge comprised of layers of different types of gunpowder charges as at 22B and 22C of the powder case as at 19 to increase the overall efficiency of the rate of burning of charges in stages, especially in the more forward succeeding bore wall chambers. And once the flow characteristics of the cartridge's front charge grains into the bore wall chambers is established through computation and trial, including viscous or entangling grain surfaces to control layer flow, two or more layers of propellant charge grains of differing burning characteristic can be used together for the front charge as shown at 22B and 22C of FIG. 10, for staged depositing into the bore wall chambers to increase burning efficiency with the outer layer as at 22B having faster explosive burning rate than the inner layer as at 22C having a slower explosive burning rate. And with charge grain flow characteristics along the projectile and laterally into the bore wall chambers being established for the layered charges the configuration of the line of demarcation of one charge layer to another layer as approximately shown of the said charge layers of FIG. 10, can be established for certain intermixing characteristics of the differing types and layers of the gunpowder charge grains together so that a larger and larger volume of the faster burning of the inner portion as at 22C of the layered charge becomes mixed together with a smaller and smaller volume of the slower burning potential of the outer layer of the front charge as at 22B to obtain a fairly even increased rate of burning of these mixed charge layers deposited together in this manner into each succeeding bore wall chamber.

And another method of gradually increasing charges and the efficiency of their burning rates in each succeeding bore wall chamber can be brought about by various methods of pre-ignition of and dispersion of the projectile's front charge as it is scattered along the bore out ahead of the projectile, considering that the inertia of individual grains of the charge can be overcome much more quickly than the inertia of the much larger solid mass of the projectile when using some of the rear charge propellant gases partially released at high expansive velocity past the projectile to disperse and pre-ignite its front charge as follows.

Figure 8:
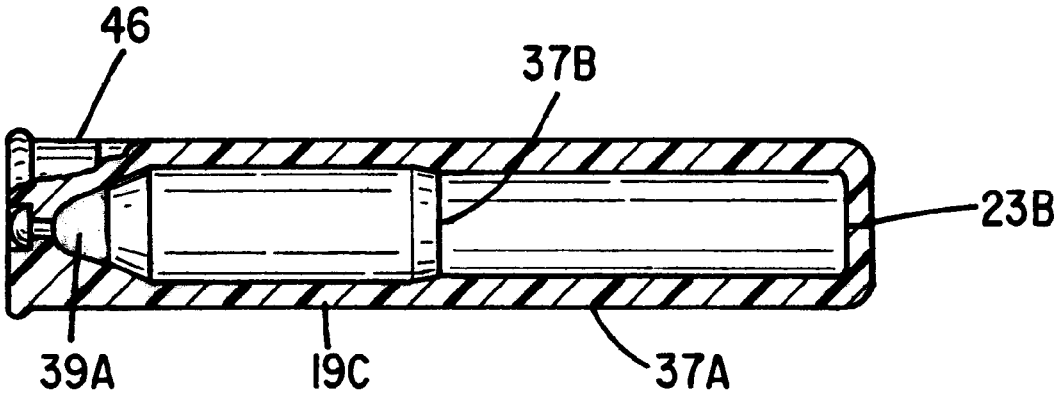
FIG. 8 is a sectional view of a simpler alternate embodiment of the cartridge case.

FIG. 8, shows a more simple alternate embodiment of a cartridge case as at 19C that has only the resiliently compressible thickened reduced caliber sized case wall as at 37A which has the rear propellant gas-sealing function as shown at 37 of FIG. 3, but the case sealing rings as at 36 of FIG. 3, and case channels as at 24 are not included in the cartridge case of FIG. 8, which case if fully loaded as a cartridge 51, FIG. 10, used in an especially minutely oversized cartridge chamber at the breech end of an alternate embodiment of a firearm barrel described below as illustrated in FIG. 10.

The cartridge case as at 19C of FIG. 8, is assembled as a cartridge with a projectile seated in it having rear and front charges as is shown exemplified in FIG. 10. And this said cartridge of FIG. 10, when if preferably fired in a special oversized cartridge chamber of the breech end (oversized cartridge chamber not shown) of the barrel by any conventional firing mechanism indenting primer 20, of case 19, FIG. 10, will expand the case's wall outwards very slightly away from the projectile's bearing surfaces to the limit provided by said cartridge chamber's wall to which the exterior of the case can go by gas pressure developed in the said case by the firing of the rear charge chamber as at 39A of FIG. 8, and the said expansion of said case will allow a precise small portion of the charge's gases that are under pressure to expansively escape around and past the projectile to the projectile's front charge, and forcing the front case's crimp as at 23B to open, and the gases thereby in reaching and colliding with the front charge overcomes the inertia of the front charge's grains 22 of FIG. 10, as it ignites the surfaces of the grains dispersing said front charge's grains out along the bore ahead of the projectile where initially the unconfined charge grains burn slowly before the relatively great inertia of the projectile is overcome by the remaining continuing development of pressure of the rear charge's propellant gas acting on the projectile, as then a moment later the projectile's bearing surfaces begin to move forward against the cartridge case's reduced caliber size thickened compressible wall area as at 37B of FIGS. 8 and 10, and forms a seal therewith the projectile's bearing surfaces 14 and 16 as the projectile tightly compresses said thickened wall area 37B to the caliber size of the projectile's bearing surfaces while the then sealed in rear charge gas pressure increases as at pressure curve E, diagram M of FIG. 1.

The projectile's velocity substantially increases as at the lower end of velocity curve F, and begins overtaking and gathering the said dispersed front charge grains ahead of it against and along its pointed front ogive form laterally forcing more and more of the said charge grains sequentially into succeeding bore wall chambers as the limited small force of the said rear charge's gas pressure and heat previously released onto the said dispersed grains quickly subsides, and these charge grains having little stored kinetic energy absorbed from the said rear charge gases then quickly slow down losing their forwarded velocity along the bore as the projectile quickly gains extra energy continually increasing its positive acceleration as it goes past each successive bore wall chamber. It being pointed out here that as the bore column gas pressure may gradually increase slowly behind the projectile due to gas pressure released into the bore column gases from each succeeding bore wall chamber there is a minor continuing decrease in the exiting velocity of the bore wall chamber's propellant gases; and by properly balancing these two mediums of low and high intermixing propellant gas pressure, gas-cutting by the high velocity propellant gases acting on the bore structures can be accordingly reduced; and also increased gas pressure being generated due to the shock wave developed by the two colliding gas mediums of the bore column and of the bore wall chambers can be properly managed with propellant gas pressure and its relieved expansive velocities kept at safe levels while efficiently accelerating the projectile in the bore to conserve the structure of the firearm barrel.

To precisely limit the portion of aforesaid rear charge gases that can escape forward of the projectile, the cartridge case of FIG. 8, can expand only a limited given distance within its cartridge chamber and away from the bearing surface of the projectile nested in the cartridge, and with the reduced caliber of the forward interior surface of the compressible case wall having a maximum reduction of its caliber as at the forward point of its interior wall surface as at 37B of FIG. 8, to which, in the expanded case, the projectile's front bearing surface must move against to create a positive seal against further escape of the rear charge's propellant gases, and which sealing time or initial jump of forward movement of the projectile can be precisely controlled by the magnitude of expansion of the cartridge case allowed against the cartridge chamber's interior wall surface, and in this manner a precise volume and quantity of force of rear charge expansive gas pressure is allowed to escape forward around the projectile to reach the projectile's front charge and thereby the magnitude of velocity of dispersing said front charge out ahead of the projectile is also limited and thereby controlled.

And it is further described as shown in the drawings that by the curved form of the recessed chambers of the bore's wall in conjunction with the projectile's co-chamber 10 and alternate embodiment 9 will create an orifice shared by said chambers with each succeeding bore wall chamber with the axis of the said orifice directed at the curved structure of each chamber's wall and thereby the said co-chamber will issue their hot propellant gases turbulently in sequence into each charged bore wall chamber which said turbulent action of the gases contributes to the overall efficient burning rates of said chamber confined charge grains.

Still another method for pre-igniting and dispersing the projectile's front charge can be brought about by the basic structure of this specification by sole use of the projectile's co-chamber 9 cooperating with another embodiment of a cartridge case having case-end gas-channels 25 structured as in FIG. 7, described below.

Figure 7:
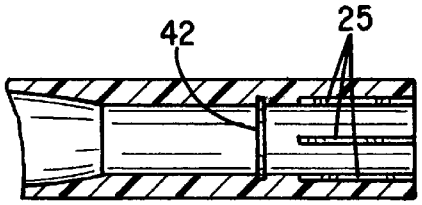
FIG. 7 is a broken-away partial sectional view of an alternate embodiment of a fired cartridge case of FIG. 5.

FIG. 7, shows another embodiment of the forward half of the cartridge case as at 19B of FIG. 5, as this forward half of its case is shown in FIG. 7.

When the cartridge 34 of FIG. 3, is fired gas-channels 24 illustrated in FIGS. 3 and 4, and then sealing rings 36 and thickened compressible case wall sealing area 37 causes a portion of rear gases to be captured in the projectile's co-chamber 9 in a manner as afore disclosed. The projectile is started out of its cartridge case pushing its front charge ahead of it out of the case and then as the projectile's sealed in co-chamber filled with propellant gases under pressure reaches the case-end gas-channels as at 25 of FIG. 7, only propellant gas pressure captured in said co-chamber 9 is released along said gas-channels 25 to precisely pre-ignite and disperse the projectile's front charge which charge's inertia has already been first initially overcome and gaining in a forwarded velocity momentum by and with the projectile's initial forward movement, and which charge the higher velocity often projectile's co-chamber's released and expanding gases overcome impinging onto the moving charge grains dispersing them scattered along the bore for a distance ahead of the projectile.

A feeder-ring as at 42 of FIG. 7, can be included to the formed in the case's interior wall into which said feeder-ring a minute portion of the front charge is deposited and passed into the projectile's co-chamber as the said co-chamber transiently moves pass the said feeder-ring and thereby the minute charge portion in said feeder-ring contributes to explosively raise the magnitude of gas pressure captured in said co-chamber which raised gas pressure is a moment later released along gas-channels 25 with greater power to act with more energy to pre-ignite and disperse the projectile's front charge in accordance to certain ballistic demands of certain types of firearms in which this added force of the projectile's co-chamber would prove useful.

It can be seen in this specification that the lengths of the projectile's bearing surfaces in accordance to their enclosing transitional time across the mouths of the bore wall chambers determines to a large degree the multitude of the rises in propellant gas pressure developed from an ignited specific charge type or types within each of these said bore wall chambers; and that the lengths of interfacing bearing surfaces can be reduced or increased to produce either a lower magnitude of propellant gas pressure, or a higher magnitude of propellant gas pressure in said bore wall chambers. And therefore in another embodiment of the projectile's bearing surface structure the same would be true especially of the longitudinal length of the forward bearing surface of the projectile for especially controlling the magnitude of sudden rises of propellant gas pressure within the bore wall chambers.

This embodiment of the projectile as shown in FIG. 9, provide an increase in the amount of propellant charge grains that may remain as deposited sequentially along the bore within each succeeding bore wall chamber by the projectile by shortening the said front bearing surface structure of the projectile as at 47 of FIG. 9, parallel to and along the projectile's longitudinal axis to be a little shorter than the lengths of the mouths of the bore wall chambers as exemplified as at 26E of FIG. 9, parallel to and along the longitudinal axis of the firearm's barrel so that in this embodiment of the shortened front bearing surface of the projectile in its transition along the bore of the firearm barrel will allow the projectile's co-chamber as at 9A, to pre-ignite a charge in the bore all chamber as previously described in the foregoing specification but with the front bearing surface of the projectile not totally confining the charge (as exaggerated in FIG. 9 for sake of illustration) at the moment of its ignition but leaving a small opening momentarily of the forward portion of the bore wall chamber as at 48 forward of the forward end of the bearing surface of the projectile and thereby allowing the pre-ignition expansive force out some of the charge's grains (accordingly to charge grain size) deposited in the bore wall chambers by the projectile, while at the same moment causing slight forward displacement and some priming of the remaining bulk of the front charge left unconfined in front of the projectile as a moment later the primed charge portion left remaining now begins burning less compactly in the said bore wall chamber as it becomes totally confined in the said bore wall chamber by the projectile's bearing surfaces as the projectile continues its forward movement along the bore.

It can be seen that this course of action of the projectile will prevent a solid compact layer of a portion of the front charge of the projectile from remaining forced into the bore wall chambers, and due to very high positive acceleration of the projectile along the bore the amount of time a bore wall chamber is only partially confined by the projectile's front bearing surface by leaving a forward opening of said chamber, as at 48 of FIG. 9, to allow out some of the charge portion in the said bore wall chamber will be accordingly, to the magnitude of increasing velocity of the projectile, less and less with each succeeding bore wall chamber along the bore, and therefore more and more of the front charge portion in the said chambers will be retained to remain in the bore wall chambers thereby gradually increasing the compactness and amount of the charge grains of a charge potion left in each succeeding bore wall's charged chambers in accordance, also too, of the web and/or grain size, or mixed web and/or grain sizes of a particular gunpowder or mixed types of gunpowders used for gradually increasing the magnitude of propellant gases that can be developed sequentially in each succeeding said bore wall chamber from its charge portion, especially when it is taken into consideration along with mixed grain and/or web sized of a charge of which some are small enough to be forced out, that the rear portion of each said bore wall chamber opens as at 49 of FIG. 9, more and more quickly with their nozzle orifice opening formed by the projectile opening increasingly wider in a shorter time period with each succeeding bore wall chamber for the charge portion left in each said bore wall chamber to be primed to ignition sequentially by the projectile's co-chamber more and more efficiently as the frontal area of each said succeeding bore wall chamber more and more quickly closed to totally confine its ignited charge to develop propellant gas pressure that is sequentially relieved, in a manner as previously described, at the rear of the projectile and into the closed bore column system of propellant gases confined rearwardly of the projectile.

In other words the co-chamber's nozzle orifice 49 opening at the rearward end of the mouth of the said bore wall chamber and at the rear end of the front bearing surface of the projectile opens as at 49 wider and wider at each succeeding one of said bore wall chambers while the forward orifice opening at the forward end of the mouth of the said bore wall chambers 26E as at 48 becomes smaller and smaller relative to the transit passage time and length of the front bearing surface of the projectile as at 47 correlated to reactive time of relief to expansive flow of the projectile's co-chamber's high pressure gases reacting to flow into said bore chamber; and so with each succeeding bore wall chamber a greater quantity of the bore wall chamber's burning charge grains and expanding gases will remain, and in the same manner to be developed in each succeeding one of said bore wall chambers when as each one of said chambers sequentially becomes totally confined by the transient passage of the projectile's annular caliber sized interfacing smooth bearing surfaces as at 47 and 15 of FIG. 9, bearing against the annular caliber sized segmented smooth bore walls as at 27 of FIG. 9, between said bore wall chamber and across the mouth of each said bore wall chamber opening at the said bearing surface of said segmented bore walls.

The following of a portion of this specification brings out and exemplifies further means of front charge pre-ignition and also dispersing of the front charge ahead of the projectile by bore column gases brought about to be initiated not by a cartridge powder case but by the barrel's structure, but by which means of the barrel's structure is considered less efficient than the means of the cartridge powder case's structure, the means of a cartridge powder case, when cartridge powder cases are used in the cartridge chamber of the breech end of the firearm barrel are preferred. As now further being brought out that in large caliber guns as those that do not utilize cartridges but load propellant charges into a firearm barrel's bore separately of the projectile without use of cartridge powder cases the pre-ignition and/or dispersing of the front charge of the projectile by the firearm barrel's bore structure becomes the only means by which these said functions of pre-ignition and/or dispersing of the said propellant charge in front of the projectile can be precisely obtained with the foregoing spirit of this specification, and therefore, become an essential structure.

So in order to be in compliance in attaining certain coefficients of the firearm barrel's ballistic systems of this invention in accordance with certain requirements of gun barrel that do not employ cartridge powder cases to be in harmony with the character of use of projectiles of this specification; similar gas-channels formed in the breech end chamber area wall may also be used as a certain additional structural configuration with that of the particular bore obturating characteristics of the interface bearing surfaces of the projectile and breech end chamber wall with inclusion of the breech end chamber wall gas-channels (not illustrated) of the bore to allow for the precise limited relief along the said breech end chamber wall by way of said gas-channels of a small portion of the expansive volume of bore column propellant gases from behind the projectile to flow forward into the projectile's co-chamber to bring about pre-ignition of the projectile's forward propellant charge, or to have limited said propellant gas expansion to flow past the projectile to accomplish some gained forward dispersion of the said forward charge of the projectile to more suitably meet its particular ballistic requirement analogously in particular ways previously exemplified by cartridge powder cases that use gas-channels.

Gas-channels may be formed into the wall of the breech end chamber of a barrel using caseless ammunition and low propellant gas pressure in its breech end chamber by cutting into the wall of said breech end chamber preferably shallow and narrow longitudinal grooves being equidistant and parallel to one another and formed in longitudinal lengths longer than the rear bearing surface of either projectile of FIGS. 12 and 16 but shorter than the combined lengths of the forward and rearward bearing surfaces separated by co-chambers of these said projectiles with said breech end chamber wall grooves acting as propellant gas-channels (not shown) to fill the co-chambers of said projectiles with propellant gases under pressure developed from a small propellant charge fired in the breech end chamber rearward of said projectile for purposes, as the projectile move forward along the bore, of pre-ignition of charge portions of the front charge of the projectiles deposited by the projectile into a bore wall chamber; and if dispersion and priming of the said front charge of the projectile as scattered along the bore in front of the projectile is desired the said gas-channel grooves in the breech end chamber's wall can be elongated to be somewhat a little longer than the combined lengths of the projectile's front and rear bearing surfaces that are separated by their co-chambers.

And in firearm barrels that do employ cartridge cases for cartridges in their breech end cartridge chambers, and the cartridge case not having gas-channels as in the embodiment of the cartridge case of FIG. 8, that cartridge case would provide a positive propellant gas seal in a tight chamber that is not oversized to keep propellant gases developed from a small charge at the rear of the projectile sealed from expanding forward past the projectile's bearing surfaces. The projectile's co-chamber may be filled with the said rear charge's propellant gases under pressure by having the first portion of the segmented bore wall as at 27B of FIG. 10, longer than only the rear bearing surface of the projectile and diametrically minutely larger than the caliber of the projectile's caliber to allow rear charge propellant gases to expand past the rear bearing surface of the projectile into the said projectile's co-chamber under pressure when the projectile is fired along the main bore with the forward bearing surface of the projectile's caliber obturating and sealing the bore at the true complemental caliber of a segmented bore wall portion as at 27C of FIG. 10, located immediately ahead of the bore wall chamber as at 26B.

The above said function of the diametrical widening of the segmented bore wall portion as at 27B of FIG. 10, can also be brought about and/or complemented by diametrical minute widening of the interior wall end portion of the mouth of the above cartridge case of FIG. 8, to be minutely diametrically larger, and preferably longer, than the caliber of the projectile's rear bearing surface, as exemplified when using the projectile embodiment of FIG. 16, in the cartridge case of FIG. 8, as illustrated in FIG. 10.

The projectile of FIG. 16, can be interchangeably used in any of the cartridge case embodiments of the specification providing that the projectile-seat and interior wall surface in each said cartridge case are of the proper complemental forms to meet with the particular projectile profile to be used in the said cartridge cases, and in which any of the projectile embodiments of FIGS. 12 and 16 would have the same correlative aforesaid functions within said cartridge cases as when assembled and fired as cartridges in the breech end cartridge chambers of the firearm barrels.

FIG. 10, illustrates particular embodiments of a firearm barrel and a cartridge loaded into its breech end cartridge chamber which functions thereof are fully described below.

The projectile embodiment as shown in FIG. 16, has a co-chamber, as at 10 which modulates bore column propellant gases, and the bore wall chamber's gases somewhat differently than the embodiment of the co-chamber as at 9 and 9A of the projectile embodiments of FIGS. 12 and 9. The greatest similarities of these projectile embodiments is the manner in which they are fired from the cartridge cases as shown in FIGS. 7 and 8 which in the foregoing description of the firing of the projectiles of FIGS. 9 and 12 within said cartridge cases 5, 7 and 8 and as when assemble and fired as a cartridge as at 34 of FIG. 3 is essentially the same manner of which the projectile of FIG. 16 may interchangeably be used and fired in these said cartridge cases forming a cartridge as at 51 of FIG. 10. The significant differences in the manner of propellant gas modulation of the projectile of FIG. 16, from that of the projectiles of FIGS. 9 and 12, begins as the projectile of FIG. 16, exits out of the mouth of the cartridge case into the main bore of the firearm barrel below.

Figure 18:
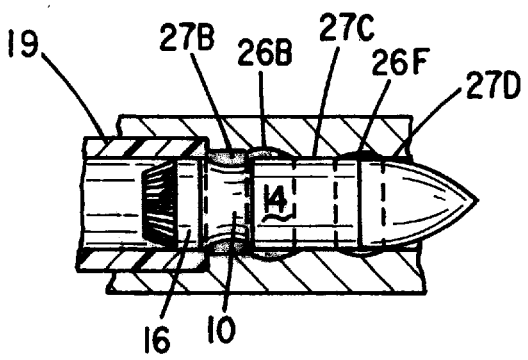
FIG. 18 is a broken-away sectional view of another embodiment of the firearm barrel with its bore structural configuration partially superimposed through its particularly embodied projectile in a first stage of fired transition along the bore.

The sequence of general ballistic events is now described as illustrated in FIG. 10, which in this scenario the cartridge 51 is loaded into a "tight" cartridge chamber 29B and cartridge case cannot be expanded outward away from the projectile upon the firing of primer 20 and firing of said primer accomplished by means of any known action which ignites the small rear charge 21 that develops only allow propellant gas pressure to force the projectile 16 forward with its bearing surface forced through the reduced caliber opening of the cartridge case's interior wall as at 37B compressing the case wall diametrically outward to caliber size which creates a positive seal against the projectile to prevent passage of the rear charge's propellant gases, and then as the projectile continues its forward movement the projectile's forward end enters the main bore with its front ogive form as at 28B upsetting the projectile's front propellant charge of gunpowder and thereby laterally forcing portions of said front charge of the projectile into bore wall chambers as at 26F as illustrated in FIG. 18, while the forward bearing surface as at 14 of the projectile's body fills and obturates a smooth caliber sized main bore wall second segment as at 27C confining the charge portion deposited into the bore wall chamber as at 26B rearward of the projectile and providing a seal against said segmented bore wall's bearing surface thereby also preventing bore column propellant gases under pressure from escaping entirely forward and entirely past the projectile while the rear bearing surface of the projectile as at 16 begins to pass by a first portion of the segmented bore wall as at 27B which is minutely diametrically larger than the caliber of the rear bearing surface of the projectile and larger than the true caliber of all other bore wall segments. The enlarged first bore wall segment allows a minute opening at the said rear bearing surface, as at 16 of the projectile for bore column gases under pressure to expansively be relieved through said opening along said bearing surface 16 and into the co-chamber 10 of the projectile and also into the first bore wall chamber 26B and igniting said bore wall chamber's charge captured and confined to bore column gas pressure by the obturative passing of the projectile's propellant gas sealing forward bearing surface 14 along the forward bearing surface of a true caliber sized smooth bore segment 27C of Fig.18, and proceeding to a succeeding caliber sized bore segment 27D.

The projectile's rear bearing surface and co-chamber 10 in transit to the next bore chamber 26F cooperate in conjoint-action in forming a single conjointly confined chamber together with the bore wall chamber 26F of FIG. 19 and in which said bore wall chamber the propellant charge portion deposited in it by the projectile has been ignited by bore column gases and explosively burns at a greater rate and reaches a higher magnitude of developed propellant gas pressure and heat then of the rear bore column's propellant gas pressure and heat and, with forward projectile movement, the segmented bore wall chamber as at 26F of FIG. 20, simultaneously together with its conjoined co-chamber 10 of the projectile expansively relieved their built-up heat and pressure of propellant gases rearward from the rear circumferential perimeter of the projectile's bearing surface as at 16 of FIG. 20 into the lower pressure and heat of the bore column gases as it moves past the circumferential co-axial perimeter of the rearward end of said bore wall chamber 26F of FIG. 20.

The effect of this relieved propellant gas pressure and heat from the said chamber is that initially when a gas that is held under pressure is suddenly relieved into a lower pressure environment there is a rise in pressure of the gases at their point of relief, and therefore a rise in propellant gas pressure caused to occur in the form of a shock-wave front of increased propellant gas pressure that immediately precedes propellant gas flowing to and from the orifice opening with a drop in pressure as at 18 of FIG. 20 point of relief by the initial annular opening being formed by the said transitory movement of the rear end of the projectile's bearing surface as at 16 of FIG. 20, in transit past the rearward end of the bore wall chamber as at 26F of FIG. 20, and the said shock-wave front of higher propellant gas pressure which immediately precedes the expansive flow of propellant gases from the opening of orifice 18 which increased pressure initially forces the projectile forward with greater force of its relieved propellant gases than that of the overall bore column's propellant gas pressure while said orifice 18 gas pressure also has a rearward force effect on the firearm barrel, as at the same moment the projectile's helicoidal heel area as at 4, tapered as at 2 of FIG. 16, together with the smooth bore wall segment as at 27C of FIG. 20, share the form of a transiently conjoined nozzle passageway as at 8 of FIG. 20, from said opening of orifice 18 which speed-up the expansive flow of said chambers propellant gases relieved ultra-high velocity through said opening of orifice 18 of the said nozzle with a drop in pressure occurring immediately behind said shock-wave front of increased propellant gas pressure which turbulently issue into the lower turbulent gas pressure of the bore column of gases and causing jet reaction propulsion forces to also force the projectile forward, as also does a forced change of direction of said jet stream of propellant gases along the helicoidal curve as at 40A of FIG. 16, of the projectile's tapered-heel 2.

In accordance with the said nozzle orifice 18 of FIG. 20, opening axis of orientation to propellant gas flow causing a degree of reactive jet-propulsive forward force to act on the firearm's barrel and which residual forward force of kinetic energy thereby absorbed by the barrel would resist to a degree or cancel the rearward reactive forces of recoil of the firearm barrel by opposing the force of the bore column gas pressure against the constant cross-sectional dimension of the diametric short axis of the breech face along with opposing the rearward reactive force acting on the barrel as also produced at the bore wall chamber rear perimeter half forming orifice 18, and finally also opposing the recoil jet reaction propulsive force acting on the barrel by its muzzle blast effect of released bore column gas pressure after the projectile leaves the barrel.

The coefficient ballistic steps as described for a bore wall segment correlated to the bore wall's recessed chambers being substantially repeated as the projectile's co-chamber 10 reaches succeeding bore chambers and bore segments as illustrated in FIG. 21, having adjacent rearward and forward bore wall bearing surface segments of true caliber and the projectile's co-chamber 10 having a mouth opening at the bearing surface of the projectile along the said projectile's longitudinal axis longer then each succeeding segmented bore wall's individual bearing surface lengths along the longitudinal axis of the firearm's barrel's bore, also as illustrated in FIG. 21 with said segmented bore walls bearing surfaces shown superimposed through the projectile in transit along the bore which allows areas of transient relief of the bore column's propellant faces under pressure to expansively flow past the rear bearing surface 16 of the projectile and along the projectile's co-chamber 10 and into succeeding bore wall chambers as at 26G of FIG. 21 and ignites a front charge portion within said chamber 26G deposited therein by the projectile and which said ignited charge in said chamber 26G a moment later becomes totally confined by the interaction of the forward and rearward bearing surface of the projectile passing along the complemental true caliber of the bearing surface of the segmented bore walls as at 27D and 27E of FIG. 21, rearward and forward of the said bore wall chamber 26G totally confining its charge within said chamber 26G and the co-chamber 10 of the projectile (similarly as illustrated in FIG. 19) and in which conjoined chambers 26G and 10 their charge then explosively burns at a greater rate to much higher gas pressure than the bore column of the propellant gases behind the projectile.

The higher gas pressure within said conjoined chambers 26G and 10 is relieved a moment later in the relatively much lower propellant gas pressure of the bore column in a manner substantially as described for the ballistic relief of high pressure propellant gases by said projectile 16 previously from the preceding second bore wall chamber as at 26F, and this ballistic step of projectile 16 interacting with the third bore wall chamber 26G repeated with each succeeding bore wall chamber recessed from the segmented bore's wall wherein each charge portion of the projectile's front propellant charge is deposited sequentially into each said succeeding bore wall chamber through an opening formed as before described as at 44 of FIG. 21 at each succeeding segmented caliber of the bore wall of true caliber in juncture with each said succeeding propellant charged bore wall chamber which a moment later becomes a duality of chambers when as sequentially conjoined with the in transit projectile's co-chamber 10; which conjoined chambers are confined by the projectile's transit rearward and forward bearing surfaces separated by the projectile's co-chamber 10 and thereby sequentially all of the bore wall chamber's charges are pre-ignited and then confined and relieved of their sequentially explosively developed propellant gases by transit interaction of the projectile's obturative bearing surfaces that bring about a series of explosive rises in propellant gas pressures that act directly at the projectile.

It is brought out here more specifically than said before that the interior diametric perimeter of the mouth of the cartridge case inward along its star crimp fold areas can also be formed with an annular opening minutely larger than the bearing surface caliber of the projectile to allow and/or complement rear charge propellant gases to expansively flow along the projectile to pre-ignite a portion of the said projectile's front charge in the first bore wall chamber; or the combined widening of the cartridge cases, mouth and first bore wall segment, as 27B of FIG. 18, can function to allow a limited spurt of expansive propellant gas flow from the said rear charge of the projectile to the said front charge of the projectile to thereby, to a certain degree disperse the said projectile's front charge while also pre-igniting it for sequential gathering and depositing into said bore wall chambers by the over-taking increasing speed of the body of the projectile.

This embodiment of the projectile of FIG. 16, can be interchangeably used in the cartridge case as at 19B of FIG. 5 with said cartridge case, when fired as a cartridge with the projectile of FIG. 16 having the same approximate interior ballistic functions as described in the foregoing specification for the projectile of FIG. 12 but with the bore of the firearm barrel of FIG. 10 having segmented bore walls, after the first segmented bore wall, having greater longitudinal expanse of their smooth segmented bore wall's bearing surfaces between the said bore wall chambers than the segmented bore walls of the firearm barrel illustrated in FIG. 3.

All embodiments of the projectiles illustrated in the accompanying drawings may have included in them any type of know internal guidance system of any conventional form or manner of implementation in keeping with the exterior structural integrity of the projectile to be fired along the firearm barrel's bore to guide them to their target with or without the use of helicoidal notches or vanes in the tapered-heel of the projectile; and using only neutral flow notches in the said tapered-heel of the projectile that turn propellant gas flow but not predominately to the right or to the left; or a notchless smooth tapered-heel of the projectile may be used.

Also it is further brought out in this specification that under certain interior ballistics the use of explosive propellant gases for especially lubricating the rear bearing surfaces of the projectiles, as at 15 and 16 of FIGS. 12 and 16 can be brought about more effectively for particular use in the firearm barrel by structurally altering of these said rear bearing surfaces and forming another embodiment thereof by minute reduction of their caliber in several ways relative to the caliber of the segmented smooth bore walls and the caliber of the front bearing surface of the projectile as at 13 and 14 of FIG. 12 and 16 below.

The said rear bearing surfaces structures of the projectile can be simply formed minutely reduced in caliber which would allow a molecular layer of each bore chamber's explosive gases to weep highly restricted between said rear bearing surfaces of the projectile and the caliber of the bearing surfaces of the segmented smooth bore walls to provide a molecular layer of explosive gases there between to act as an explosive gas lubrication between these said bearing surfaces while not significantly effecting the development of high propellant gas pressure from ignited charges in the said bore wall chambers of the firearm barrel.

In another embodiment the rear bearing surface reduction of the projectile can be brought about by use of the high gas pressures developed in each succeeding bore wall chamber. This means of reduction of the projectile's rear bearing surfaces from their full caliber can be brought about automatically by high gas pressure of the bore wall chambers because gas pressure developing from an ignited charge in a bore wall chamber develops its highest gas pressure against the rear bearing surfaces of the projectile; and a projectile's body can be materially constructed to be slightly compressible at a given magnitude of high gas pressure developed in each succeeding bore wall chamber preferably only at the projectile's rear bearing surface of the projectile now pressured away from the full caliber of the segmented bore walls bearing surfaces to thereby weep through to lubricate these said bearing surfaces with high pressure explosive gases sequentially made available at each succeeding bore wall chamber of the firearm barrel. And the said projectile's interior ballistics functions can be made to be more efficient if the said compressible rear bearing surfaces of the projectile are made to be materially constructed to have resiliently elastic properties of compressabilities.

And as a fail-safe measure the said compressible rear bearing surface of the projectile can become even more highly compressed by any accidental excessively high gas pressure that might become developed in any bore wall chamber; and thereby any bore wall chamber having excessively high gas pressure will have the excess of its gas reduced caliber of the rear bearing surface of the projectile and segmented caliber of the bore wall's bearing surface and into the lower pressure of the bore column of propellant gases behind the projectile before said bore wall chamber's gases can rise high enough in excess pressure to become deleterious to the integrity of the firearm's barrel without interruption of repeated firing of the firearm.

Rifling as described in the foregoing specification greatly reduced the magnitude of velocity to which a projectile can be safely accelerated along the bore of the firearm barrel, and will be an obstacle preventing projectiles from safely reaching their full potential velocity and energy at the muzzle; but rifling could be safely used with its lands and grooves cut helically synchronized into each of the segmented bore walls forming another embodiment of the firearm barrel of this invention to impart a twist to projectiles not having pre-formed helicoidal notches in their heels for particular firearms in which ultra-high projectile velocities and energies are not desirable to be obtained in the bore; but what would be desirable would be just to reach the lower conventional feet per second velocities and foot pounds of energies at the muzzle of a barrel as efficiently and safely as possible with as little recoil as possible of the firearm barrel using the principles and elements of this invention when including using rifling in the bore.

When rifling is used in the segmented bore wall the rear charge of the projectile should be kept as small as practically possible to initiate the projectile's speed at the lowest practical velocity as it enters with a long "jump" into the first rifled segmented bore wall area into which it is introduced as gently as possible for indentation of the lands of the rifling into its bearing surface and with the potential energy of the forward main charge of the projectile accordingly reduced correlated to a reduction in the rate of feet per second velocity with which the lands of the rifling will allow the projectile to be safely accelerated along the bore. The said front main charge of the projectile can be pre-ignited and dispersed when using a projectile not having a helicoidally formed heel, and not having a co-chamber formed at its bearing surface seated in the simpler form of a cartridge case as shown in FIG. 8 forming a cartridge for use in an over sized cartridge chamber of the breech end of the firearm barrel, as described in the foregoing specification, that allows the cartridge case when fired to expand in its cartridge chamber away from the bearing surface of the projectile nested in it to allow a portion of the developing gases of the ignited rear charge of the cartridge to expand around the forward past the projectile to ignite and disperse its front charge.

And the projectiles should have preferably a tapered-heel or as sometimes termed a boat-tail that includes a curved surface for causing turbulent flow of propellant gases issuing from the bore wall chambers and preferably, too, in the form of a helicoidal-heel of the projectile as illustrated in the drawings to cause a multitude of eddies in turbulent flow of the said propellant gases as further described below.

The increasing volume of the length of the bore column of gases behind the in transit obturating body of the projectile allows an increasing volume of space into which all of the bore's gases can expand with the overall gas pressure of the bore column of gases behind the projectile kept relatively low relative to the turbulent relief of the high pressure propellant gases issuing from the bore wall chambers of which the shock of introduction is decreased into the bore column of gases by the turbulence established in the said bore column of gases by the turbulent gas flow along the helicoidal-heel of the projectile in reference to the relative greater shock if the said bore column of gases were not turbulent and had a higher velocity of streamlined flow, because instead of a head-on collision occurring with a static pressure head of propellant gases of a streamline flow which could otherwise cause formation of deleterious lateral pressure shock waves onto the barrel's mass, there is instead a meeting of two harmoniously converging turbulent sources of propellant gas flow with one of a higher power issuing from the bore wall chambers converting to the one with the lower power of the bore column of gases resulting in turbulent diffusion of all these propellant gases with the exchange coefficient for the diffusion of a conservative property caused by eddies in the turbulent flow being turned at a greater rate with the slower rate of turning or revolving of eddies in the lower power of turbulent flow of the bore column of gases being increased in their rate of turning or revolving by the invasion of the higher power's turbulent flow of gases issuing from the bore wall chambers having eddies turning or revolving at a much higher rate resulting in the distribution of kinetic energy among eddies with various frequencies of rotation and sized dies to the combined magnitudes of turbulent heated mass transfer being equal to the ration of the eddy mass diffusivity to the eddy thermal diffusivity correlative to the coefficient of turbulent flux in accordance to the differing pressures heat and turbulent flow of the bore wall chamber's propellant gases meeting with differing pressure heat and turbulent flow of the bore column of propellant gases.

The interchange coefficients of the propellant gases is brought about to be more safely efficient by the establishment of coefficients of eddy flux in turbulent flow in the bore column of gases preferably at the bore column of gases lowest possible practical pressure and low initial streamlined flow velocity from the breech area to turn said streamlined flow of the bore column of gases from the breech early on to a highly turbulent flow along the bore column thereby to reduce the magnitude of the formation of lateral pressure shock waves in the expansive flows of propellant gases as aforesaid especially further along the bore of the muzzle end of the firearm barrel whether or not the projectiles are to be rotated by gas pressure action on their helicoidal-heel; because it is desirable to have the propellant gases turned immediately at the rear end of the projectile's rear bearing surface along curves, or a curve formed in the heel of the projectile, even if the turning of these gases does not cause rotation of the projectile, and propellant gas flowing turbulently out of the bore wall chambers will still efficiently accelerate the projectile forward by the combined effects of the propellant gases as, aforementioned, when they are suddenly relieved from the bore wall chambers under pressure, the said gases undergo a rise in pressure at the points of relief in the form of a shock-wave front of higher pressure, and because this rise in pressure of the propellant gases is brought about at points between two moveable objects (namely the firearm barrel and the projectile) with one body having a much greater mass and inertia (the firearm barrel) then the other body (the projectile) the forwarded positive acceleration of the body of less mass and inertia (the projectile) is greater and becomes still greater as the said gases of the bore wall chambers become turned against the curved surfaces of the projectile's body while producing a certain amount of jet-reaction propulsion force effects which although reduced by the turbulence of the gases relieved from the said bore wall chambers along the curved nozzle passageway formed by the projectile's heel, these said jet-reactionary propulsive forces are only secondary to their safe turbulent introduction into the bore column of gases while the orifice of the said nozzle still increases propellant gas pressure at point of relief between the said bore wall chambers of the firearm barrel and the projectile while the immediate turbulent flow from the said orifice along the rear curved structure of the projectile push the projectile forward, while some of the jet-reaction propulsion forces reduce recoil of the firearm barrel as described in the foregoing specification.

The preferred projectiles of this specification as illustrated in the accompanying drawings having cylindrically formed rearward and forward bearing surfaces or proper caliber complemental to the proper cylindrical form of the proper caliber of the segmented smooth bore walls bearing surfaces, and the co-chambers of the projectiles can be more than one in number, or the annular groove of the said co-chambers can also be formed into separate cavities or recesses in and around the caliber of the projectile's bearing surface leaving an area of continuity of the front bearing surface to extend to the rear bearing surface to provide added support to the projectile by its bearing surface while in transit along the bore bridging the mouths of the bore wall chambers.

The co-chamber 9 of the projectile shown in FIG. 12 has a mouth of less length along the longitudinal axis of the projectile than the length of the smooth caliber of a segmented bore wall along the longitudinal axis of the bore and thereby capable of relieving a short burst of extremely high velocity propellant gases of low mass and of high heat and pressure previously captured in it from developing propellant gas pressure of a preceding bore wall chamber into a succeeding charged bore wall chamber and thereby ignites the succeeding bore wall chamber's charge in a very short space of time which is an advantage for projectiles reaching for the highest velocity along the bore by giving each of the bore's bore wall chambers charges the advantage, by ultra-fast priming and ignition, of reaching their fullest potential of explosive high pressure capacity of a volume of high energy propellant gases safely in shortest possible time.

Any adverse jet-reactionary force effects, or nozzle orifice force effects on the firearm barrel by the relief of the projectile co-chamber's high pressure gases into the bore wall chambers is neutralized on its effects on the barrel by the sudden termination of the jetstream of gases relieved out of said co-chamber against the charge and against the forward end of the chambers, the force of which neutralizes any jet-reactionary rearward propulsive force acting on the barrel; and any adverse jet-reactionary propulsive force acting on the projectile by relief of its co-chamber's high pressure gases are overcome to the advantage of the projectile by the change of direction of the gas flow to some degree along the forward slope of the said co-chamber's surface and which said gases thereby give up some of their kinetic energy to the projectile while the said co-chamber's gases undergo an increase in pressure at their sight of sudden relief at the jet-orifice formed between the annular opening at the forward edge of the said co-chamber and the rear edges of the bore wall chambers and which increased gas pressure at the said co-chamber's jet-orifice pushes the projectile forward.

The co-chamber as at 10 of the embodiment of the projectile shown in FIG. 16 has a mouth of a length larger and longer then the smooth caliber bearing surface of the segmented bore wall, with the length of the rear bearing surface of the projectile not as long as the length of each one of said bore wall segments, nor as long as a mouth of the recessed bore wall chambers and therefore this projectile embodiment of a co-chamber's charge primer means ignites relatively lower pressure of the bore column gases to flow into each bore wall chamber to ignite the charge; but the said co-chamber embodiment of this projectile 16 has the advantage of being able to be structurally configurated into a conjoined position with the bore wall's chamber structure to share, within the structure of the volume of its co-chamber, in both the priming and development of a larger volume of high energy propellant gas pressure sequentially in each bore wall chamber in conjoined relationship with the said co-chamber 10 for simultaneous rearward relief from the projectiles of their chambers combined volume capacity of high pressure high energy propellant gases; and thereby this said structural configuration of the bore's and projectile's chambers greatly increases the overall volume and mass of high energy propellant gases made available to be relieved rearward directly from the projectile, relative to the alternate embodiments of the bore's and projectile's chambers of FIG. 3, to increase the projectile's forward velocity along the barrel's bore to the muzzle end.

And in this embodiment of the projectile's co-chamber as at 10 of FIG. 16 the length of the bearing surface of each of the segmented caliber sized smooth bore walls in configuration with the bore wall chamber structure also governs the magnitude of propellant gas pressure that can be reached or developed in the said bore wall chamber by the interaction of the projectile's bearing surface. Therefore, too, it can be seen that by increasing the length of the segmented bore walls while keeping the same volume and form of the co-chamber of the projectile, and also keeping the same volumes and form of the bore chambers recessed from the segmented caliber of the bore's wall as illustrated at 26G FIG. 19, and as at 26 of FIG. 2 propellant gas pressure can be governed within the said chambers in ratios accordingly to varying the lengths of the caliber of the bearing surface of said segmented bore wall, and in accordance to other interior ballistics as brought out and described in the foregoing specification; and in this manner of configurations of the bore wall bearing surfaces with the projectile all the bore wall chambers, as at 26 of FIG. 2 of the firearm barrel 32 can be of the same preferred shallow broad form and volume capacity for receiving the compact depositing of explosive charges relative to the caliber of the bearing surface of the segmented bore walls as at 27 of FIG. 2 with each said bore wall chamber's gas pressure regulates at near ideal maximum gas pressure by properly increasing the length of each succeeding segment of the caliber of a bore wall bearing surface propellant interface along the bore to the muzzle to match the increasing velocity of the projectile in transit along the bore to the ideal confinement time of each explosive charge portion deposited in each bore wall chamber by the projectile.

So, therefore, by increasing the length of the caliber of the bearing surfaces of the segmented bore walls with each succeeding said bore wall segment a little longer than preceding said wall segment, all the bore wall chambers charges can be brought to more harmoniously burn explosively in their chambers to develop propellant gases to proper pressure in each succeeding bore wall chamber interactively with the projectile's bearing surfaces, and especially of the projectile's rear bearing surface embodiment of FIG. 16. And with proper increased lengths of the said interfaces of the caliber of the bore wall bearing surface segments the bore wall chambers will thereby have more time to develop their propellant gases in succession within their volumes, and also interactively expansively within the conjoined volume of space provided by the co-chamber 10 of the in transit projectile with the said explosively developed propellant gases in each succeeding bore wall chamber simultaneously relieved rearward out of these chambers of the bore wall and of the projectile between the rear end of the projectile's bearing surface interface and rearward out from between each succeeding interface of the bearing surface of the segmented caliber portion of the bore wall exposed to the mouth of the projectile's co-chamber and into the lower pressure of the bore column of propellant gases which lower pressure is used by way of the projectile's bearing surface propellant interfaced and its co-chamber 10 to prime the ignition of each subsequent projectile charged bore wall chamber and thereby accelerating the projectile's forward movement along the bore as described in the foregoing specification.

And it being further brought out here that although with increased lengths of the said segmented caliber of the bore's bearing surfaces which can be eventually formed in this embodiment longer than the width of the projectile's co-chamber 10, the projectile's co-chamber will then capture a portion of the lower pressure of the bore column of propellant gases by the interface interaction of the bearing surfaces of the segmented bore walls correlated to the rear interface bearing surface of the projectile which longitudinal length remains shorter, then, than the longitudinal length of the expanse of the mouths of the chambers recessed from the bore wall; and by which a moment later as the projectile moves a short distance further along the bore the low pressure bore column gases captured in the projectile's co-chamber 10 are relieved into a succeeding charged bore wall chamber which pre-ignites the said bore wall chamber's explosive charge and its developing gases then expand into the low pressure co-chamber 10 of the projectile which safely allows a greater volume of explosive gases to be developed (compared to the embodiment of the projectile's co-chamber 9 of FIG. 12) simultaneously within the said chamber of the bore wall and said co-chamber 10 of the projectile from the said segmented bore wall chamber's charge consistent in each succeeding bore wall chamber.

It is noted that the flow of propellant gases either forwardly or rearwardly along the helical curves of the projectile's helicoidally notched heel will impart a twisting force rotating then projectile in the same direction around its longitudinal axis regardless of the direction of flow of the said propellant.

In conclusion the simplest and least desirable and least preferable embodiment of a projectile for use in the firearm barrel of FIG. 3 using some of the principles and elements of this invention to maintain low pressure of the bore column of propellant gases behind the projectile producing only a mild recoil of the firearm barrel by deployment of the projectile's main front charge in stages along the barrel's bore would be to have a plain projectile with a sufficiently long cylindrical bearing surface of proper caliber to span the segmented bore wall chambers as at 26 enough to form positive propellant gas seals against the segmented caliber of the bearing surfaces of either smooth or rifled bore walls to keep bore column propellant gases positively sealed to the rear of the projectile with the projectile fired from a cartridge case as at 19B but the gas-channels as at 24 may preferably be omitted from the case structure but retaining the cartridge case's special flexible gas sealed rings, as at 36 and forward end case sealing means of the compressible undersized caliber of the case wall structure as at 37 that also keep propellant gases sealed to the rear end of the projectile's bearing surface; and by these means of sealing propellant gases the projectile when fired by low propellant gas pressure developed from its rear charge within a tight cartridge chamber at the breech end from its cartridge case would simply sequentially deposit portions of its front charge unignited into each succeeding bore wall chamber, and each said unignited explosive charge portion in the said bore wall chamber, and each said unignited explosive charge portion in the said bore wall by the proper caliber of the projectile's long bearing surface spanning said bore wall chambers against the caliber of the complemental bearing surfaces of the segmented bore walls, and then the said bore wall chamber's explosive charges sequentially passing rearward of the projectile's bearing surface and exposed to the heat and pressure of the bore column of propellant gases which ignites the said exposed bore wall chamber's charges which then explosively burn contributing their developing gases to the overall volume, pressure and hear of the bore column of propellant gases that together continually produce propellant gases of regulated low pressure which continues to act on the constant diametric transverse dimension of the breech maintaining a mild rearward recoil of the firearm barrel while maintaining the forward acceleration of the projectile by said low pressure propellant gases that do not rise very high in pressure with the developing propellant gases generated from the said bore wall chamber's explosive charge due to the greatly increasing volume of the overall dimension of the bore column sealed to the rear of the forward transit movement of the projectile along the bore of the muzzle end.

Whereby this method as just described in the above paragraph would gently accelerate the projectile along the bore to a limited muzzle velocity while keeping recoil of the firearm barrel mild by maintaining a low propellant gas pressure against the breech end; but the bore wall chamber's explosive charge could not be relied on in every instance not to become haphazardly pre-ignited accidentally in this embodiment while the said explosive charges are contained and confined in each said bore wall chamber by the bearing surface of the projectile due to, for example, from hot debris such as still slowly burning unconfined remnants of charge grains that may be left in the bore wall chambers from previous shot of a rapid firing automatic weapon which might somewhat randomly pre-ignite some of the succeeding fresh explosive charges deposited into the bore wall chambers; and frictional heat build-up in the firearms barrel might also somewhat contribute to said charge pre-ignition which would further restrict the broad use of certain combinations and types of gunpowders, especially of the very quick-burning types that would otherwise be most practical in this embodiment for use to develop to quantify a volume of propellant gases to pressure behind the projectile when raw explosive charges are passed into the copiously increasing volume of the dimensions of the bore column behind the said projectile; and in any event in this particular embodiment, as compared to other embodiments, efficient very high velocities of the projectile to the muzzle end could not be obtained, especially while maintaining mild recoil of the firearm barrel; and accuracy from one shot to the other to the target could not be relied on. Therefore it being more practical and efficient to plan and design for pre-ignition of explosive charges in the firearms barrel's bore ahead of the projectile and/or within the bore's bore wall chambers as transiently confined in the said bore wall chambers by the transit body of the projectile as disclosed and preferred in other embodiments of the foregoing specification where much more reliable and efficient acceleration of the projectile can be obtained at higher velocities and in a shorter space of time while controlling recoil of the firearm barrel which ballistics are more desirable that to try to prevent pre-ignition of the bore wall chambers charges ahead of the projectile, or as confined in the bore's bore wall chambers.

The mouth of the cartridge case of a cartridge may be closed and sealed in any convenient manner such as by forming, and aforesaid, a conventional star crimp, or sometimes termed an indent crimp formed by a number of indents in the circumference of the encircling mouth which is folded over to make an enclosure; or the mouth of the cartridge case may be left in its natural cylindrical shape and simply closed by a plug of wax, or its perimeter may have a rolled crimp in which the rim of the cartridge case is turned inward around its circumference holding in, at the top surface of the projectile's front charge, a fragile propellant wafer disc of proper diameter to block the opening of the said cartridge case's mouth, and a wax-like substance or compound used to seal the said propellant wafer in place (wafer and sealant not illustrated) and thereby sealing in the contents of the cartridge. And upon firing of the said cartridge the said wafer is fractured into many places and eventually burned explosively in the firearm barrel's bore wall chambers while sealing substance for the said wafer may also act as a bore lubricant.

The rearward recoil of the firearm barrel in reaction to firing of a charge of propellant within a chamber of the breech area is also reduced due to the projectile's front charge portions upsetting force of impacts forwardly into and onto the segmented bore chamber's walls.

In the final analysis the bore wall chambers may be sized and spaced in any convenient practical form and configuration to meet requirements of the projectile herein when fired along the bore as specified, and the projectiles may have any convenient practical size and configuration of the complemental caliber of its rearward and forward bearing surface in configurate with any practical form and size of a chamber recessed into the surface of the projectile between its said rearward and forward bearing surfaces to meet requirements of the bearing surfaces of the bore and its bore wall chambers as further brought out and exemplified in FIG. 22 in that the bore wall chambers may be spaced and formed in practical conformity to the rearward and forward bearing surfaces of the projectile 53, as at 54 and 52 for capture of front charge 57 portions to open in any practical number at the mouth of the co-chamber 55 of the projectile to bring about the development of a volume of propellant gas pressure from more that one explosively charge bore wall chamber at a time as at 56, 56A and 56B exposed and confined to the projectile's co-chamber as at 55 while only one bore wall chamber's volume of explosively developing gases under pressure as at 56 are sequentially captured and confined at a time at the transit rear bearing surface, as at 54 of the projectile, to be relieved rearwardly of the projectile one at a time in a manner previously described for rearward propellant gas pressure relief.

This interacting conjunction of chamber means is that while two or more explosive propellant charge filled bore wall chambers as at 56, 56A and 56B, and like chambers are sequentially opening at, and burning conjointly with, the transitory co-chamber 55 of the projectile, that the potential volume and pressure of developed propellant gases combined within these conjointly confined chambers of the bore wall exposed to the co-chamber 55 of the projectile will always be in a state of higher magnitude of developing gas pressure relative to each succeeding single volume of developed gas pressure of a single bore wall chamber 56 becoming independently captured at the transitory rear bearing surface as at 54 of the projectile 53 to be relieved sequentially rearward of the projectile, hence the conjoint-action of developing confined gas volume and pressure of the bore wall chambers as at 56, 56A and 56B thereby sequentially conjointly grouped together in captured succession transiently confined to the co-chamber 55 of the in transit projectile will continue to rise in pressure due to maintaining two or more grouped bore wall chamber's charges confined to explosively burn at a time to produce greater volumes of explosive gases confined transiently together under pressure as captured to expand into co-chamber 55 of the projectile 53, relative to the much smaller volume of only one bore wall chamber of high propellant gas pressure as at 56 being eventually sequentially independently captured and then relieved at a time at the rearward end of the projectile's rear bearing surface, as at 54; and with each successive portion of a captured volume of propellant gas pressure thereby relieved from a bore wall chamber at the rear of the projectile having a higher magnitude of propellant gas pressure at the point of relief than a preceding one of said bore wall chambers resulting in successively higher and higher magnitudes of propellant gas pressure at the point of relief at the rear end of the projectile's rear bearing surface as at 54 occurring to gradually effect higher and higher increases in the projectile's forwarded velocity; and with projectiles furnished with helicoidal-heels effecting a gradually gained rotational speed.

The gradual increasing force of said sequentially relieved explosive propellant gases thereby act to accelerate the projectile more gradually and gently in this embodiment to its full velocity at the muzzle; and which manner of projectile acceleration may especially be desirable for the protection of any fragile type payload which may be carried by the projectile not being subjected to deleteriously high adverse initial inertial resistance to projectile acceleration.

The structure of each projectile embodiment can be conformed to interchangeably be used in any of the cartridge-case embodiments, or the cartridge-case structure conformed to the projectile to make up various types of cartridges with various combinations all of which can be used interchangeably with the barrel embodiments, as the barrel embodiments can be interchangeably structurally conformed to be used with any cartridge components combinations, all component embodiments of the barrel, projectiles, cartridge-cases and cartridges can alternately meet a broad range of certain firearm ballistics functions as disclosed in the specification.

For some firearms, reducing muzzle blasts for sake of increased projectile accuracy when the projectile exits the muzzle can be advantageous. And, muzzle blast can be reduced by lowering bore column gas pressure kinetic energy potential along the bore column to the muzzle end behind the projectile before it exits the muzzle.

In this invention lower column gas pressure expansive kinetic forces released at the muzzle can be naturally attained while maintaining, to a degree, interior ballistics coefficient efficiencies to continue to act with intermittent expansive kinetic propellant gas energy concessions of static pressure of the bore column at the projectile into the bore wall chambers used in the bore by allowing early depletion of the projectile's front charge as deployed along the bore leaving a forward series of empty bore wall chambers to act as bore column gas pressure expansion chambers to lower bore column energy efficiently when propellant gases under static pressure in the bore and acting on the rear areas of the projectile are subjected to a partial sudden limited relief of static pressure, into a relatively low pressure and temperature captured environment of a pressure relieving expansion chamber opening into the bore wall forwardly of the point of maximum propellant gas pressure, at the instant when the bearing surface of the projectile has initially passed the chamber opening in the bore wall, whereupon the transiently accelerated bore gases are turned by the projectile to which said bore gases give up some of their momentum absorbed from the column of high pressure gases in the bore to thereby effect continuing rotation of the projectile and increases its forwarded velocity, the gases in the said captured environment thereafter turbulently receding rearwardly of the projectile to become a part again of the column of gases in the bore and the residual energy of the gases in said captured environment not absorbed by the projectile or barrel becoming a part of the total energy that thereby decreases in the column of gases in the bore, the method including the steps of repeating said partial sudden limited relief of column static pressure into subsequent expansion chambers to thereby recycle said residual energy which, together with the energy in the column of gases, cause transitory increases in projectile rotation and forwarded velocity by converting more of the static pressure of the gases in the column into dynamic pressure at the projectile which thereby absorbs and stores kinetic energy from the column of bore gases with projectile velocities below 1.25 miles per second while in the barrel for free flight accuracy purposes correlated with reduction of the magnitude of bore column expansive kinetic energy relief of gases at the muzzle in the form of muzzle blast reduction as the projectile exits the barrel.

It being noted here that the bore wall chambers when used as chargeless expansion chambers work more efficiently with the projectile structural means as shown in FIG. 12 and that at first several empty bore expansion chambers will be used to reduce the high gas pressure of the projectile's co-chamber charged with high pressure gases from the last charge activated bore wall chamber, and after the co-chamber pressure is reduced, expansive column gas pressure will continue to effect the forward and tangential rotational forces to act on the projectile as aforesaid.

And it can be clearly seen as illustrated in the drawing that the projectile will be rotated by its helicoidal heel means to the same direction of rotation by the force of propellant gases flowing either rearwardly or forwardly along the projectile's helicoidal heel area.

In compliance with the statutory requirements, the invention in various embodiments has been described in language more or less specific as to structural features and methods to enable one of skill in this art to practice the invention. It is to be understood, however, that the invention is not limited to the specific features and methods shown and described, since the means and construction herein disclosed comprise preferred forms of putting the invention into effect. The invention is, therefore claimed in any of its forms or embodiments within the legitimate and valid scope of the appended claims.

I claim as my invention:

1. A cartridge system round of ammunition for launching a projectile and pushing a propellant charge at the front of the projectile out of the cartridge and along a bore of a gun barrel, said cartridge system round of ammunition comprising:

a cartridge casing having a casing bore defining a projectile passageway and a casing sidewall having an interior surface, said cartridge casing containing:

(a) a projectile having a rear end and a front end, and a bearing surface defining an interface in association with said casing;

(b) a first propellant charge placed at said rear end of said projectile; and (c) a second propellant charge placed across the frontal area of said projectile forward of said bearing surface, said second charge being disposed in a transverse positional arrangement extending inward from the interior surface of said casing sidewall and nested within said casing bore and directly in the path of said projectile.

2. The system of claim 1 wherein said projectile further includes a front ogive surface.

3. The system of claim 1 wherein the projectile includes a helicoidally structured rear end.

4. The system of claim 1 and further including at least one gas channel extending along said bearing surface of said projectile.

5. The system of claim 1 and further including means for preventing forward movement of said first primer propellant charge along said projectile body.

6. The system of claim 1 and further including means for allowing forward movement of said first primer propellant charge along said projectile body.

7. The system of claim 1 wherein said projectile further includes a chamber opening into said bearing surface.

8. The system of claim 1 wherein said first propellant charge operates as a primer for said second propellant charge.

9. The system of claim 1 wherein said cartridge casing includes a seal between said first and said second propellant charges.

10. The system of claim 1 and further including at least one gas channel extending along said inner surface of the sidewall of said cartridge casing.

11. The system of claim 1 wherein said second propellant charge comprises a plurality of charges selected from the group consisting of layered and stacked charges.

12. The system of claim 1 wherein said second propellant charge comprises a plurality of charges of different compositions.

13. The system of claim 1 wherein said second propellant charge comprises a plurality of charges having differing characteristics selected from the group including differing grain and web characteristics.

14. The system of claim 1 further comprising a recess in said interior surface of the sidewall for primer charging through said chamber opening into the bearing surface of said projectile.

15. A cartridge system round of ammunition for launching a projectile and pushing a propellant charge at the front of the projectile of a cartridge along a bore of a gun barrel, said cartridge system round of ammunition comprising:

a cartridge casing having a casing bore defining a projectile passageway and sealing means and a casing sidewall having an interior surface, said cartridge casing containing:

(a) a projectile having a rear end and a front end, and a bearing surface defining a bearing surface interface in association with said casing, and at least one chamber opening into said bearing surface interface;

(b) a first propellant charge placed at said rear end of said projectile;

(c) a second propellant charge placed across the frontal area of said projectile forward of said bearing surface, said second charge being disposed in a transverse positional arrangement extending inward from the interior surface of said casing sidewall and nested within said casing bore and directly in the path of said projectile; and (d) at least one gas channel extending along said interior surface of the sidewall of said cartridge casing.

16. The system of claim 15 and further including at least one gas channel extending along said obturator surface of said projectile.

17. The system of claim 15 and further including means for preventing forward movement of said first primer propellant charge along said projectile body.

18. The system of claim 15 and further including means for allowing forward movement of said first primer propellant charge along said projectile body.

19. The system of claim 15 wherein said first primer propellant charge operates as a primer charge for said second propellant charge.

20. The system of claim 15 wherein said at least one gas channel extending along said interior surface of said casing sidewall, in association with said casing bore sealing means associated with said interface bearing surface of said projectile, provides an access between said first propellant charge and said second propellant charge for primer-igniting said second propellant charge after it is displaced from said cartridge.

21. The system of claim 15 wherein said at least one gas channel allows primer charging of said chamber opening into the bearing surface of said projectile.

22. A projectile system round of ammunition for launching a projectile and pushing an associated propellant charge from a cartridge system along a gun barrel bore having a plurality of spaced barrel recessed chambers of predetermined length and spaced apart at a predetermined spacing distance therebetween, said round of ammunition comprising;

a) a hollow cartridge casing having a casing bore with a longitudinal axis defining a projectile passageway b) a projectile located in said cartridge casing, said projectile having a longitudinal axis, a rear end, a front end, a rearward obturator bearing surface, a forward obturator bearing surface, and a projectile recessed chamber formed between said rearward and forward obturator bearing surfaces;

c) a seal on said cartridge casing, said seal in contact with said projectile;

d) a first propellant charge positioned in said cartridge casing and rearward of said projectile; and e) a second propellant charge placed across the frontal area of said projectile forward of said bearing surface, said second charge being disposed in a transverse positional arrangement extending inward from the interior surface of said casing sidewall and nested within said casing bore and directly in the path of said projectile.

23. The system of claim 22 wherein said forward obturator surface has a length less than said predetermined length of said spaced barrel recessed chambers of said plurality of recessed chambers of said bore of a gun barrel.

24. The system of claim 22 wherein said forward obturator surface has a length greater than said predetermined length of said spaced barrel recessed chambers of said plurality of recessed chambers of said bore of a gun barrel.

25. The system of claim 22 wherein said rearward obturator surface has a length less than said predetermined length of said spaced barrel recessed chambers of said plurality of recessed chambers of said bore of the gun barrel.

26. The system of claim 22 wherein said rearward obturator surface has a length greater than said predetermined length of said spaced barrel recessed chambers of said plurality of recessed chambers of said bore of the gun barrel.

27. The system of claim 22 wherein said projectile recessed chamber has a length greater than said predetermined distance between said plurality of spaced barrel recessed chambers of said bore of the gun barrel.

28. The system of claim 22 wherein said projectile recessed chamber has a length less than said predetermined distance between said plurality of spaced barrel recessed chambers of said bore of the gun barrel.

29. The system of claim 22 wherein said second propellant charge is larger than said first propellant charge.

30. The system of claim 22 wherein said second propellant charge comprises a plurality of charges selected from the group consisting of layered and stacked charges.

31. The system of claim 22 wherein said second propellant charge comprises a plurality of charges of different compositions.

32. The system of claim 22 wherein said second propellant charge comprises a plurality of charges having differing characteristics selected from the group including differing grain and web characteristics.

33. The method for launching a projectile and propellant charge from a cartridge round of ammunition along a main bore of a gun barrel having a cartridge receiving chamber and a bore wall and a series of spaced recessed bore wall chambers of predetermined length and spacing along said bore wall, said method of launching said projectile and propellant charge comprising the steps of:

a) providing a projectile with a longitudinal axis, a rear end, a front end, a rearward obturator surface, a forward obturator surface, and a recessed projectile chamber recessed between said rearward and forward obturator surfaces;

b) providing a cartridge case having a bore with a longitudinal axis, a sidewall and a case seal in said cartridge case;

c) placing a first propellant charge and locating, said projectile in front of said first propellant charge in said cartridge case, said projectile being in contact with said case seal; and d) placing a second propellant charge in said cartridge case across the frontal area of and in the path of said projectile and securing the front end of said cartridge case;

e) placing said cartridge case in said cartridge receiving chamber of a gun barrel;

f) igniting said first propellant charge;

g) launching said projectile and forward propellant charge; and h) deploying and igniting portions of said second propellant charge along said main bore of said gun barrel and in said series of recessed bore wall chambers of said main bore of said gun barrel.

34. The method of claim 33 and including the step of providing friction-sensitive explosive film lubrication of said main bore of said gun barrel and said projectile, material of said explosive film lubrication being contained in said second propellant charge, said explosive film operating as a primer for said second propellant charge.

35. The method of claim 33 and further including the step of allowing said first propellant charge to travel along the projectile body and ignite said second propellant charge.

36. The method of claim 33 and further including the step of preventing said first propellant charge to travel along said projectile body and ignite said second propellant charge.

37. The method of claim 33 and further including the steps of developing peak pressure of each said portion of second propellant charge in each subsequent said recessed bore wall chamber of a gun barrel of said series of bore wall chambers greater than developed peak pressure of each preceding said bore wall chamber of said series of bore wall chambers.

* * * * *

UNITED STATES PATENT AND TRADEMARK OFFICE

CERTIFICATE OF CORRECTION

PATENT NO. : 6,085,630
DATED : July 11, 2000
INVENTOR(S) : John R. Manis

It is certified that error appears in the above-identified patent and that said Letters Patent is hereby corrected as shown below:

Delete Title page and substitute therefore the attached title page as shown on the attached page.

Delete columns 1-44 and substitute therefore columns 1-44 as shown on the attached pages.

Signed and Sealed this

Sixth Day of May, 2003

JAMES E. ROGAN
*Director of the United States Patent and Trademark Office*

United States Patent [19]

Manis

[11] Patent Number: 6,085,630

[45] Date of Patent: Jul. 11, 2000

[54] GUN PROPELLANT SYSTEMS AMMUNITION

[76] Inventor: John R. Manis, 17320 Meridian Blvd., Hudson, Fla. 34667-4937

[21] Appl. No.: 09/168,323

[22] Filed: Aug. 26, 1998

Related U.S. Application Data

[63] Continuation of application No. 08/592,575, filed on Jan. 26, 1996.

[51] Int. Cl.[7] ..... F41F 1/00; F41A 21/00; F42B 3/00; F42B 14/00

[52] U.S. Cl. ..... 89/8; 42/78; 42/76.01; 89/14.05; 102/430; 102/524

[58] Field of Search ..... 89/8, 14.05, 14.3, 89/14.4; 102/433, 434, 430, 524, 525, 526, 527; 42/78, 76.01

[56] References Cited

U.S. PATENT DOCUMENTS

| | | | |
|---|---|---|---|
| 478,020 | 6/1892 | Pollard | 102/526 |
| 847,149 | 3/1907 | Barlow | 102/524 |
| 1,450,558 | 4/1923 | Maze | 89/14.05 |
| 1,529,664 | 3/1925 | Moriarty | 102/526 |
| 2,454,801 | 11/1948 | Himmer | 102/526 |
| 2,759,421 | 8/1956 | Sublette | 102/526 |
| 3,059,367 | 10/1962 | Rosebush | 42/76.01 |
| 3,154,016 | 10/1964 | Frey | 102/501 |
| 3,441,403 | 4/1969 | Rodenberger . | |
| 3,459,101 | 8/1969 | Scanlon, Jr. et al. . | |
| 3,465,638 | 9/1969 | Canning . | |
| 3,482,516 | 12/1969 | Farmer et al. | 102/430 |
| 3,483,794 | 12/1969 | Packard | 42/78 |
| 3,528,187 | 9/1970 | Harrell | 102/430 |
| 3,575,112 | 4/1971 | Farmer | 102/430 |
| 3,705,549 | 12/1972 | Quinlan et al. | 102/430 |
| 4,176,487 | 12/1979 | Manis | 42/78 |
| 4,197,801 | 4/1980 | LaFever et al. | 102/430 |
| 4,296,893 | 10/1981 | Ballmann | 102/520 |
| 4,379,531 | 4/1983 | Manis | 42/78 |
| 4,527,348 | 7/1985 | Brennan | 42/78 |
| 4,552,071 | 11/1985 | Horais et al. | 102/527 |
| 4,587,905 | 5/1986 | Maki | 102/430 |
| 4,590,842 | 5/1986 | Goldstein . | |
| H167 | 12/1986 | Forester et al. | 102/524 |
| 4,665,825 | 5/1987 | Pettersson | 102/430 |
| 4,691,638 | 9/1987 | Meyer et al. | 102/430 |
| 4,712,465 | 12/1987 | Macdonald | 42/78 |
| 4,782,758 | 11/1988 | Washburn | 102/430 |
| 4,802,415 | 2/1989 | Clarke et al. | 102/434 |
| 4,846,068 | 7/1989 | Zedrosser | 102/430 |
| 4,938,145 | 7/1990 | Martwick | 102/434 |
| 4,953,440 | 9/1990 | Moscrip . | |
| 4,982,647 | 1/1991 | Hertzberg et al. . | |
| 5,016,537 | 5/1991 | Pinson | 102/443 |
| 5,029,530 | 7/1991 | Martwick et al. . | |
| 5,042,388 | 8/1991 | Warren et al. | 102/434 |
| 5,048,422 | 9/1991 | Northrup et al. | 102/434 |
| 5,048,423 | 9/1991 | Garrett | 102/434 |
| 5,069,137 | 12/1991 | Martwick | 102/434 |
| 5,309,842 | 5/1994 | Matysik et al. | 102/430 |
| 5,322,002 | 6/1994 | Miskelly, Jr. et al. | 89/8 |
| 5,355,765 | 10/1994 | Rogers | 89/14.4 |
| 5,631,436 | 5/1997 | Brown et al. . | |
| 5,677,505 | 10/1997 | Dittrich | 102/430 |
| 5,841,058 | 11/1998 | Manis | 89/8 |

*Primary Examiner*—Theresa M. Wesson

*Attorney, Agent, or Firm*—Nikolai, Mersereau & Dietz, P.A.

[57] ABSTRACT

A cartridge round of ammunition has propellant charges rearward and forward of a projectile, with the rear ignited propellant charge starting the projectile out of the cartridge case and the projectile pushing, deploying and developing the front propellant charge as a portioned propellant entity within a series of propellant charge receiving chambers recessed within the main bore of a firearm barrel.

37 Claims, 10 Drawing Sheets

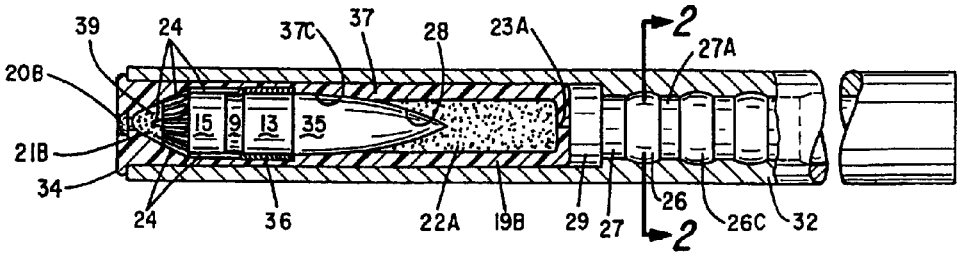

GUN PROPELLANT SYSTEMS AMMUNITION

This application is a Continuation of application Ser. No. 08/592,575, filed Jan. 26, 1996.

FIELD OF THE INVENTION

My invention relates to improvements in coefficient ballistic efficiencies of the movements of projectiles in the barrels of firearms with particular references to arms of minor caliber, although the principles and elements of the invention are applicable to gun projectiles and barrels of any justifiable size in accordance to any practical objectives for their intended targeted use.

BACKGROUND OF THE INVENTION

The firearm barrels and projectiles of this invention function together in conjoint-action to form transiently explosive captive environments in a series of recessed chambers of the bore walls by the interacting transitional interfacing functions of the projectile's lubricated bore obturator bearing surfaces, furnished with a recessed co-chamber, and sequentially bearing against the caliber sized annularly segmented bore wall bearing surface interfaces and passing the mouths of explosively charged annular bore wall propellant gas-relief chambers, the said projectiles bore obturator bearing surface interfaces thereby also functioning as quick-acting valves in combination with the annular segmented bore wall bearing surface interfaces as the projectile passes each said charged annularly recessed bore chamber's mouth; the said bore wall chambers becoming filled with explosive propellant charge portions forced from a propellant charge unconfined in the bore column in front of the projectile, and the said charge quickly sealed therein the said chambers by the projectile bore obturating body are ignited to explosively burn confined for short periods of time.

To avoid deleterious forces from acting on the barrel structure the mass of each charge portion impacting into bore wall chambers is preferably kept small, and the impaction forces widely distributed over as broad and shallow a longitudinal surface of a bore chamber's wall structure as practical to minimize said force of impaction and also naturally provides easy access to the chamber's structure when cleaning the bore after firing when necessary.

The said interfacing valving functions of the conjoint-action of the bore obturator bearing surfaces of the projectile and segmented bore walls, in relative conjunction of structural configuration of their said recessed chambers, transiently create a series of small individual transitory constructed special captively sealed and confined explosively developing propellant environmental entities within each of the said chambers recessed into the segmented bore walls of the firearm barrel shared by the said in transit captive recessed co-chamber of the projectile; and these chambers of the bore and projectile can be put to use to cooperate in various ways and methods to meet the requirements of various firearms of particular ballistic character to create an efficient propellant property by the explosive development of high pressure propellant gases forming in and then suddenly relieved to expand out of said chambers directly at the projectile body which propel the projectile along the bore and may also act to impart a particular rotational movement to the projectile while resisting reactive recoiling forces acting on the firearm barrel.

In a particular alternative combination of a firearm barrel and a projectile with a front charge, the rearward chambers of the bore wall may be charged by the projectile and the forward chambers of the bore may be left devoid of charges, by early depletion of the projectile's front charge, and thereby the forward chambers only used as bore column gas expansion chambers to bring about reduction of bore column pressure while bore column expansive gas pressure still actively energizes the projectile movement along the bore, but with a relatively reduced muzzle blast as the projectile exits the barrel.

It is brought out that the plug of air contained in the front of projectiles in the bores of firearm barrels of known conventional construction is normally highly compressed and thereby heated in front of a speeding projectile fired along the bore in which the projectile acts as an obturator. This plug of air somewhat resists the projectile's progress and contributes heat transfer to the firearm barrel.

The phenomenon of this said highly compressed and heated plug of air in the bore is reduced in the firearm barrels of this invention and therefore relieves, to a certain degree, air resistance and its heat transfer to the barrel because as the projectile passes the mouths of the bore wall chambers the plug of air being compressed in front of the projectile in the bore is, before becoming highly compressed and heated, progressively passed captively into the series of said segmented bore wall chamber's mouths, being wedged therein by the projectile along with and between the grains of the front propellant charge of the projectile.

It is known that most modern smokeless gunpowders burn slowly when not confined compared to the explosive rate at which they burn when highly confined in the closed systems of the bore of a firearm barrel wherein the projectile body acts as a bore obturator to the expansive escape of the gaseous products of combustion of the gunpowder, and thereby the rising heat and pressure of the confined developing gases forces, with greater and greater efficiency, more and more heat into the remaining unburned gunpowder grains and causes them to burn more and more explosively as additional explosive propellant gases develop, and as the confined heat and pressure of the gases becomes higher and higher until eventually the projectile's inertia is overcome and moves substantially forward along the bore relieving its breech charge from high confinement.

These burning characteristics of smokeless gunpowder are taken and used to advantage by structures of the firearm barrels and projectiles of this specification.

In the firearms of known conventional closed-system structures that use a single or even multiple propellant charges in the chamber of the breech area of the barrel there is a rapid rate of increasing entropy where the expanding explosive force of the charge or charges becomes less and less efficient to act on the diametric short axis of the projectile thereto to push the projectile forward as it speeds away from the breech in its course along the bore of a firearm barrel, because theoretically in accordance to certain laws of thermodynamics, hot propellant gases under pressure do not easily expand faster than the speed of sound and therefore the conventional firearms described in this paragraph do not have the potential to shoot projectiles much faster than 1.25 miles per second from the force of expanding propellant gases initiated from the chamber of the breech. That is, theoretically, once the projectile is traveling at its potential limit of 1.25 miles per second in the barrel the propellant gases no longer have the potential to expand any more rapidly from the barrel's explosive chamber of the breech end than the forwarded speed of the projectile they were expanding against, and therefore, kinetic energy is no longer available to be absorbed from the propellant gases by the projectile.

Prior inventions have introduced some closed structure firearm systems employing multiple charges in wells of the bore walls in attempts to reduce entropy, but the charges of these bore structures are shown not to be precisely controlled, modulated or otherwise structurally governed for exact timed development and finely tuned relief by and directly at the body of the projectile to energize its movement along the bore.

SUMMARY OF THE INVENTION

In this invention of propellant energizing of projectiles in firearms, high pressure propellant wave fronts of expansion are in sequential intermittent sequence, created as high propellant gas flow from bore chambers directly at the projectile body by being initiated by the projectile structure and to occur at the projectile body at preferred oblique to substantially right angles to the projectiles's longitudinal axis whereat propellant gases developed under high static pressure by the bore obturator bearing surface body of the projectile, being suddenly relieved by the projectile, undergo an increase in pressure at the point of dynamic expansive relief at the diametric perimeter of the projectile caliber where these high velocity expanding gases preceded by a shock-wave front of increased pressure are turned along the rearward longitudinal axis of the projectile's transit body at chambers along the bore wall as the projectile's conical and/or helically vaned notched rear area passes these high pressure chambers where high kinetic energy absorptions thereby are caused to occur directly from the propellant gases to the projectile by conversion of the static high pressure gases captively developed in a bore wall chamber by the said bore obturator bearing surface body of the projectile into dynamic pressure of these gases relieved initially directly at the projectile body, and complemented by jet-reaction and turbine force effects that occur as the gases expansively drop in pressure into lower pressure of the column of gases confined in the bore rearward of the projectile thereby reducing entropy of the thermodynamic system of the firearm barrel, and cause the said projectile to have a final greater potential muzzle velocity greater than 1.25 miles per second.

To acquire these efficiencies of expansion and kinetic energy absorption of the propellant gases directly by the projectile, it is possible to have an unconfined smokeless gunpowder propellant that could be initiated or primed to begin to burn slowly unconfined in front of the projectile and the said front gunpowder propellant then immediately be forced by the projectile, along with yet an unburned portion, into segmented bore wall chambers wherein the said primed propellant becomes highly confined, and its confinement causing it to then explosively burn generating high propellant gas pressure within the active environment of said chambers, and relieved a moment later rearwardly directly at the projectile, and the degree of the magnitude of high pressure within the said chambers being relieved at the projectile being determined by the manner of efficiently priming the charge and the particular character of component chemical interactions of the propellant, the correlative lengths of the bearing surfaces and recessed chambers of the barrel and projectile, the combined volumes and existing pressure and heat of the segmented bore wall chambers corresponding with the co-chamber of the projectile, and the rate of speed of travel of the projectile past the mouths of the said bore wall chambers correlated to the length of each said chamber's mouth, all other factors of interior ballistics being relevant.

In this instance, the bore wall chambers could have higher potentials of captive generated gas pressure within them than the coefficient of potential propellant gas pressure as contained in the column of propellant gases within the bore behind the projectile, and therefore, as the bearing surface of the projectile passes the mouth of a bore wall chamber, the higher pressure propellant gases developed within the said bore wall chambers are relieved to invade and turbulently mix with the much lower pressure of the column of propellant gases of the bore behind the projectile creating a higher pressure wave front of turbulent propellant gases directly at the projectile then the overall bore column propellant gas pressure; and these pulses of increased pressure of the chambers also acting to push the projectile forward with greater force than the much lower pressure of the bore column of propellant gases. These said forces acting along the length of the firearm's barrel being so great that such a barrel housing these bore wall chambers would be required to have a sufficiently strong construction along its entire length to contain these pulses of high pressure. It is pointed out, however that the overall coefficient of pressures thereby used in this specification could be kept much lower than conventional while obtaining high muzzle velocities.

In conventional firearms that fire breech charges it is known that their propellant gas flow is streamlined and not turbulent along their bores.

The turbulent violent mixture of propellant gases as disclosed in this invention cause any unburned portions of their powder grains in the said turbulent mixture to burn even more explosively with greater efficiency within the entire system of the firearm's barrel.

Also it can be seen that the inclined form of the projectile's ogively pointed front end and also its inclined rearward end keeps the projectile's body from being upset by pressure of its forward charge or being upset by the high pressure gases at the mouths of said bore wall chambers; the said propellant wave front of high pressure tending to favorably apply a compressive force to the body of the projectile rather than an upsetting force; including bore column gas pressure.

A peculiar phenomenon of most smokeless gunpowders is that they require, as aforesaid, high confinement in order to explosively burn; and when unconfined will only burn slowly like the igniting and burning of a kitchen match head. And these characteristics of smokeless powder burning are used to an efficient advantage in this invention.

There are many kinds and types of gunpowders now available on the open market. Each has its own characteristic peculiarities for use in firearms under varying conditions.

A particularly favorable group of gunpowders that would meet the particular integrity of coefficient ballistics requirements of the firearm barrel and projectile structures of this specification would be the use of a group of the more stable smokeless powders that do not contain nitroglycerin in them such as are particularly available within the single base group of gunpowders which therefore are less sensitive to being ignited by friction or shock and therefore more tolerant of the impacting action of the projectile deploying its front charge into the firearm's bore wall chambers as later fully described. But also as later described a small proportion of nitroglycerin may be used as a coating for gunpowder grains that otherwise do not contain nitroglycerin.

As aforesaid certain types of single base gunpowders require high confinement of their charges to burn explosively which characteristic is desired and put to efficient use together within further consideration of controlling sequentially balanced burning rates of the gunpowder in accordance to grain size and structural configuration, web thickness and coatings applied to the grains of the gunpowder, and when taken together with the inherent burning characteristics within the main body of the said grains of each powder type, itself, all contributing to an overall given efficient balanced burning rate for an individual gunpowder type or types that will be employed for a particular firearm type or types as illustrated and described and pointed out in this specification.

A basic method of making gunpowders as exemplified below is by first making a chemical compound called guncotton, or in another term the guncotton is called nitrocellulose. This compound is formed by action of nitric and sulphuric acids on cotton, or any other kind of cellulose. Hence, often the term for the end product is "nitrocellulose" instead of "guncotton" but the nitrocellulose does not contain nitroglycerin so the term "guncotton" is preferred for use in this specification to avoid confusion. The guncotton is then dissolved in a mixture of ether and alcohol, thus forming a mass called a colloid having very much the same consistency as melted glue. This colloid is squeezed out into tubes like macaroni out of a press and these tubes are cut into short lengths after which the ether and alcohol used to dissolve the guncotton are evaporated off leaving a hard substance something like dried glue. This dried-out colloid of guncotton is basically of the group of gunpowders of the single base types that do not contain nitroglycerin.

Nitroglycerin is made by reaction of glycerol with nitric and sulphuric acids in a process similar to that of guncotton, and if nitroglycerin is included to be mixed within the guncotton (nitrocellulose) it then becomes a double-base gunpowder called a nitroglycerin gunpowder. And generally "nitrocellulose" is accepted as a public term in reference to single-base gunpowders.

And an especially versatile gunpowder called Ball powder would be particularly also favorable as it can be manufactured without nitroglycerin; or can be simply coated with a very small proportion of nitroglycerin, or any other explosive substance sensitive to friction that would ignite them, and also a deterrent coating can be applied over the nitroglycerin coating and these coatings can serve the broad coefficient ballistics requirements of the structures of this invention brought about by computation and trial in various combinations for gunpowder use; some being exemplified here by first the deterrent coating resisting, or momentarily delaying, ignition if included and/or the nitroglycerin coating providing for especially the pre-ignition means of igniting the gunpowder charge of the projectile by impaction and/or frictional forces acting on the gunpowder.

Ball powder is unique in its manufacturing process of smokeless gunpowder having individual grains in the form of little balls, and the ballistic characteristics of this powder are partially determined by the size of the individual balls of grain. Everything being equal the small diameter balls of the grain results in a faster burning powder. And differing sizes of the balls of grain can be mixed to adjust the gunpowder's burning characteristics. The final grain ball product contains no nitroglycerin and in that state can be used like a single-base gunpowder; but the gunpowder can go through several further stages of operations of applying coatings to its balls of grain for bringing about a wide variation in means of controlling a desired final ballistic characteristic of the gunpowder. As further exemplified here in that one coating can be of nitroglycerin and another deterrent coating can be also applied. The nitroglycerin coating does not require high confinement in order to burn explosively and burns off very quickly and raises the potential energy in the remaining main body of the slower burning grain portion that burns explosively only when highly confined, and because of nitroglycerin's sensitivity to friction and impacts can provide for the means of pre-igniting the front gunpowder charge of the projectile within its course along the firearm barrel when the said gunpowder charge is unconfined in front of the projectile. The deterrent coating further delays the surface burning of the balls of grain under its coating so that although the front charge grain surfaces are ignited the main inner bulk of the charge grains burn even more slowly unconfined in front of the projectile until highly confined within a segmented bore wall chamber of the firearm barrels of this specification.

It being further brought out here that some minute particles of the gunpowder grains will be sloughed off the front charge of the projectile and wedged in highly confined between the bearing surfaces of the projectile and the smooth segmented bore walls of the firearm barrel where between frictional heat and/or impact forces cause these minute gunpowder particles either of a pure single-base gunpowder or one especially treated with nitroglycerin to explosively burn generating a film of explosive gases to form between these said bearing surfaces and thereby providing an explosive film of lubricant keeping these bearing surfaces apart especially when the projectile has proceeded further along the bore at a higher velocity. And therefore Ball powder preferably can provide these two additional ballistic functions of providing the means of pre-igniting the projectile's front charge and the means by which the projectile's bearing surfaces are lubricated. And therefore in this specification the gunpowders used in this manner are termed by the inventor as pre-igniting-explosive-lubricant gunpowders.

And with or without the said explosive-lubricant other means of lubrication may be used such as petrolatum.

Considering further that while the Ball gunpowder can be used with or without coatings; a wide variation of coatings can be used still further exemplified by sequentially reversing the order of the application of deterrent and nitroglycerin coatings thereby reversing their ballistic coefficients in the firearm barrel, or even additional coatings applied in various combinations such as either a deterrent coatings or a nitroglycerin coating used alone, or a nitroglycerin coating sandwiched between two deterrent coating, or further variation might be made to come to a proper balance of ignition and burning rates to meet particular ballistic requirements.

Further, too, is the consideration of some deformation of the form of the Ball gunpowder's individual grains by wedging action of the projectile upon its front charge, which deformation may or may not occur in accordance to the degree of the profile of the form of the projectile's frontal ogive point and the hardness and ball size of the gunpowder's grains, and also in accordance to a choice of departing from the usual grain forms such as balls, rods and flakes and developing a form of grain of gunpowder suited to the above stated purpose of grain fracturing and/or crushing; that is to say the choice for the powder grains to be formed and organized to be crushed in a certain limited manner as the front charge portions are deployed into the firearm barrel's bore wall chambers by the nose of the projectile; including the choice of designing and formulating the gunpowder to be subjected to little or no significant grain break-up.

The projectiles illustrated herein in their cartridge powder cases are provided with preferably only a very small rear charge of gunpowder which is ignited by the usual means of a conventional primer to get the projectile started out of its cartridge case at a very low developed breech propellant gas pressure as the projectile's large main front propellant charge is then deployed into segmented bore wall chambers, as the projectile moves along the bore, by the front sloped wedging surface action of the projoctile's ogive form with means of the projectile's bearing surfaces a moment later acting as interfaces for transiently confining portions of the said front charge into the firearm barrel's segmented bore wall chambers wherein the charge portions are ignited sequentially to generate propellant gases explosively to higher pressures than the bore column pressure behind the projectile, and interfaces of the bearing surfaces of the projectile interacting with bearing surfaces of the caliber sized segmented smooth bore wall areas, which a moment later releases the high pressure propellant gases of the segmented bore wall's charge chambers sequentially rearwardly along the projectile and turbulently into the bore column gases while said means of said bearing surfaces interfacing interactions also provides the means of a bore obturation by the projectile to block the escape of the said charges propellant gases from issuing forward into the bore past the projectile; except for a slight release of gases in certain embodiments used for pre-igniting portions of the projectile's front charge deployed as described into the bore chambers and which by aforesaid means the projectile is fired efficiently by its propellant charges in attaining its high muzzle velocity in a system of successively developed and rearward relieved high pressure propellant gases in the firearm barrel which reduce recoil of the firearm.

The front charge of the projectile can be deployed into the bore wall chambers in several different ways as shown in several structural embodiments. In one embodiment as the projectile is fired and started along the bore by low propellant gas pressure of its rear small charge the large front charge in contact with the front ogive surface of the projectile is pushed along the bore by the projectile to be deployed into bore wall's chambers preferably being as aforesaid pre-ignited by means of tapping of the generated pressure and heat of propellant gases of the fired rear small charge either by the projectile's annular surfaced co-chamber, and/or by means of first stage bore wall gas-channels.

In another embodiment a small portion of propellant gas pressure and heat is tapped from the projectile's rear charge momentarily released past the projectile, the said gases having a forwarded speed greater than the projectile's forwarded speed in the first stages of the projectile's movement along the bore. And this spurt of rear charge's gases ignites and somewhat scatters the projectile's front charge forwardly along the bore ahead of the projectile, and a moment later the projectile overtakes and gathers the unconfined slowly burning charge grains together and forces portions of them successively pushed laterally into the bore wall's chambers where thus the said charge's grains being now confined burn explosively to a high magnitude of static gas pressure and heat which is dynamically relieved from the bore chamber a moment thereafter rearwardly directly at the projectile causing a great part of the dynamic conversion of the kinetic power of the gases to be absorbed by the projectile, forcing the projectile forward, and the residual pressure and heat of these said propellant gases after their above actions on the projectile then turbulently contained in the rear column of bore gases that are themselves contained in the firearm's barrel under such lower pressure, and with the said bore column gases slowly rising in pressure; but the bore wall chamber's developed gas pressure always being much higher in pressure and heat when relieved rearwardly in and contributing some of their residual energy into the lower pressure bore column gases.

The known rifling used in firearms barrels impart a mechanical twist to a projectile while it is contained in the bore. The object of the initial twist in the bore is to create a high rate of residual kinetic spin to the projectile after it has left the muzzle of the firearm. The rotation of the projectile in free flight enable gyro-dynamic force to stabilize the projectile's trajectory in order that the projectile may be accurately aimed at a given target.

Although the rifling as used obtains the objective of rotation of the projectile in free flight there are many unwanted effects on the projectile and on the firearm barrel used to fire the projectile when using the lands of the rifling of the bore wall to impart the twist such as deformation of the streamlined bearing surface of the projectile due to the land's indentation and the great magnitude of high frictional force on the bearing surfaces of the projectile and bore wall as the projectile is forced to twist along the rifling, and which rifling limits means of reaching the greatest potential velocity of the projectile at the muzzle in accordance to the tensile strength of its bearing surfaces to resist being torn and stripped by the lands of the rifling and the obstructive frictional resistance thereof its forwarded movement by the energy expended by the firearms propellant to overcome these forces of friction.

From the standpoint of interior ballistics it is desirable for a firearms's barrel to have as little frictional restriction of the forward passage of a projectile along the bore as is possible while functioning to impart the twist and safely contain substantially the full volume of high pressure propellant gases directly at and behind the projectile whereby with reduced friction the gunpowder gases may safely propel the projectile to the greatest advantage. A particularly ideal condition in firing a projectile in a firearm's barrel is to have the pressure of the propellant gases initially rise very moderately to gently start the projectile in motion along the bore and then to deploy additional propellants along the bore to continue to rise in gas pressure directly at the projectile to cause positive high acceleration of the projectile all the way to the muzzle while reducing or neutralizing the reactive recoil and muzzle blast effects on the firearm by the projectile; and which foregoing principles and elements are objective of this invention.

Also from the standpoint of exterior ballistics it is desirable to have a projectile which is not deformed by the bore and which affords a streamlined free flight structure especially at very high velocities. With propellants made available along the bore directly at the projectile with reduced bearing surface friction a much higher magnitude of kinetic energy can be safely absorbed from the propellant charge gases as sequentially developed directly at the projectile and relieved at the projectile along the barrel's bore by the projectile in this invention resulting in acquiring a higher magnitude of muzzle velocity and/or muzzle energy and a long accurate range with the projectile in free flight having been afforded with great speed and energy and with great resistance to gravitational force resulting in a flatly acquired and accurate trajectory to the target. All of the above being objectives of this invention.

A particular objective is that if ultra-high muzzle velocities are not required for a particular firearm in accordance to its kinetic energy requirements in foot pounds at the muzzle, then at the lower muzzle velocities and energies using the principles and elements of ballistic efficiencies of this invention, then the length of the firearm's barrel and its bore can be less, and the weight of the propellant charge and/or its cartridge powder case can be less while still obtaining muzzle velocities and stored kinetic energy of the projectile at the muzzle in keeping with those as obtained by various known conventional firearms popularly now in use that use propellants less efficiently and therefore require greater bore lengths and weights of charges and/or weights of the cartridge powder case.

Other objectives will be brought out or be apparent within the course of the following disclosure of the construction, arrangement and combination of elements as fully described hereafter and pointed out in the claims forming a part of the specification.

Some of the drawings of this invention do not show the front propellant charge of the projectile for sake of clarity of structural illustration.

Practical embodiments of the invention are illustrated in the accompanying drawings whereby:

BRIEF DESCRIPTION OF DRAWINGS

FIG. 1 is a small view of the firearm barrel partially cut-away in side elevation; included is a diagrammatic comparison view for approximately representing certain features with relation to the usual gas-pressure and projectile-velocity curves or diagram.

Figure 2:
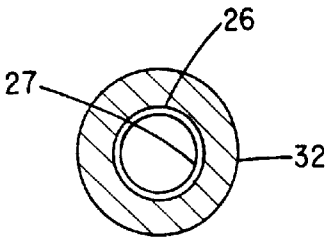
FIG. 2 is a sectional view on the respective line 2—2, of FIG. 3.

FIG. 2 is a sectional view on the respective line 2—2, of FIG. 3.

FIG. 3 is a partial sectional view of the firearm barrel illustrating a particular partial sectional view of the firearm's breech cartridge and bore structure configuration.

FIG. 4 is a sectional view of the cartridge case of FIG. 3, being fired with its projectile in a forwardly moved position.

FIG. 5 is a sectional view of the empty cartridge case of FIGS. 3 and 4, illustrating its interior structural configuration.

FIG. 6 is an enlarged broken-away sectional view of the fired cartridge as respectively encircled within the long and short broken line 33, of FIG. 4.

FIG. 7 is a broken-away partial sectional view of an alternate embodiment of a fired cartridge case of FIG. 5.

FIG. 8 is a sectional view of a simpler alternate embodiment of the cartridge case.

FIG. 9 is an alternate embodiment of a firearm projectile having a shortened front bearing surface.

FIG. 10 is a partial sectional view of another embodiment of the firearm barrel with a sectional view of a cartridge in its chamber of the breech.

FIG. 11 is a rear view of the projectile of FIG. 12.

FIG. 12 is a view of a firearm projectile in side elevation.

FIG. 13 is a broken-away sectional view of the firearm barrel of FIG. 3 with its bore structural configuration partially superimposed through its projectile in a first stage of fired transition along the bore.

FIG. 14 is another broken-away sectional view of the firearm barrel with some structural bore components superimposed with its fired projectile progressed to a further transitional stage along its bore.

FIG. 15 is a further broken-away sectional view of the firearm barrel with some structural bore components superimposed with its fired projectile progressed to a still further transitional stage along its bore.

FIG. 16 is another embodiment of a firearm projectile in side elevation.

FIG. 17 is a rear view of the projectile of FIG. 16.

FIG. 18 is a broken-away sectional view of another embodiment of the firearm barrel with its bore structural configuration partially superimposed through its particularly embodied projectile in a first stage of fired transition along the bore.

FIG. 19 is another broken-away sectional view of the firearm barrel with some bore structural components superimposed with its projectile progressed to a further transitional stage along its bore.

FIG. 20 is another further broken-away sectional view of the firearm barrel with some bore structural components superimposed with its fired projectile progressed to another transitional stage along its bore.

FIG. 21 is another further broken-away sectional view of the firearm barrel with some bore structural components superimposed with its fired projectile progressed to another transitional stage.

FIG. 22 is another alternate projectile and barrel embodiment shown piece-meal in a broken-away sectional view.

DESCRIPTION OF THE PREFERRED ELEMENTS

In the present embodiments of the helicoidal projectile the tensile and compressive strengths of the structures of these projectile helicoid-heels are improved structurally by means shown in the rear view of FIGS. 11 and 17, by having the plane sides, as at 41 and 41A, respectively of their helicoid notches as also illustrated in side elevation in FIGS. 12 and 16, as at 41 and 41A respectively obliquely inclined from the radial short axis of the projectiles, thereby providing a larger body of metal forming the individual helicoidally notched escarpments giving additional support to the individual helicoid sides, as at 40A in FIGS. 11, 12, 16 and 17 respectively, and said plane wall also providing an improved angle of resistance to the force vector line of the impinging propellant gases.

These projectiles for use in the firearm barrels are of overall preferable configurations of structures as illustrated in the drawings in large side elevations and rear views as shown in FIGS. 11 and 12, and FIGS. 16 and 17 respectively. And other embodiments are shown in FIGS. 9 and 22. These projectiles are formed with taper-heel and/or helicoidally notched areas as at 1 and 2, which do not upset in the bore of the firearm's barrel by force of propellant gas pressure because the gas pressure tends to try and wedge itself between the tapered end of the bore obturating projectile and the bore wall, and in doing so the bore's propellant gas pressure tends to have a compressive force rather than an upsetting force that acts on the projectiles. And the front areas of the projectiles are preferably formed with ogively curved or inclined surface areas ending preferably pointed to provide streamlined surfaces for exterior free flight. Additionally, the front form of the projectile first functions interiorly in the firearm barrel's bore to provide a wedging surface for its front charge; whereby onto which said charge the projectile provides an efficient lateral force which forces portions of the said charge to upset into the segmented bore wall chambers of the barrel. Therefore the charge does not tend to upset the projectile's structure because of the reactive compressive wedging action of the charge on the inclined front surface area of the projectile.

And as aforesaid the inclined taper-heels of the projectiles are formed with helicoidal notches as shown in other views, as at 3 and 4, FIGS. 12 and 16, and as at 5 and 6, FIGS. 11 and 17, and the inclined taper-heels together with their helicoidal-notches, and the projectile's bearing surfaces transiently form a closed-system of sequentially activated nozzle orifices, as at 17 and 18, FIGS. 15 and 20, respectively, and nozzle passageways, as at 8 and 7, when conjointly cooperating interactively with the barrel's segmented smooth bore walls bearing surfaces, and its segmented bore wall chambers.

Also the projectiles are preferably formed to include co-chambers in their structures formed as annular recessed surfaces or grooved areas, as at 9 and 10, FIGS. 12 and 16, from and around the projectiles bearing surfaces, as at 15 and 13, FIG. 12, and as at 16 and 14, FIG. 16, which elements also transiently forms a closed-system of projectile co-chambers, as at 9, FIG. 15, and as at 10, FIG. 19, when they also conjointly cooperate interactively with the barrel's segmented smooth bore walls bearing surfaces segmented with recessed bore wall chambers.

In FIG. 10, the projectile, as at 35, is shown seated inside a cartridge case, as at 19, in the cartridge chamber 29B, of an embodiment of a firearm's barrel, as at 32B. The said cartridge case 19, is fitted with a conventional primer, as at 20, and propellant charges placed rearwardly, as at 21, and forwardly, as at 22, of the projectile in the case with the frontal area of the case, as at 23, crimped and folded closed over to enclose the front charge and the front of the case to thereby seal in the case's contents. The rear charge 21, in the case is preferably much smaller, and potentially is much less powerful, and develops a much lower propellant gas pressure than portions of the projectile's forward charge, as at 22, when confined in bore wall chambers. The front charge may consist of one homogeneous charge, as at 22A, FIG. 3, including a lubricating element, or may be made up of different types of two or more lubricated, layered or stacked charges, as at 22B, and 22C, of charge 22 of FIG. 10, with each layer of propellant charges having different compositions and/or grain and web characteristics thereby to provide differences of each layer of propellant charges in reaching their time of full explosive development of expansive energy potential correlated so as to therefore be arranged to be ignited to burn and generate propellant gases differently for particular requirements of a particular firearm in order thereby to provide more efficient stages for the proper kinetic conversion of the energy of propellants to kinetic energy of the projectile along the bore.

Several optional cartridge powder case types are made available for the projectile; and the projectile is itself also shown in several embodiments. Particular combinations of projectiles and their cartridge cases either provide positive seals 36, 37, to contain rear charges developing propellant gases against escaping entirely past the projectile; or the interior surface of the case sidewall is allowed to expand or has gas-channels formed into its wall, as at 24 FIG. 5, to allow a precisely limited small partial forward flow of propellant gases past the projectile's rear bearing surface to fill and pressurize the projectile's co-chambers 9 and 10, and/or in other embodiments, as at 25, FIG. 7, allowing a small precisely limited spurt of propellant gases to flow forward to the front charge of the projectile to disperse the said charge scattering it out somewhat ahead of the projectile as it primer ignites it, and together these variations and modifications of structural configurations of the cartridge and its firearm barrel are correlated to respectively provide various efficient methods of deploying and/or pre-igniting the cartridge's frontal charge to control its efficient employment along the bore of the barrel ahead of and at the projectile for explosive development of propellant gases to high pressure and heat within the firearm's segmented smooth bore wall recessed chambers, as at 26 FIG. 3 to meet a wide variety of specialized objectives of the use of any particular firearm's barrel structured to use the principles and elements as herein stated; as within certain preferred embodiments the segmented bore wall chambers, as at 26, cooperate with the annular pocketed areas of the projectile which act as transient precise charge igniting co-chambers, as at 9 and 10, as particularly illustrated in FIGS. 9, 15 and 21 of the projectile which ignites charges in the segmented bore wall chambers into which precise portions of the front charge, as at 22A and 22 of FIGS. 3 and 10, of the projectile are forced into, and which bore wall chambers together with the co-chambers of the projectile generate controlled high magnitudes jumps in the rise of propellant gas pressure provided by means of the interfacing actions of the forward and rearward bearing surfaces of the projectile, as at 15, 13 and 16, 14 of FIGS. 12 and 16, respectively interacting with the bearing surfaces of the segmented smooth bore walls, as at 27 and 27A FIG. 3, whereby the developing high propellant gas pressure is made captive in the said chambers as it reaches its intended maximum static pressure then expansively relieved and dynamically develops a magnitude of pressure directly at the body of the projectile where it is relieved because when a gas is held under static pressure and then suddenly relieved it undergoes a rise in pressure at the point of relief in the form of a shock-wave front of increased pressure which precedes the expansive gas flow that occurs sequentially at each succeeding bore wall chamber along the length of the bore to accelerate the projectile to an efficient high velocity all the way to the muzzle while imparting a stabilizing twist.

Further, more specifically, these ballistic steps provide methods of imparting a rotational motion to the helicoidal projectile in the firearm's barrel having a smooth annular caliber sized bore, as at 27, FIG. 3, segmented by annular chambers recessed from the bore's walls, as at 26 FIG. 3, by the expansive flow of propellant gases relieved from the said bore wall chambers 26, and turned along helical surfaces of a rear helicoidal area of the projectile, as at 1, 2, 3, 4, 5 and 6, as respectively shown in FIGS. 11, 12, 16 and 17, while also substantially increasing the projectile's forwarded velocity when fired along the bore in which the projectile's body acts as an interfacing obturator of the smooth main bore's caliber sized wall segments, as at 27, FIG. 3, and segmented bore wall chambers, as at 26, FIG. 3, wherein propellant gases under preferred low pressure in the column of gases held behind the projectile in the bore and acting on the rear of the projectile are subjected to a precisely limited transient expansive relief of the heat and pressure of a small portion of their gases, of either the bore column of gases and/or transferred from the projectile's bore gas pressurized co-chambers 9 and 10, FIGS. 12 and 16, which pre-ignites a portion of the main propellant charge located in front of the projectile, as at 22A and 22, FIGS. 3 and 10, after that said charge portion is forcibly deposited by the charge upsetting wedging action of the front ogive surface form of the projectile, as at 28 and 28B FIGS. 12 and 16, upsetting and wedging a front charge portion into a captive closed environment of a recessed bore wall chamber opening into the main bore clearly exemplified in embodiments as shown in FIGS. 13, 14, 15 and FIGS. 19, 20, 21 and FIG. 22, made captive after the forward and rearward bearing surfaces of the projectile are passing the forward and rearward adjacent caliber sized bearing surfaces of the smooth bore wall segments which then act as segmented bore wall obturating interfaces of the projectile and its transient co-chambers 9 and 10. Wherein the captively enclosed propellant charge of a bore wall chamber explosively burns generating a volume of gases under high static pressure and high heat, and which a moment later are suddenly relieved to expand dynamically at ultra-high velocity from the said chamber at and along the rearward helicoidal area of the projectile in the form of expanding high pressure and heat in a jet stream of propellant gases by way of a widening nozzle orifice and nozzle passageway formed transiently as the rear end of the projectile's rear bearing surface passes a rear opening point of junction of a segmented bore wall chamber with a rise in pressure at the point of sudden relief at the said nozzle orifice in the form of a shock-wave front of increased pressure which immediately precedes the sudden ultra-high velocity expansive flow of propellant gases to and from nozzle orifice 17, which drop in pressure behind their said shock-wave front of increased pressure, as at 17, FIG. 15, and as at 18, FIG. 20, along with also gas pressure subsequently relieved through another nozzle orifice, as at 43 FIG. 15, of the projectile's co-chamber as at 9, formed as the said co-chamber begins to pass and relieve its charge primer gas pressure into a succeeding subsequently charged bore wall chamber, as at 26C, to in sequence ignite that said chamber's charge to explosively energize the said chamber with high pressure propellant gases for relief at the projectile.

An alternate embodiment of a projectile co-chamber, as at 10, FIG. 16, opening at a bore wall chamber is exemplified, as at 44, FIG. 21. And which actions accelerates the forward movement of the projectile with a rearward relieved portion of gases of the jet stream issuing from a bore wall chamber immediately turned by the helicoidal rear area of the projectile thereby, too, absorbing kinetic energy from the gases increasing the overall forwarded movement of the projectile while also to impart an obliquely directed tangential turbine force by the said gases imparting a rotational movement to the said projectile; and then too, also at the same moment a portion of the said jet stream's expansive reactive force provides a forwarding force of higher pressure in sequence to act on the forward wall of each bore wall chamber of the firearm's barrel to reduce or neutralize reactive rearward recoil forces of the propellant gases acting on the breech face of the barrel. And these said gases as relieved from said captive environment of a bore wall chamber turbulently receding rearwardly of the projectile to become a part of the column of gases in the main bore and the residual energy of the gases of said captive environment of a fired charge of the bore wall chamber not absorbed by the projectile or barrel becoming a part of the total energy in the column of gases in the main bore. The method including repeating steps of firing a charge in each succeeding segmented bore wall chamber along the length of the barrel's bore while substantially containing propellant gases within the firearm barrel until the projectile leaves it.

Several embodiments of the firearm's barrel and its ammunition are shown in varying combinations.

The cartridge case 19B, as in FIG. 5, is formed of any suitable resiliently flexible plastic and/or paper material with a compressible thickened wall area starting as at 37, being of a reduced caliber size to its forward end, and rearwardly of said thickened wall area are a series of resiliently flexible integrally formed case sealing rings that project from the case wall as at 36, FIGS. 3, 4 and 5. And FIG. 6, shows an enlarged area view of said sealing rings 36, as encircled with short and long broken lines 33, of FIG. 4. The said rings 36, as shown in FIG. 5, in their unflexed state form annular openings of a reduced caliber size through which the full caliber size of the bearing surfaces of the projectile 35, when inserted into the case are forced, and forces said rings 36, to flex rearwardly resiliently pressed tightly to the said bearing surfaces of the projectile as shown in FIG. 3, after first having inserted an explosive charge. The projectile 35, caliber also having been forced through the cartridge case's compressible and resiliently flexible thickened and reduced caliber sized wall area as at 37, and seated in the said cartridge case 19B, as in FIG. 3, against case seat area as illustrate, as at 38, FIG. 5. The rearward end of the cartridge case's thickened wall area is gradually reduced of its thickness complementary to the profile of the ogive front form of the seated projectile being then in snug contact with this said complementary gradually thickened wall area of the case. And the said resilient flexible sealing rings 36, and case's compressible thickened wall area 37, together forming positive sealing of the rear propellant charge's explosive gases against forward passage of the said gases past the forward bearing surface of the projectile.

Cartridge case gas channels as at 24 of FIGS. 3, 4 and 5, are formed equidistantly leading from the cartridge case's rear gunpowder chamber 39 of FIG. 3, and ending at the rearmost ring of sealing rings 36. A rear gunpowder charge as at 21B of FIG. 3, for starting movement of the projectile is first preferably deposited into said rear gunpowder chamber 39, before projectile 35, is inserted and seated into cartridge case 19B, and then after said projectile is seated a larger main charge of gunpowder as at 22A, which becomes the prime mover of the projectile is deposited into said cartridge case in front of said projectile 35, and the cartridge case then crimped and folded closed as at 23A, at its front end over said front charge 22A, (the open form of the said case crimp is exemplified as at 23A of FIG. 4) and sealing it in together with all of the interior cartridge case's components with the exterior of the cartridge case being in conventional appearance. The cartridge case employs the use of an ordinary primer of known construction in the base for use in firing of its rear charge of propellant. And the overall construction of said cartridge case 19B, lends itself to be constructed and assembled by adapting known methods and facilities as used in the fabrication, construction and assembly of conventional shotgun shells or cartridge cases in general, including the installation of conventional primers into the metallic base of cases as at 46 of FIG. 8, and also including the method of crimping and folding the front of the case closed in a known manner as done for most conventional shotgun shells.

In the manufacturing processes of cases using plastics or other easily moldable mediums the configuration of the structures of these cartridge cases will allow for each case to be molded as a single integral piece. And due to the very small rear charge to be fired in the case at very lowly developed propellant gas pressure that each case must only withstand will allow a broad choice of moldable materials to choose from for use in the molding processes to produce the cases preferable as single units for firearms that would not require a metal reinforced base as would be arrived at in accordance to the magnitude of pressure developed by the rear charge and/or in some primers at the case's base; and also when in consideration of rapid fire automatic firearms metal reinforcing of the base and especially at the rim of the case may be required to withstand the force of ejection on the rim of the cartridge case by the firearm's ejection action. And it being further brought out that the overall pressure of the bore column gases remains low after all jumps of high propellant gas pressure are relieved from all of the bore wall chambers and hence the chamber of the breech area, including the constant cross-sectional dimension of its breech face area, is never subjected to high gas pressure (which low pressure on the breech face area minimizes rearward recoil of the firearm) so neither will be the cartridge case's primer cup, or in shotgun terminology the "BATTERY CUP" that holds the primer mixture, but if the primer cup is to be installed in a case without the case having a base reinforced with metal and the reinforcing metal including a metal primer pocket and flash hole for a primer not used, then the primer cup itself may be required to be made with its walls made of a metal of sufficient strength or thickness of metal great enough to self contain the pressure of its ignited primer explosive to be relieved only through the flash hole of the case without the cup structure itself being effected to be upset by its explosive charge, which charge itself may be made to avoid excessive explosive gas pressure by being made up of an available conventional LE type of explosive which is a relatively slow burning low explosive that can be set off by heat or friction and which LE type of explosive would be preferred to be used in place of the high explosive types of primer mixtures. The LE type of primer being especially practical due to the small amount of gunpowder of the rear charge of the case it is used to prime to ignite; and in some cases the LE primer may be all that would be required to develop enough propellant gas pressure from its primer mixture to get the projectile started out of the cartridge case without a gunpowder charge in the rear chamber of the case.

And in any foreseen circumstance the primer cup may be secured into the primer pocket of a case by the usual known methods and available facilities of metal reinforcement of the case's base which would include a primer pocket in which to secure the primer; or as in some firearms the primer cup can be installed in the case's base in a manner as to allow rearward movement of the primer cup from the case's primer pocket after the primer is fired to use the rearward recoiling movement of the primer cup as a force to operate some conventional recoil-operated actions of some particular firearms.

FIG. 5, clearly illustrates the empty cartridge case's 19B, means of configuration of construction for pre-igniting a portion of the front charge and sealing back rear charge propellant gases by the sealing rings as at 36, and thickened compressible case wall area as at 37.

The assembled cartridge 34, shown in FIG. 3, is as illustrated in FIG. 4, fired to start the projectile 35, out of its case 19B, and along the firearm's barrel 32, described below.

The firearm barrels of the specification as exemplified in the firearm barrel as at 32, FIG. 3, are provided with a cartridge chamber as at 29, opening at the breech end, and the caliber of the main bore is smooth and segmented as at 27, for preferably its entire length by shallow and wide annular recessed bore wall chambers as at 26. And the shallowness and long length of each one of the bore wall chambers as at 26, along the longitudinal axis of the barrel's bore allow proper time for lateral upset thin layering forcement of portions of the front charge as at 22A, by the projectile into the said bore wall chambers.

All of the bore wall chambers as at 26 of FIG. 3, are especially structured so that the full volume of said chamber as at 26, can be safely completely filled by a charge portion and highly confined therein by the lateral upset wedging action of the projectile's front surface forcement on its front charge, and the said charge being transiently kept confined in the bore wall chamber by the transit forward and rearward bearing surfaces of the projectile illustrated as at 15 and 13 of FIG. 13, interfacing with the caliber of the bore's segmented bearing surfaces as at 27 and 27A, that are forward and rearward of the said bore wall chamber, and the said charge portion in the said chamber being fired by priming action of the projectile providing primer means of its co-chamber having hot gases under pressure relieved to ignite the front charge portion deposited in the bore wall chamber, and the gases of the said ignited charge portion explosively developing to a safe limit of high gas pressure in the bore wall chamber by also expanding to increase in pressure within the conjoined volume of space provided by the said co-chamber 9, of the projectile that initially ignited the said bore chamber charge; and in this manner fail-safe loading and firing of the bore wall chambers is brought about which thereby cannot be "over-filled" with a propellant charge, and therefore cannot cause deleteriously high rises in gas pressures to develop within the firearm barrel.

And this form of coefficient ballistic interaction structuring of the said bore wall chambers and the projectile and its chamber also provides natural cleaning of the bore wall chambers by the turbulent scrubbing action of the burning propellant charge grains. And the shallowness of the bore wall chambers being structured in close proximity with the segmented caliber sized smooth bore wall areas also provides, too, for practical access of the overall configuration of the bore structure for inspection and additional cleaning when required by use of a simple cleaning rod (not shown) that may be inserted into the muzzle and along the bore of the firearm barrel in the same manner as used to inspect and clean a conventional rifled bore. And under combat conditions the firearm barrels of this invention having a bore with relief areas provided by the bore wall chambers are less likely to burst or become ruined by obstructions in the bore.

For more fully indicating the foregoing explanation FIG. 1, shows a gas-pressure and projectile-velocity diagram M, drawn in a known manner with the base-line A, thereof alongside of the firearm barrel 32, shown in a reduced scale. In this diagram the pressure and velocity curves as at C and D, respectively shown as broken curved lines are of a form representing results such as commonly obtained in some conventional military firearms. And the solid lines of the pressure and velocity curves respectively shown as at E and F, approximately represent ballistic results to be obtained with the structures of this invention.

The cartridge as at 34, FIG. 3, shown seated in the cartridge chamber 29, of the firearm barrel 32, when fired by any known action device preferably employing a firing pin for indenting a conventional primer as at 20B, fires said primer which ignites a small rear gunpowder charge as at 21B, which generates only preferably low pressure propellant gases peaking as at G of FIG. 1, of diagram M, or to any given pressure that would be normal to the charge, as compared to a conventional breech pressure peaking as at H, with said low pressure rising just high enough to get the projectile as at 35, started out of the cartridge case 19B, and initially along the bore of the firearm barrel, but as the projectile's inertia is being overcome these said rear charge generated propellant gases first travel along the cartridge powder case's rear gas channels structure as at 24 of FIG. 3, and as more clearly illustrated as at 24 of FIG. 5, from the rear charge chamber 39, to and pressurizing the projectile's co-chamber 9 with a portion of said rear charge gases, and the cartridge case's spaced resiliently rearwardly flexed sealing rings, as at 36 FIGS. 3, 4 and 5, and as shown enlarged in FIG. 6, respective of the portion 33 of FIG. 4, prevent the said rearward charge gases from passing the projectile's forward bearing surface, as at 13, and hence the propellant gases are kept away from reaching the cartridge's large forward propellant charge 22A of FIG. 3, (the said charge not shown in FIG. 4, for sake of illustration of the opened crimp as at 23A) and the gas sealing rings as at 36, FIG. 3, and as clearly shown in the enlarged view in FIG. 6, are forced tightly in contact with the projectile's bearing surfaces and keep the co-chamber 9, of the projectile pressurized with rear charge gases, the said sealing rings 36, capturing the higher end of the magnitude of the rear charge developing gas pressure because as the projectile moves forwardly along the interior of the cartridge case the sealing rings as at 36A, which block gas pressure from expanding past the forward bearing surface 13, of the projectile then sequentially flex inward into the space provided by the projectile's co-chamber 9, and then each sealing ring 36, in sequence is forced to flex forwardly bent against the rear bearing surface 15, of the projectile as at 36B of FIG. 6.

In this resilient flexing action of the said sealing rings the said rear gas pressure can pass forward as at 36B of FIG. 6, into the co-chamber 9, of the projectile by forcing the said rings 36B, situated at the rear bearing surface 15, to flex forwardly outward away from the said rear bearing surface of the projectile, but as the explosive chamber 39 gases rearward of the sealing rings begins to drop lower than the gas pressure forward of the said rings, the higher gas pressure forward of the rings forces the rearward rings as at 36B of FIG. 6, to flex rearwardly inward against the rear bearing surface as at 15, rearward of the projectile's co-chamber 9, and in the same manner the forward sealing rings as at 36A are forced forwardly inward against the forward bearing surface 13, of the projectile forward of the projectile's co-chamber 9, and thereby portions of these gases become sealed within the said sealing rings and the projectile's in transit co-chamber 9. Then the forward bearing surface 13 of the projectile is forced along the thickened compressible wall area as at 37, of the cartridge case compressing the wall to form a forward secondary positive sealing area of the case's wall pressed tightly against the caliber of the in transit projectile's forward and rearward bearing surfaces 13 and 15 thereby further keeping gas pressure sealed within the in transit co-chamber 9 of the projectile.

As the projectile moves forward and compresses the case wall 37 and moves against its front charge 22A which forces open the crimped end as at 23A of the case some minute particles of the front charge 22A will be forced between the forward bearing surface 13 of the projectile and the compressible case wall 37 (especially in the crimp indents left in the case's opened crimp end 23A) and these charge particles will eventually be exposed to the projectile's co-chamber 9 that contains captured gas pressure at high heat wherein these minute front charge particles will be confined and burning explosively somewhat increasing the overall gas pressure and heat of said co-chamber enclosed by the confining sealing action of the compressible case wall 37, as the projectile begins to pass from the cartridge case into the caliber sized bore area as at 27 of FIG. 3, and thereat the wall of the cartridge case compressed by the projectile causes some forward bulging of the case's opened rim end as at 50 of FIG. 4, forming a tight seal against the right angled front end of the cartridge chamber 29 in juncture with the main bore keeps gas pressure sealed into co-chamber 9 while the front ogive area of the projectile laterally upsets and wedges a portion of the front charge 22A of the projectile to be forced into a bore wall chamber 26 that is subsequently sealed therein by the projectile's bearing surfaces, rearward and forward of its co-chamber 9 as the said co-chamber 9 of the said projectile then initially opens at the bore wall chamber 26 and the hot gases of the co-chamber 9 expand and prime the bore wall chamber's confined charge while the bore column propellant gas pressure behind the projectile at that moment having dropped very low as at I of FIG. 3 of diagram M, and at the same moment the said confined bore chamber's ignited charge portion then explosively burns generating propellant gases and heat which increases peaking in pressure as at J (or to any pressure normal to particular gunpowders used in combination with particular embodiments of projectiles and/or cartridge cases as brought out in this specification) well above the overall bore column gas pressure as at L.

As the said bore wall chamber remains confined by the rear bearing surface as at 15 of the projectile as shown in FIG. 14, as then also the said bore wall chamber recharges the co-chamber by increasing its gas pressure as the said projectile's co-chambers transiently passes the said bore wall chamber and its explosive gases, and which transient said co-chamber a moment later, as it continues to move further becomes confined and momentarily held independently captured at a succeeding caliber sized segmented bore wall as at 27A of FIG. 14, between the first and second bore wall chambers, and then the end of the projectile's rear bearing surface 15 is about to begin moving past said first bore wall chamber 26 the projectile's co-chamber 9 opens at the succeeding second bore wall chamber as at 26C of FIG. 15 wherein said co-chamber expansively relieves the heat and energy of its high pressure primer gases and pre-ignites that bore wall chamber's 26C captured charge portion while the heat and pressure of the propellant gases generated from the preceding bore wall chamber's 26 burning charge are independently suddenly relieved rearwardly, as shown in FIG. 15, directed at the projectile's helicoidal heel area 3 through another orifice independently created as at 17 by the juncture of heel 3 with the rear end of the projectile's bearing surface 15 opening at the juncture of the caliber sized segmented smooth bore wall area as at 27 with said bore wall chamber 26 and the large portion of said bore chamber gases relieved through said orifice 17, which orifice's axis is preferably obliquely aligned to the projectile's heel, the direction of these said relieved expanding gases then being immediately turned by the projectiles helicoidally curved surface area as clearly illustrated enlarged as at 40 of FIG. 12, of the projectile's helicoidally notched heel. A portion of the kinetic energy of the said gases is tangentially absorbed by the projectile and imparting a stabilizing turbine twisting force thereat to the projectile for free flight purposes while at the same time these gases are being turned rearwardly against and along said helicoidally curved area 40 and thereby also push the projectile forward increasing its overall forwarded velocity and which forwarded projectile velocity is also increased by the pressure at the point of relief of said propellant gases at orifice 17 created and shared by the projectile and the recessed bore wall chamber because when a gas that is under high pent-up static pressure is suddenly relieved there is a rise in pressure at the point of relief in the form of a shock-wave front of increased pressure which immediately precedes the sudden ultra-high velocity expansive flow of propellant gases from nozzle orifice 17, and along a divergent nozzle passageway 7, dropping in pressure behind said shock-wave front of increased gas pressure, and this said shock-wave front rise in gas pressure initiated at the said propellant orifice shared by the projectile and firearm barrel acts to push the projectile forward while also applying a rearward recoil force onto the barrel.

However, the incline of the projectile's heel area as at 1 of FIGS. 12 and 15, cooperating with a smooth bore wall segment 27 form a divergent nozzle passageway 7 which enhances expansion of the gases with a drop in pressure from orifice 17 which a jet stream jet-reactionary propulsive forwarding force on the barrel cancels to some degree the rearward recoiling force on the barrel caused by gas pressure acting on the constant cross-section dimension of the breech face area of the cartridge chamber at the breech end of the firearm barrel, and also resists the recoil forces caused by the said shock-wave front rises in gas pressure that travel rearward from said orifice openings of the barrel's bore wall chambers as, thereby the kinetic energy stored in the barrel resists too, the reactive recoil effect of the muzzle blast force.

This sequence of events starting within the cartridge demonstrates the first steps of acquiring pressurization of the projectile's co-chamber while the said co-chamber is in the cartridge case for priming the ignition of a charge portion within the first chamber of the bore wall as shown in FIG. 13, then afterwards all the bore wall chambers are primed to burn explosively by the projectile pre-ignited sequentially in succession in the same manner but now by propellant gas pressure generated in the first bore wall chamber and transiently within each preceding bore wall chamber and simultaneously sharing developed propellant gas pressure within the in transit co-chamber of the projectile as shown in FIG. 13, with said in transit co-chamber then a moment later independently splitting away from each bore wall chamber by means of the structural interfacing interactions of each of the segmented smooth, bore wall bearing surfaces interfacing with conjoining interface bearing surfaces of the in transit projectile captively confining high gas pressure in the projectile's co-chamber, as shown in FIG. 14, and a moment later these said transient interfacing bearing surfaces of the caliber sized segmented bore wall areas interacting in sequence with those interfaces of the in transit bearing surfaces of the projectile which structurally configure sequentially to form and act as quick acting valves to relieve the co-chamber's hot high pressure gases into each succeeding segmented bore wall chamber as shown in FIG. 15, to thereby sequentially prime each of the said bore wall chamber's charge portions to burn explosively as confined by the projectile, and then relieved rearward from the projectile which sequence of steps for positive acceleration of the projectile are repeated with the projectile in its course along the bore at each segmented bore wall's bearing surface and bore wall chamber segments along the length of the bore. And each time the high pressure gas of a projectile's co-chamber is relieved into a succeeding bore wall chamber the said co-chamber gases undergo a rise in pressure at the said point of relief in the form of a shock-wave front of increased pressure which immediately precedes the sudden ultra-high velocity expansive flow of the projectile co-chamber's high pressure gases into each bore wall chamber and these rises in propellant gas pressure also contributes to increase the overall forwarded velocity of the projectile along the bore of the firearm barrel.

It can be envisioned from the aforesaid that the series of ballistic events occurring inside of the firearm barrel will accelerate the projectile to very high velocities, and to avoid the build-up of frictional forces from impeding the projectile's high positive acceleration, especially at its higher velocities along the bore, the wedging effect of the projectile onto its front propellant charge causes minute particles of that charge to be forced between the hard bearing surface of the projectile and the segmented caliber sized smooth bore wall's bearing surfaces and whereat these said propellant's minute particles of proper explosively sensitive composition are ignited by frictional heat and pressure exerted by these bearing surfaces and explosively burns between them generating explosive gases to provide an explosively gaseous film of lubricant between said bearing surfaces. For explosive-lubricating purposes the projectile's forward gunpowder charge grains may be coated or powdered with an explosive compound having a higher frictional sensitivity and rate of burning than the charge grains. A simpler method to bring about this means of explosive-lubrication would be to powder the charge grains with a fine powder made up from the same gunpowder compound as are the grains of the front charge of the projectile with the great multitude of the said fine particles of the said explosive powder being exposed to more friction and heat, hence burn at a higher rate than the charge grains they cover; and which explosive fine particle powder would also be means by which the larger charge grains may be more efficiently pre-ignited by hot charge primer gases that issue from the projectile's co-chamber.

It is shown in diagram M of FIG. 1, that the bore wall chamber charge when ignited and confined develops a high gas pressure as peaking in the first bore wall chamber, as at J, and thereafter as also shown in diagram M each succeeding bore chamber's rise in propellant gas pressure as indicated as at K, of the second chamber is less due to the increasing velocity of the projectile which increased projectile velocity reduces the time of confinement of an ignited charge to develop propellant gases, and the slowly increasing back pressure of bore column gases somewhat reduces the released velocity of the bore chamber gases and hence the efficiency of increasing the forwarded velocity of the projectile that may be reduced as shown in velocity curve F, so the inventor has shown in diagram M the least optimistic view of the potential of each succeeding bore wall chamber to produce propellant gas pressure and forwarded velocity of the projectile.

When, however in consideration by computation and trials of various mediums of propellant charges each succeeding bore wall chamber may be brought up to a more efficient level of producing propellant gas pressure in consideration that the shallowness and length of the bore wall chambers allows ample time for the projectile to laterally layer a charge portion into each succeeding chamber at increased velocity, because as the forwarded velocity of the projectile increases so does the lateral forced wedging action acting on its front charge increase to upset the charge into each succeeding bore wall chamber. And in consideration too of reaction time for gas to expand when relieved from under high pressure, and that although the charge in each succeeding bore wall chamber has less time to burn to produce propellant gases, each succeeding bore wall chamber may have a more powerful charge deposited, as further described below, and will open more quickly to accomplish a wider opening of the bore wall chamber's orifice at the projectile for entrance of initially a larger expansive volume of charge primer gases that provide a greater quantity of the said hot gases in less time that will enter a bore wall chamber to reach and ignite in less time a greater quantity of gunpowder charge grains in said bore wall chamber to thereby ignite the said charge grains more efficiently, and then when the propellant gas pressure developed by said charge is relieved from its chamber at the projectile the increased velocity of the said projectile will also decrease the time required for creating a larger orifice opening to relieve said chamber gas pressure respective to its reactive time of expansion, and therefore each succeeding chamber's orifice will open wider by the time gas pressure had time to expansively react and to flow thereat through said orifice, and the volume of expansive flow of gases under pressure being relieved out of each succeeding bore wall chamber will be more efficient, and these increased coefficient of ballistics of ignition and burning of charges and then expansive propellant gas flow into succeeding bore wall chambers, and ignition and burning of those charges with the coefficient ballistics of the expansive volume of flow of propellant gases out of said bore wall chambers overcomes in great part the entropy of decreasing confinement time of each succeeding ignited bore wall charge to generate a high propellant gas pressure.

Then, too, a method is shown in FIG. 10, of the projectile having its front charge comprised of layers of different types of gunpowder charges as at 22B and 22C of the powder case as at 19 to increase the overall efficiency of the rate of burning of charges in stages, especially in the more forward succeeding bore wall chambers. And once the flow characteristics of the cartridge's front charge grains into the bore wall chambers is established through computation and trial, including viscous or entangling grain surfaces to control layer flow, two or more layers of propellant charge grains of differing burning characteristic can be used together for the front charge as shown at 22B and 22C of FIG. 10, for staged depositing into the bore wall chambers to increase burning efficiency with the outer layer as at 22B having a slower explosive burning rate than the inner layer as at 22C having a faster explosive burning rate. And with charge grain flow characteristics along the projectile and laterally into the bore wall chambers being established for the layered charges the configuration of the line of demarcation of one charge layer to another layer as approximately shown of the said charge layers of FIG. 10, can be established for certain intermixing characteristics of the differing types and layers of the gunpowder charge grains together so that a larger and larger volume of the faster burning inner portion as at 22C of the layered charge becomes mixed together with a smaller and smaller volume of the slower burning potential of the outer layer of the front charge as at 22B to obtain a fairly even increased rate of burning of these mixed charge layers deposited together in this manner into each succeeding bore wall chamber.

And another method of gradually increasing charges and the efficiency of their burning rates in each succeeding bore wall chamber can be brought about by various methods of pre-ignition of and dispersion of the projectile's front charge as it is scattered along the bore out ahead of the projectile, considering that the inertia of individual grains of the charge can be overcome such more quickly than the inertia of the much larger solid mass of the projectile when using some of the rear charge propellant gases partially released at high expansive velocity past the projectile to disperse and pre-ignite its front charge as follows.

FIG. 8, shows a more simple alternate embodiment of a cartridge case as at 19C that has only the resiliently compressible thickened reduced caliber sized case wall as at 37A which has the rear propellant-gas-sealing function as shown at 37 of FIG. 3, but the case sealing rings as at 36 of FIG. 3, and case channels as at 24 are not included in the cartridge case of FIG. 8, which case is fully loaded as a cartridge 51, FIG. 10, used in an especially minutely oversized cartridge chamber at the breech end of an alternate embodiment of a firearm barrel described below as illustrated in FIG. 10.

The cartridge case as at 19C of FIG. 8, is assembled as a cartridge with a projectile seated in it having rear and front charges as is shown exemplified in FIG. 10. And this said cartridge of FIG. 10, when if preferably fired in a special oversized cartridge chamber of the breech end (oversized cartridge chamber not shown) of the barrel by any conventional firing mechanism indenting primer 20, of case 19, FIG. 10, will expand the interior surface of the case's sidewall outwards very slightly away from the projectile's bearing surfaces to the limit provided by said cartridge chamber's wall to which the exterior of the case can go by gas pressure developed in the said case by the firing of the rear charge chamber as at 39A of FIG. 8, and the said expansion of said case will allow a precise small portion of the charge's gases that are under pressure to expansively escape around and past the projectile to the projectile's front charge, and forcing the front case's crimp as at 23B to open, and the gases thereby in reaching and colliding with the front charge overcomes the inertia of the front charge's grains 22 of FIG. 10, as it primer ignites the surfaces of the grains dispersing said front charge's grains out along the bore ahead of the projectile where initially the unconfined charge grains burn slowly before the relatively great inertia of the projectile is overcome by the remaining continuing development of pressure of the rear charge's propellant gas acting on the projectile, as then a moment later the projectile's bearing surfaces begin to move forward against the cartridge case's reduced caliber size thickened compressible wall area as at 37B of FIGS. 8 and 10, and forms a seal therewith the projectile's bearing surfaces 14 and 16 as the projectile tightly compresses said thickened wall area 37B to the caliber size of the projectile's bearing surfaces while the then sealed in rear charge gas pressure increases as at pressure curve E, diagram M of FIG. 1.

The projectile's velocity substantially increases as at the lower end of velocity curve F, and begins overtaking and gathering the said dispersed front charge grains ahead of it against and along its pointed front ogive form laterally forcing more and more of the said charge grains sequentially into succeeding bore wall chambers as the limited small force of the said rear charge's gas pressure and heat previously released onto the said dispersed grains quickly subsides, and these charge grains having little stored kinetic energy absorbed from the said rear charge gases then quickly slow down losing their forwarded velocity along the bore as the projectile quickly gains extra energy continually increasing its positive acceleration as it goes past each successive bore wall chamber. It being pointed out here that as the bore column gas pressure may gradually increase slowly behind the projectile due to gas pressure released into the bore column gases from each succeeding bore wall chamber there is a minor correlated continuing decrease in the exiting velocity of the bore wall chamber's propellant gases; and by properly balancing these two mediums of low and high intermixing propellant gas pressure, gas-cutting by the high velocity propellant gases acting on the bore structures can be accordingly reduced; and also increased gas pressure being generated due to the shock wave developed by the two colliding gas mediums of the bore column and of the bore wall chambers can be properly managed with propellant gas pressure and its relieved expansive velocities kept at safe levels while efficiently accelerating the projectile in the bore to conserve the structure of the firearm barrel.

To precisely limit the portion of aforesaid rear charge gases that can escape forward of the projectile, the cartridge case of FIG. 8, can expand only a limited given distance within its cartridge chamber and away from the bearing surface of the projectile nested in the cartridge, and with the reduced caliber of the forward interior surface of the compressible case wall having a maximum reduction of its caliber as at the forward point of its interior wall surface as at 37B of FIG. 8, to which, in the expanded case, the projectile's front bearing surface must move against to create a positive seal against further escape of the rear charge's propellant gases, and which sealing time or initial jump of forward movement of the projectile can be precisely controlled by the magnitude of expansion of the cartridge case allowed against the cartridge chamber's interior wall surface, and in this manner a precise volume and quantity of force of rear charge expansive gas pressure is allowed to escape forward around the projectile to reach the projectile's front charge and thereby the magnitude of velocity of dispersing said front charge out ahead of the projectile is also limited and thereby controlled.

And it is further described as shown in the drawings that by the curved form of the recessed chambers of the bore's wall in conjunction with the projectile's co-chamber and alternate embodiment 9 will create an orifice shared by said chambers with each succeeding bore wall chamber with the axis of the said orifice directed at the curved structure of each chamber's wall and thereby the said co-chamber will issue their hot propellant gases turbulently in sequence into each charged bore wall chamber which said turbulent action of the gases contributes to the overall efficient burning rates of said chamber confined charge grains.

Still another method for pre-igniting and dispersing the projectile's front charge can be brought about by the basic structure of this specification by sole use of the projectile's co-chamber 9 cooperating with another embodiment of a cartridge case having case-end gas-channels structured as in FIG. 7, described below.

FIG. 7, shows another embodiment of the forward half of the cartridge case as at 19B of FIG. 5, as this forward half of its case is shown in FIG. 7.

When the cartridge 34 of FIG. 3, is fired gas-channels 24 illustrated in FIGS. 3 and 4, and then sealing rings 36 and thickened compressible case wall sealing area 37 causes a portion of rear gases to be captured in the projectile's co-chamber 9 in a manner as afore disclosed. The projectile is started out of its cartridge case pushing its front charge ahead of it out of the case and then as the projectile's sealed in co-chamber filled with propellant gases under pressure reaches the case-end gas-channels as at 25 of FIG. 7, only propellant gas pressure captured in said co-chamber 9 is released along said gas-channels 25 to precisely pre-ignite and disperse the projectile's front charge which charge's inertia has already been first initially overcome and gaining in a forwarded velocity momentum by and with the projectile's initial forward movement, and which charge the higher velocity of the projectile's co-chamber's released and expanding gases overcome impinging onto the moving charge grains dispersing them scattered along the bore for a distance ahead of the projectile.

A feeder-ring as at 42 of FIG. 7, can be included to be formed as a tiny groove recessed in the case's interior wall into which said feeder-ring case wall recess a minute portion of the front charge is deposited and passed to the projectile's co-chamber as the said co-chamber transiently moves past the said feeder-ring charged case wall recess and thereby the minute charge portion in said feeder-ring case wall recess contributes to explosively raise the magnitude of gas pressure captured in said co-chamber which raised gas pressure is a moment later released along gas-channels 25 with greater power to act with more energy to pre-ignite and disperse the projectile's front charge in accordance to certain ballistic demands of certain types of firearms in which this added force of the projectile's co-chamber would prove useful.

It can be seen in this specification that the lengths of the projectile's said rearward and forward bearing surfaces in accordance to their enclosing transitional time across the mouths of the bore wall chambers determine to a large degree the magnitude of the rises in propellant gas pressure developed from an ignited specific charge type or types within each of these said bore wall chambers; and that the lengths of interfacing bearing surfaces can be reduced or increased to produce either a lower magnitude of propellant gas pressure, or a higher magnitude of propellant gas pressure in said bore wall chambers. And therefore in another embodiment of the projectile's bearing surface structure the same would be true especially of the longitudinal length of the forward bearing surface of the projectile for especially controlling the magnitude of sudden rises of propellant gas pressure within the bore wall chambers.

This embodiment of the projectile as shown in FIG. 9, provides an increase in the amount of propellant charge grains that may remain as deposited sequentially along the bore within each succeeding bore wall chamber by the projectile by shortening the said front bearing surface structure of the projectile as at 47 of FIG. 9, parallel to and along the projectile's longitudinal axis to be a little shorter than the lengths of the mouths of the bore wall chambers as exemplified as at 26E of FIG. 9, parallel to and along the longitudinal axis of the firearm's barrel so that in this embodiment of the shortened front bearing surface of the projectile in its transition along the bore of the firearm barrel will allow the projectile's co-chamber as at 9A, to pre-ignite a charge in the bore wall chamber as previously described in the foregoing specification but with the front bearing surface of the projectile not totally confining the charge (as exaggerated in FIG. 9 for sake of illustration) at the moment of its ignition but leaving a small opening momentarily of the forward portion of the bore wall chamber as at 48 forward of the forward end of the bearing surface of the projectile and thereby allowing the pre-ignition expansive energy of the projectile's co-chamber charge priming gases to expansively force out some of the charge's grains (accordingly to charge grain size) deposited in the bore wall chambers by the projectile, while at the same moment causing slight forward displacement and some priming of the remaining bulk of the front charge left unconfined in front of the projectile as a moment later the primed charge portion left remaining now begins burning less compactly in the said bore wall chamber as it becomes totally confined in the said bore wall chamber by the projectile's bearing surfaces as the projectile continues its forward movement along the bore. It can be seen that this course of action of the projectile will prevent a solid compact layer of a portion of the front charge of the projectile from remaining forced into the bore wall chambers, and due to very high positive acceleration of the projectile along the bore the amount of time a bore wall chamber is only partially confined by the projectile's front bearing surface by leaving a forward opening of said chamber, as at 48 of FIG. 9, to allow out some of the charge portion in the said bore wall chamber will be accordingly, to the magnitude of increasing velocity of the projectile, less and less with each succeeding bore wall chamber along the bore, and therefore more and more of the front charge portion in the said chambers will be retained to remain in the bore wall chambers thereby gradually increasing the amount of the charge grains of a charge portion left in each succeeding bore wall's charged chambers in accordance, also too, of the web and/or grain size, or mixed web and/or grain sizes of a particular gunpowder or mixed types of gunpowders used for gradually increasing the magnitude of propellant gases that can be developed sequentially in each succeeding said bore wall chamber from its charge portion, especially when it is taken into consideration along with mixed grain and/or web sizes of a charge of which some are small enough to be forced out, that the rear portion of each said bore wall chamber opens as at 49 of FIG. 9, more and more quickly with their nozzle orifice opening formed by the projectile opening increasingly wider in a shorter time period with each succeeding bore wall chamber for the charge portion left in each said bore wall chamber to be primed to ignition sequentially by the projectile's co-chamber more and more efficiently as the frontal area of each said succeeding bore wall chamber more and more quickly closing to totally confine its ignited charge to develop propellant gas pressure that is sequentially relieved, in a manner as previously described, at the rear of the projectile and into the closed bore column system of propellant gases confined rearwardly of the projectile.

In other words the co-chamber's nozzle orifice 49 opening at the rearward end of the mouth of the said bore wall chamber and at the rear end of the front bearing surface of the projectile opens as at 49 wider and wider at each succeeding one of said bore wall chambers while the forward orifice opening at the forward end of the mouth of the said bore wall chambers 26E as at 48 becomes smaller and smaller relative to the transit passage time and length of the front bearing surface of the projectile as at 47 correlated to reactive time of relief to expansive flow of the projectile's co-chamber's high pressure gases reacting to flow into said bore chamber; and so with each succeeding bore wall chamber a greater quantity of the bore wall chamber's burning charge grains and expanding gases will remain, and in the same manner to be developed in each succeeding one of said bore wall chambers when as each one of said chambers sequentially becomes totally confined by the transient passage of the projectile's annular caliber sized interfacing smooth bearing surfaces as at 47 and 15 of FIG. 9, bearing against the annular caliber sized segmented smooth bore walls as at 27 of FIG. 9, between said bore wall chamber and across the mouth of each said bore wall chamber opening at the said bearing surface of said segmented bore walls.

The following of a portion of this specification brings out and exemplifies further means of front charge pre-ignition and also dispersing of the front charge ahead of the projectile by bore column gases brought about to be initiated not by a cartridge powder case but by the barrel's structure, but by which means of the barrel's structure is considered less efficient than the means of the cartridge powder case's structure, the means of a cartridge powder case, when cartridge powder cases are used in the cartridge chamber of the breech end of the firearm barrel are preferred. As now further being brought out that in guns as those that do not utilize cartridges but load propellant charges into a firearm barrel's bore separately of the projectile without use of cartridge powder cases the pre-ignition and/or dispersing of the front charge of the projectile by the firearm barrel's bore structure becomes the only means by which these said functions of pre-ignition and/or dispersing of the said propellant charge in front of the projectile can be precisely obtained with the foregoing spirit of this specification, and therefore, become an essential structure.

So in order to be in compliance in attaining certain coefficients of the firearm barrel's ballistic systems of this invention in accordance with certain requirements of gun barrels that do not employ cartridge powder cases to be in harmony with the character of use of projectiles of this specification; similar gas-channels formed in the breech end chamber area wall may also be used as a certain additional structural configuration with that of the particular bore obturating characteristics of the interface bearing surfaces of the projectile and breech end chamber wall with inclusion of the breech end chamber wall gas-channels (not illustrated) of the bore to allow for the precise limited relief along the said breech end chamber wall by way of said gas-channels of a small portion of the expansive volume of bore column propellant gases from behind the projectile to flow forward into the projectile's co-chamber to bring about pre-ignition of the projectile's forward propellant charge, or to have limited said propellant gas expansion to flow past the projectile to accomplish some gained forward dispersion of the said forward charge of the projectile to more suitably meet its particular ballistic requirement analogously in particular ways previously exemplified by cartridge powder cases that use gas-channels.

Gas-channels may be formed into the wall of the breech end chamber of a barrel using caseless ammunition and low propellant gas pressure in its breech end chamber by cutting into the wall of said breech end chamber preferably shallow and narrow longitudinal grooves being equidistant and parallel to one another and formed in longitudinal lengths longer than the rear bearing surface of either projectile of FIGS. 12 and 16 but shorter than the combined lengths of the forward and rearward bearing surfaces separated by co-chambers of these said projectiles with said breech end chamber wall grooves acting as propellant gas-channels (not shown) to fill the co-chambers of said projectiles with propellant gases under pressure developed from a small propellant charge fired in the breech end chamber rearward of said projectile for purposes, as the projectiles move forward along the bore, of primer pre-ignition of charge portions of the front charge of the projectiles deposited by the projectile into a bore wall chamber; and if dispersion and priming of the said front charge of the projectile as scattered along the bore in front of the projectile is desired the said gas-channel grooves in the breech end chamber's wall can be elongated to be somewhat a little longer than the combined lengths of the projectile's front and rear bearing surfaces that are separated by their co-chambers.

And in firearm barrels that do employ cartridge cases for cartridges in their breech end cartridge chambers, and the cartridge case not having gas-channels as in the embodiment of the cartridge case of FIG. 8, that cartridge case would provide a positive propellant gas seal in a tight chamber that is not oversized to keep propellant gases developed from a small charge at the rear of the projectile sealed from expanding forward past the projectile's bearing surfaces. The projectile's co-chamber may be filled with the said rear charge's propellant gases under pressure by having the first portion of the segmented bore wall as at 27B of FIG. 10, longer than only the rear bearing surface of the projectile and diametrically minutely larger than the caliber of the projectile to allow rear charge propellant gases to expand past the rear bearing surface of the projectile into the said projectile's co-chamber under pressure when the projectile is fired along the main bore with the forward bearing surface of the projectile's caliber obturating and sealing the bore at the true complemental caliber of a segmented bore wall portion as at 27C of FIG. 10, located immediately ahead of the bore wall chamber as at 26B.

The above said function of the diametrical widening of the segmented bore wall portion as at 27B of FIG. 10, can also be brought about and/or complemented by diametrical minute widening of the interior wall end portion of the mouth of the above cartridge case of FIG. 8, to be minutely diametrically larger, and preferably longer, than the caliber of the projectile's rear bearing surface, as exemplified when using the projectile embodiment of FIG. 16, in the cartridge case of FIG. 8, as illustrated in FIG. 10.

The projectile of FIG. 16, can be interchangeably used in any of the cartridge case embodiments of the specification providing that the projectile-seat and interior wall surface in each said cartridge case are of the proper complemental forms to meet with the particular projectile profile to be used in the said cartridge cases, and in which any of the projectile embodiments of FIGS. 12 and 16 would have the same correlative aforesaid functions within said cartridge cases as when assembled and fired as cartridges in the breech end cartridge chambers of the firearm barrels.

FIG. 10, illustrates particular embodiments of a firearm barrel and a cartridge loaded into its breech end cartridge chamber which functions thereof are fully described below.

The projectile embodiment as shown in FIG. 16, has a co-chamber, as at 10 which modulates bore column propellant gases, and the bore wall chamber's gases somewhat differently than the embodiment of the co-chamber as at 9 and 9A of the projectile embodiments of FIGS. 12 and 9. The greatest similarities of these projectile embodiments is the manner, in which they are fired from the cartridge cases as shown in FIGS. 7 and 8 which in the foregoing description of the firing of the projectiles of FIGS. 9 and 12 within said cartridge cases 5, 7 and 8 and as when assembled and fired as a cartridge as at 34 of FIG. 3 is essentially the same manner of which the projectile of FIG. 16 may interchangeably be used and fired in these said cartridge cases forming a cartridge as at 51 of FIG. 10. The significant differences in the manner of propellant gas modulation of the projectile of FIG. 16, from that of the projectiles of FIGS. 9 and 12, begins as the projectile of FIG. 16, exits out of the mouth of the cartridge case into the main bore of the firearm barrel below.

The sequence of general ballistic events is now described as illustrated in FIG. 10, which in this scenario the cartridge 51 is loaded into a "tight" cartridge chamber 29B and the cartridge case cannot be expanded outward away from the projectile upon the firing of primer 20 and firing of said primer accomplished by means of any known action which ignites the small rear charge 21 that develops only low propellant gas pressure to force the projectile 16 forward with its obturator bearing surface forced through the reduced caliber opening of the cartridge case's interior wall as at 37B compressing the case wall diametrically outward to caliber size which creates a positive seal against the projectile to prevent passage of the rear charge's propellant gases, and then as the projectile continues its forward movement the projectile's forward end enters the main bore with its front ogive form as at 28B upsetting the projectile's front propellant charge of gunpowder pushed out of said cartridge case of the projectile and thereby laterally forcing portions of said front charge of the projectile into bore wall chambers as at 26F as illustrated in FIG. 18, while the forward bearing surface as at 14 of the projectile's body fills and obturates a smooth caliber sized main bore wall second segment as at 27C confining the charge portion deposited into the bore wall chamber as at 26B rearward of the projectile and providing a seal against said segmented bore wall's bearing surface thereby also preventing bore column propellant gases under pressure from escaping entirely forward and entirely past the projectile while the rear bearing surface of the projectile as at 16 begins to pass by a first portion of the segmented bore wall as at 27B which is minutely diametrically larger than the caliber of the rear bearing surface of the projectile and larger than the true caliber of all other bore wall segments. The enlarged first bore wall segment allows a minute opening at the said rear bearing surface, as at 16 of the projectile for bore column gases under pressure to expansively be relieved through said opening along said bearing surface 16 and into the co-chamber 10 of the projectile and also into the first bore wall chamber 26B and igniting said bore wall chamber's charge captured and confined to bore column gas pressure by the obturative passing of the projectile's propellant gas sealing forward bearing surface 14 along the forward bearing surface of a true caliber sized smooth bore segment 27C of FIG. 18, and proceeding to a succeeding caliber sized bore segment 27D.

The projectile's rear bearing surface and forward bearing surface and co-chamber 10 in transit to the next bore chamber 26F cooperate in conjoint-action in forming a single conjointly confined chamber together with the bore wall chamber 26F of FIG. 19 and in which said bore wall chamber the propellant charge portion deposited in it by the projectile has been ignited by bore column gases and explosively burns at a greater rate and reaches a higher magnitude of developed propellant gas pressure and heat then of the rear bore column's propellant gas pressure and heat and, with forward projectile movement, the segmented bore wall chamber as at 26F of FIG. 20, simultaneously together with its conjoined co-chamber 10 of the projectile expansively relieves their built-up heat and pressure of propellant gases rearward from the rear circumferential perimeter of the projectile's bearing surface as at 16 of FIG. 20 into the lower pressure and heat of the bore column gases as it moves past the circumferential co-axial perimeter of the rearward end of said bore wall chamber 26F of FIG. 20.

The effect of this relieved propellant gas pressure and heat from the said chamber is that initially when a gas that is held under high pressure is suddenly relieved into a lower pressure environment there is a rise in pressure of the gases at their point of relief, and therefore a rise in propellant gas pressure caused to occur in the form of a shock-wave front of increased propellant gas pressure that immediately precedes propellant gas flowing to and from the orifice opening with a drop in pressure as at 18 of FIG. 20 point of relief by the initial annular opening being formed by the said transitory movement of the rear end of the projectile's bearing surface as at 16 of FIG. 20, in transit past the rearward end of the bore wall chamber as at 26F of FIG. 20, and the said shock-wave front of higher propellant gas pressure which immediately precedes the expansive flow of propellant gases from the opening of orifice 18 which increased pressure initially forces the projectile forward with greater force of its relieved propellant gases than that of the overall bore column's propellant gas pressure while said orifice 18 gas pressure also has a rearward force effect on the firearm barrel, as at the same moment the projectile's helicoidal heel area as at 4, tapered as at 2 of FIG. 16, together with the smooth bore wall segment as at 27C of FIG. 20, share the form of a transiently conjoined nozzle passageway as at 8 of FIG. 20, from said opening of orifice 18 which speed-up the expansive flow of said chambers propellant gases relieved ultra-high velocity through said opening of orifice 18 of the said nozzle with a drop in pressure occurring immediately behind said shock-wave front of increased propellant gas pressure which turbulently issue into the lower turbulent gas pressure of the bore column of gases and causing jet reaction propulsion forces to also force the projectile forward, as also does a forced change of direction of said jet stream of propellant gases along the helicoidal curve as at 40A of FIG. 16, of the projectile's tapered-heel 2.

In accordance with the said nozzle orifice 18 of FIG. 20, opening axis of orientation to propellant gas flow causing a degree of reactive jet-propulsive forward force to act on the firearm's barrel and which residual forward force of kinetic energy thereby absorbed by the barrel would resist to a degree or cancel the rearward reactive forces of recoil of the firearm barrel by opposing the force of the bore column gas pressure against the constant cross-sectional dimension of the diametric short axis of the breech face along with opposing the rearward reactive force acting on the barrel as also produced at the bore wall chamber rear perimeter half forming orifice 18, and finally also opposing the recoil jet reaction propulsive force acting on the barrel by its muzzle blast effect of released bore column gas pressure after the projectile leaves the barrel.

The coefficient ballistic steps as described for a bore wall segment correlated to the bore wall's recessed chambers being substantially repeated as the projectile's forward and rearward bearing surface and co-chamber 10 reaches succeeding bore chambers and bore segments as illustrated in FIG. 21, having adjacent rearward and forward bore wall bearing surface segments of true caliber and the projectile's co-chamber 10 having a mouth opening at the bearing surface of the projectile along the said projectile's longitudinal axis longer then each succeeding segmented bore wall's individual bearing surface lengths along the longitudinal axis of the firearm's barrel's bore, also as illustrated in FIG. 21 with said segmented bore walls bearing surfaces shown superimposed through the projectile in transit along the bore which allows areas of transient relief of the bore column's propellant gases under pressure to expansively flow past the rear bearing surface 16 of the projectile and along the projectile's co-chamber 10 and into succeeding bore wall chambers as at 26G of FIG. 21 and ignites a front charge portion within said chamber 26G deposited therein by the projectile and which said ignited charge in said chamber 26G a moment later becomes totally confined by the interaction of the forward and rearward bearing surface of the projectile passing along the complemental true caliber of the bearing surface of the segmented bore walls as at 27D and 27E of FIG. 21, rearward and forward of the said bore wall chamber 26G totally confining its charge within said chamber 26G and the co-chamber 10 of the projectile (similarly as illustrated in FIG. 19) and in which conjoined chambers 26G and 10 their charge then explosively burns at a greater rate to much higher gas pressure than the bore column of the propellant gases behind the projectile.

The higher gas pressure within said conjoined chambers 26G and 10 is relieved a moment later in the relatively much lower propellant gas pressure of the bore column in a manner substantially as described for the ballistic relief of high pressure propellant gases by said projectile 16 previously from the preceding second bore wall chamber as at 26F, and this ballistic step of projectile 16 interacting with the third bore wall chamber 26G repeated with each succeeding bore wall chamber recessed from the segmented bore's wall wherein each charge portion of the projectile's front propellant charge is deposited sequentially by the projectile is primed to begin burning by the heat of the bore column's low pressure propellant gases expanding into each said succeeding bore wall chamber through an opening formed as before described as at 44 of FIG. 21 at each succeeding segmented caliber of the bore wall of true caliber in juncture with each said succeeding propellant charged bore wall chamber which a moment later becomes a duality of chambers when as sequentially conjoined with the in transit projectile's co-chamber 10; which conjoined chambers are confined by the projectile's transit rearward and forward bore obturator bearing surfaces separated by the projectile's co-chamber 10 and thereby sequentially all of the bore wall chamber's charges are pre-ignited and then confined and relieved of their sequentially explosively developed propellant gases by transit interaction of the projectile's obturative bearing surfaces that bring about a series of explosive rises in propellant gas pressures that act directly at the projectile.

It is brought out here more specifically than said before that the interior diametric perimeter of the mouth of the cartridge case inward along its star crimp fold areas can also be formed with an annular opening minutely larger than the bearing surface caliber of the projectile to allow and/or complement rear charge propellant gases to expansively flow along the projectile to pre-ignite a portion of the said projectile's front charge in the first bore wall chamber; or the combined widening of the cartridge cases mouth, and first bore wall segment, as 27B of FIG. 18, can function to allow a limited spurt of expansive propellant gas flow from the said rear charge of the projectile to the said front charge of the projectile to thereby, to a certain degree, disperse the said projectile's front charge while also pre-igniting it for sequential gathering and depositing into said bore wall chambers by the over-taking increasing speed of the body of the projectile.

This embodiment of the projectile of FIG. 16, can be interchangeably used in the cartridge case as at 19B of FIG. 5 with said cartridge case, when fired as a cartridge with the projectile of FIG. 16 having the same approximate interior ballistic functions as described in the foregoing specification for the projectile of FIG. 12 but with the bore of the firearm barrel of FIG. 10 having segmented bore walls, after the first segmented bore wall, having greater longitudinal expanse of their smooth segmented bore wall's bearing surfaces between the said bore wall chambers than the segmented bore walls of the firearm barrel illustrated in FIG. 3.

All embodiments of the projectiles illustrated in the accompanying drawings may have included in them any type of known internal guidance system of any conventional form or manner of implementation in keeping with the exterior structural integrity of the projectile to be fired along the firearm barrel's bore to guide them to their target with or without the use of helicoidal notches or vanes in the tapered-heel of the projectile; and only neutral flow notches may be formed in the said tapered-heel of the projectile that turn propellant gas flow but not predominately to the right or to the left; or a notchless smooth tapered-heel of the projectile may be used.

Also it is further brought out in this specification that under certain interior ballistics the use of explosive propellant gases for especially lubricating the rear bearing surfaces of the projectiles, as at 15 and 16 of FIGS. 12 and 16 can be brought about more effectively for particular use in the firearm barrel by structurally altering of these said rear bearing surfaces and forming another embodiment thereof by minute reduction of their caliber in several ways relative to the caliber of the segmented smooth bore walls and the caliber of the front bearing surface of the projectile as at 13 and 14 of FIGS. 12 and 16 below.

The said rear bearing surfaces structures of the projectile can be simply formed minutely reduced in caliber which would allow a molecular layer of each bore chamber's explosive gases to weep highly restricted between said rear bearing surfaces of the projectile and the caliber of the bearing surfaces of the segmented smooth bore walls to provide a molecular layer of explosive gases there between to act as an explosive gas lubrication film between these said bearing surfaces while not significantly effecting the development of high propellant gas pressure from ignited charges in the said bore wall chambers of the firearm barrel.

In another embodiment the rear bearing surface reduction of the projectile can be brought about by use of the high gas pressures developed in each succeeding bore wall chamber. This means of reduction of the projectile's rear bearing surfaces from their full caliber can be brought about automatically by high gas pressure of the bore wall chambers because gas pressure developing from an ignited charge in a bore wall chamber develops its highest gas pressure against the rear bearing surfaces of the projectile; and a projectile's body can be materially constructed to be slightly compressible at a given magnitude of high gas pressure developed in each succeeding bore wall chamber preferably only at the projectile's rear bearing surface whereby a slight leakage of said high pressure bore wall chamber gases is allowed to occur passing in between the reduced caliber of a rear bearing surface of the projectile now pressured away from the full caliber of the segmented bore walls bearing surfaces to thereby weep through to lubricate these said bearing surfaces with a film of high pressure explosive gases sequentially made available at each succeeding bore wall chamber of the firearm barrel. And the said projectile's interior ballistics functions can be made to be more efficient if the said compressible rear bearing surfaces of the projectile are made to be materially constructed to have resiliently elastic properties of compressabilities.

And as a fail-safe measure the said compressible rear bearing surface of the projectile can become even more highly compressed by any accidental excessively high gas pressure that might become developed in any bore wall chamber; and thereby any bore wall chamber having excessively high gas pressure will have the excess of its gas pressure automatically harmlessly relieved rearward between the highly reduced caliber of the rear bearing surface of the projectile and segmented caliber of the bore wall's bearing surface and into the lower pressure of the bore column of propellant gases behind the projectile before said bore wall chamber's gases can rise high enough in excess pressure to become deleterious to the integrity of the firearm's barrel without interruption of repeated firing of the firearm.

Rifling as described in the foregoing specification greatly reduces the magnitude of velocity to which a projectile can be safely accelerated along the bore of the firearm barrel, and will be an obstacle preventing projectiles from safely reaching their full potential velocity and energy at the muzzle; but rifling could be safely used with its lands and grooves cut helically synchronized into each of the segmented bore walls forming another embodiment of the firearm barrel of this invention to impart a twist to projectiles not having pre-formed helicoidal notches in their heels for particular firearms in which ultra-high projectile velocities and energies are not desirable to be obtained in the bore; but what would be desirable would be just to reach the lower conventional feet per second velocities and foot pounds of energies at the muzzle of a barrel as efficiently and safely as possible with as little recoil as possible of the firearm barrel using the principles and elements of this invention when including using rifling in the bore.

When rifling is used in the segmented bore wall the rear charge of the projectile should be kept as small as practically possible to initiate the projectile's speed at the lowest practical velocity as it enters with a long "jump" into the first rifled segmented bore wall area into which it is introduced as gently as possible for indentation of the lands of the rifling into its bearing surface and with the potential energy of the forward main charge of the projectile accordingly reduced correlated to a reduction in the rate of feet per second velocity with which the lands of the rifling will allow the projectile to be safely accelerated along the bore. The said front main charge of the projectile can be pre-ignited and dispersed when using a projectile not having a helicoidally formed heel, and not having a co-chamber formed at its bearing surface seated in the simpler form of a cartridge case as shown in FIG. 8 forming a cartridge for use in an over sized cartridge chamber of the breech end of the firearm barrel, as described in the foregoing specification, that allows the cartridge case when fired to expand in its cartridge chamber away from the bearing surface of the projectile nested in it to allow a portion of the developing gases of the ignited rear charge of the cartridge to expand around and forward past the projectile to ignite and disperse its front charge.

And the projectiles should have preferably a tapered-heel or as sometimes termed a boat-tail that includes a curved surface for causing turbulent flow of propellant gases issuing from the bore wall chambers and preferably, too, in the form of a helicoidal-heel of the projectile as illustrated in the drawings to assist its rotation and to cause a multitude of eddies in turbulent flow of the said propellant gases as further described below.

The increasing volume of the length of the bore column of gases behind the in transit obturating body of the projectile allows an increasing volume of space into which all of the bore's gases can expand with the overall gas pressure of the bore column of gases behind the projectile kept relatively low relative to the turbulent relief of the high pressure propellant gases issuing from the bore wall chambers of which the shock of introduction is decreased into the bore column of gases by the turbulence established in the said bore column of gases by the turbulent gas flow along the helicoidal-heel of the projectile in reference to the relative greater shock if the said bore column of gases were not turbulent and had a higher velocity of streamlined flow, because instead of a head-on collision occurring with a static pressure head of propellant gases of a streamline flow which could otherwise cause formation of deleterious lateral pressure shock waves onto the barrel's mass, there is instead a meeting of two harmoniously converging turbulent sources of propellant gas flow with one of a higher power issuing from the bore wall chambers converting to the one with the lower power of the bore column of gases resulting in turbulent diffusion of all these propellant gases with the exchange coefficient for the diffusion of a conservative property caused by eddies in the turbulent flow being turned at a greater rate with the slower rate of turning or revolving of eddies in the lower power of turbulent flow of the bore column of gases being increased in their rate of turning or revolving by the invasion of the higher power's turbulent flow of gases issuing from the bore wall chambers having eddies turning or revolving at a much higher rate resulting in the distribution of kinetic energy among eddies with various frequencies of rotation and sizes due to the combined magnitudes of turbulent heated mass transfer being equal to the ratio of the eddy mass diffusivity to the eddy thermal diffusivity correlative to the coefficient of turbulent flux in accordance to the differing pressures heat and turbulent flow of the bore wall chamber's propellant gases meeting with differing pressure heat and turbulent flow of the bore column of propellant gases.

The interchange coefficients of the propellant gases is brought about to be more safely efficient by the establishment of coefficients of eddy flux in turbulent flow in the bore column of gases preferably at the bore column of gases lowest possible practical pressure and low initial streamlined flow velocity from the breech area to turn said streamlined flow of the bore column of gases from the breech early on to a highly turbulent flow along the bore column thereby to reduce the magnitude of the formation of lateral pressure shock waves in the expansive flows of propellant gases as aforesaid especially further along the bore to the muzzle end of the firearm barrel whether or not the projectiles are to be rotated by gas pressure action on their helicoidal-heel; because it is desirable to have the propellant gases turned immediately at the rear end of the projectile's rear bearing surface along curves, or a curve formed in the heel of the projectile, even if the turning of these gases does not cause rotation of the projectile, and propellant gas flowing turbulently out of the bore wall chambers will still efficiently accelerate the projectile forward by the combined effects of the propellant gases as, aforementioned, when they are suddenly relieved from the bore wall chambers under pressure, the said gases undergo a rise in pressure at the points of relief in the form of a shock-wave front of higher pressure, and because this rise in pressure of the propellant gases is brought about at points between two moveable objects (namely the firearm barrel and the projectile) with one body having a much greater mass and inertia (the firearm barrel) then the other body (the projectile) the forwarded positive acceleration of the body of less mass and inertia (the projectile) is greater and becomes still greater as the said gases of the bore wall chambers become turned against the curved surfaces of the projectile's body while producing a certain amount of jet-reaction propulsion force effects which although reduced by the turbulence of the gases relieved from the said bore wall chambers along the curved nozzle passageway formed by the projectile's heel, these said jet-reactionary propulsive forces are only secondary to their safe turbulent introduction into the bore column of gases while the orifice of the said nozzle still increases propellant gas pressure at point of relief between the said bore wall chambers of the firearm barrel and the projectile while the immediate turbulent flow from the said orifice along the rear curved structure of the projectile push the projectile forward, while some of the jet-reaction propulsion forces reduce recoil of the firearm barrel as described in the foregoing specification.

The preferred projectiles of this specification as illustrated in the accompanying drawings having cylindrically formed rearward and forward bearing surfaces of proper caliber complemental to the proper cylindrical form of the proper caliber of the segmented smooth bore walls bearing surfaces, and the co-chambers of the projectiles can be more than one in number, or the annular groove of the said co-chambers can also be formed into separate cavities or recesses in and around the caliber of the projectile's bearing surface leaving an area of continuity of the front bearing surface to extend to the rear bearing surface to provide added support to the projectile by its bearing surface while in transit along the bore bridging the mouths of the bore wall chambers.

The co-chamber 9 of the projectile shown in FIG. 12 has a mouth of less length along the longitudinal axis of the projectile than the length of the smooth caliber of a segmented bore wall along the longitudinal axis of the bore and thereby capable of relieving a short burst of extremely high velocity propellant gases of low mass and of high heat and pressure previously captured in it from developing propellant gas pressure of a preceding bore wall chamber into a succeeding charged bore wall chamber and thereby ignites the succeeding bore wall chamber's charge in a very short space of time which is an advantage for projectiles reaching for the highest velocity along the bore by giving each of the bore's bore wall chambers charges the advantage, by ultra-fast priming and ignition, of reaching their fullest potential of explosive high pressure capacity of a volume of high energy propellant gases safely in shortest possible time.

Any adverse jet-reactionary force effects, or nozzle orifice force effects on the firearm barrel by the relief of the projectile co-chamber's high pressure gases into the bore wall chambers is neutralized on its effects on the barrel by the sudden termination of the jetstream of gases relieved out of said co-chamber against the charge and against the forward end of the chambers, the force of which neutralizes any jet-reactionary rearward propulsive force acting on the barrel; and any adverse jet-reactionary propulsive force acting on the projectile by relief of its co-chamber's high pressure gases are overcome to the advantage of the projectile by the change of direction of the gas flow to some degree along the forward slope of the said co-chamber's surface and which said gases thereby give up some of their kinetic energy to the projectile while the said co-chamber's gases undergo an increase in pressure at their sight of sudden relief at the jet-orifice formed between the annular opening at the forward edge of the said co-chamber and the rear edges of the bore wall chambers and which increased gas pressure at the said co-chamber's jet-orifice pushes the projectile forward.

The co-chamber as at 10 of the embodiment of the projectile shown in FIG. 16 has a mouth of a length larger and longer then the smooth caliber bearing surface of the segmented bore wall, with the length of the rear bearing surface of the projectile not as long as the length of each one of said bore wall segments, nor along as a mouth of the recessed bore wall chamber and therefor this projectile embodiment of a co-chamber's charge primer means ignites a charge of a bore wall chamber less quickly by using only the relatively lower pressure of the bore column gases to flow into each bore wall chamber to ignite the charge; but the said co-chamber embodiment of this projectile 16 has the advantage of being able to be structurally configurated into a conjoined position with the bore wall's chamber structure to share, within the structure of the volume of its co-chamber, in both the priming and development of a larger volume of high energy propellant gas pressure sequentially in each bore wall chamber in conjoined relationship with the said co-chamber 10 for simultaneous rearward relief from the projectiles of their chambers combined volume capacity of high pressure high energy propellant gases; and thereby this said structural configuration of the bore's and projectile's chambers greatly increases the overall volume and mass of high energy propellant gases made available to be relieved rearward directly from the projectile, relative to the alternate embodiments of the bore's and projectile's chambers of FIG. 3, to increase the projectile's forward velocity along the barrel's bore to the muzzle end.

And in this embodiment of the projectile's co-chamber as at 10 of FIG. 16 the length of the bearing surface of each of the segmented caliber sized smooth bore walls in configuration with the bore wall chamber structure also governs the magnitude of propellant gas pressure that can be reached or developed in the said bore wall chamber by the interaction of the projectile's bearing surface. Therefore, too, it can be seen that by increasing the length of the segmented bore walls while keeping the same volume and form of the co-chamber of the projectile, and also keeping the same volumes and form of the bore chambers recessed from the segmented caliber of the bore's wall as illustrated at 26G FIG. 19, and as at 26 of FIG. 2 propellant gas pressure can be governed within the said chambers in ratios accordingly to varying the lengths of the caliber of the bearing surface of said segmented bore wall, and in accordance to other interior ballistics as brought out and described in the foregoing specification; and in this manner of configurations of the bore wall bearing surfaces with the projectile all the bore wall chambers, as at 26 of FIG. 2 of the firearm barrel 32 can be of the same preferred shallow broad form and volume capacity for receiving the compact depositing of explosive charges relative to the caliber of the bearing surface of the segmented bore walls as at 27 of FIG. 2 with each said bore wall chamber's gas pressure regulated at near ideal maximum gas pressure by properly increasing the length of each succeeding segment of the caliber of a bore wall bearing surface propellant interface along the bore to the muzzle to match the increasing velocity of the projectile in transit along the bore to the ideal confinement time of each explosive charge portion deposited in each bore wall chamber by the projectile.

So, therefore, by increasing the length of the caliber of the bearing surfaces of the segmented bore walls with each succeeding said bore wall segment a little longer than a preceding said wall segment, all the bore wall chambers charges can be brought to more harmoniously burn explosively in their chambers to develop propellant gases to proper pressure in each succeeding bore wall chamber interactively with the projectile's bearing surfaces, and especially of the projectile's rear bearing surface embodiment of FIG. 16. And with proper increased lengths of the said interfaces of the caliber of the bore wall bearing surface segments the bore wall chambers will thereby have more time to develop their propellant gases in succession within their volumes, and also interactively expansively within the conjoined volume of space provided by the co-chamber 10 of the in transit projectile with the said explosively developed propellant gases in each succeeding bore wall chamber simultaneously relieved rearward out of these chambers of the bore wall and of the projectile between the rear end of the projectile's bearing surface interface and rearward out from between each succeeding interface of the bearing surface of the segmented caliber portion of the bore wall exposed to the mouth of the projectile's co-chamber and into the lower pressure of the bore column of propellant gases which lower pressure is used by way of the projectile's bearing surface propellant interfaces and its co-chamber 10 to prime the ignition of each subsequent projectile charged bore wall chamber and thereby accelerating the projectile's forward movement along the bore as described in the foregoing specification.

And it being further brought out here that although with increased lengths of the said segmented caliber of the bore's bearing surfaces which can be eventually formed in this embodiment longer than the width of the projectile's co-chamber 10, the projectile's co-chamber will then capture a portion of the lower pressure of the bore column of propellant gases by the interface interaction of the bearing surfaces of the segmented bore walls correlated to the rear interface bearing surface of the projectile which longitudinal length remains shorter, then, than the longitudinal length of the expanse of the mouths of the chambers recessed from the bore wall; and by which a moment later as the projectile moves a short distance further along the bore the low pressure bore column gases captured in the projectile's co-chamber 10 are relieved into a succeeding charged bore wall chamber which pre-ignites the said bore wall chamber's explosive charge and its developing gases then expand into the low pressure co-chamber 10 of the projectile which safely allows a greater volume of explosive gases to be developed (compared to the embodiment of the projectile's co-chamber 9 of FIG. 12) simultaneously within the said chamber of the bore wall and said co-chamber 10 of the projectile from the said segmented bore wall chamber's charge consistent in each succeeding bore wall chamber.

It is noted that the flow of propellant gases either forwardly or rearwardly along the helical curves of the projectile's helicoidally notched heel will impart a twisting force rotating the projectile in the same direction around its longitudinal axis regardless of the direction of flow of the said propellant.

In conclusion the simplest and least desirable and least preferable embodiment of a projectile for use in the firearm barrel of FIG. 3 using some of the principles and elements of this invention to maintain low pressure of the bore column of propellant gases behind the projectile producing only a mild recoil of the firearm barrel by deployment of the projectile's main front charge in stages along the barrel's bore would be to have a plain projectile with a sufficiently long cylindrical bearing surface of a proper bore obturator caliber to span the segmented bore wall chambers as at 26 enough to form positive bore obturator propellant gas seals against the segmented caliber of the bearing surfaces of either smooth or rifled bore walls to keep bore column propellant gases positively sealed to the rear of the projectile with the projectile fired from a cartridge case as at 19B but the gas-channels as at 24 may preferably be omitted from the case structure but retaining the cartridge case's special flexible gas sealing rings, as at 36 and forward end case sealing means of the compressible undersized caliber of the case wall structure as at 37 that also keep propellant gases sealed to the rear end of the projectile's bearing surface; and by these means of sealing propellant gases the projectile when fired by low propellant gas pressure developed from its rear charge within a tight cartridge chamber at the breech end from its cartridge case would simply sequentially deposit portions of its front charge unignited into each succeeding bore wall chamber, and each said unignited explosive charge portion in the said bore wall chamber sequentially sealed in said chambers of the bore wall by the proper bore obturator caliber of the projectile's long bearing surface spanning said bore wall chambers against the caliber of the complemental bearing surfaces of the segmented bore walls, and then the said bore wall chamber's explosive charges sequentially passing rearward of the projectile's bearing surface and exposed to the heat and pressure of the bore column of propellant gases which ignites the said exposed bore wall chamber's charges which then explosively burn contributing their developing gases to the overall volume, pressure and heat of the bore column of propellant gases that together continually produce propellant gases of regulated low pressure which continues to act on the constant diametric transverse dimension of the breech maintaining a mild rearward recoil of the firearm barrel while maintaining the forward acceleration of the projectile by said low pressure propellant gases that do not rise very high in pressure with the developing propellant gases generated from the said bore wall chamber's explosive charge due to the greatly increasing volume of the overall dimension of the bore column sealed to the rear of the forward transit movement of the projectile along the bore to the muzzle end.

Whereby this method as just described in the above paragraph would gently accelerate the projectile along the bore to a limited muzzle velocity while keeping recoil of the firearm barrel mild by maintaining a low propellant gas pressure against the breech end; but the bore wall chamber's explosive charge could not be relied on in every instance not to become haphazardly pre-ignited accidentally in this embodiment while the said explosive charges are contained and confined in each said bore wall chamber by the bearing surface of the projectile due to, for example, from hot debris such as still slowly burning unconfined remnants of charge grains that may be left in the bore wall chambers from a previous shot of a rapid firing automatic weapon which might somewhat randomly pre-ignite some of the succeeding fresh explosive charges deposited into the bore wall chambers; and frictional heat build-up in the firearms barrel might also somewhat contribute to said charge pre-ignition which would further restrict the broad use of certain combinations and types of gunpowders, especially of the very quick-burning types that would otherwise be most practical in this embodiment for use to develop to quantity a volume of propellant gases to pressure behind the projectile when raw explosive charges are passed into the copiously increasing volume of the dimensions of the bore column behind the said projectile; and in any event in this particular embodiment, as compared to other embodiments, efficient very high velocities of the projectile to the muzzle end could not be obtained, especially while maintaining mild recoil of the firearm barrel; and accuracy from one shot to the other to the target could not be relied on. Therefore it being more practical and efficient to plan and design for pre-ignition of explosive charges in the firearms barrel's bore ahead of the projectile and/or within the bore's bore wall chambers as transiently confined in the said bore wall chambers by the transit body of the projectile as disclosed and preferred in other embodiments of the foregoing specification where much more reliable and efficient acceleration of the projectile can be obtained at higher velocities and in a shorter space of time while controlling recoil of the firearm barrel which ballistics are more desirable than to try to prevent pre-ignition of the bore wall chambers charges ahead of the projectile, or as confined in the bore's bore wall chambers.

The mouth of the cartridge case of a cartridge may be closed and sealed in any convenient manner such as by forming, as aforesaid, a conventional star crimp, or sometimes termed an indent crimp formed by a number of indents in the circumference of the encircling mouth which is folded over to make an enclosure; or the mouth of the cartridge case may be left in its natural cylindrical shape and simply closed by a plug of wax, or its perimeter may have a rolled crimp in which the rim of the cartridge case is turned inward around its circumference holding in, at the top surface of the projectile's front charge, a fragile propellant wafer disc of proper diameter to block the opening of the said cartridge case's mouth, and a wax-like substance or compound used to seal the said propellant wafer in place (wafer and sealant not illustrated) and thereby sealing in the contents of the cartridge. And upon firing of the said cartridge the said wafer is fractured into many pieces and eventually burned explosively in the firearm barrel's bore wall chambers while sealing substance for the said wafer may also act as a bore lubricant.

The rearward recoil of the firearm barrel in reaction to firing of a charge of propellant within a chamber of the breech area is also reduced due to the projectile's front charge portions upsetting force of impacts forwardly into and onto the segmented bore chamber's walls.

In the final analysis the bore wall chambers may be sized and spaced in any convenient practical form and configuration to meet requirements of the projectile herein when fired along the bore as specified, and the projectiles may have any convenient practical size and configuration of the complemental caliber of its rearward and forward bearing surface in configurate with any practical form and size of a chamber recessed into the surface of the projectile between its said rearward and forward bearing surfaces to meet requirements of the bearing surfaces of the bore and its bore wall chambers as further brought out and exemplified in FIG. 22 in that the bore wall chambers may be spaced and formed in practical conformity to the rearward and forward bearing surfaces of the projectile 53, as at 54 and 52 for capture of front charge 57 portions to open in any practical number at the mouth of the co-chamber 55 of the projectile to bring about the development of a volume of propellant gas pressure from more that one explosively charged bore wall chamber at a time as at 56, 56A and 56B exposed and confined to the projectile's co-chamber as at 55 while only one bore wall chamber's volume of explosively developing gases under pressure as at 56 are sequentially captured and confined at a time at the transit rear bearing surface, as at 54 of the projectile, to be relieved rearwardly of the projectile one at a time in a manner previously described for rearward propellant gas pressure relief.

This interacting conjunction of chamber means is that while two or more explosive propellant charge filled bore wall chambers as at 56, 56A and 56B, and like chambers are sequentially opening at, and burning conjointly within, the transitory co-chamber 55 of the projectile, that the potential volume and pressure of developed propellant gases combined within these conjointly confined chambers of the bore wall exposed to the co-chamber 55 of the projectile will always be in a state of a higher magnitude of developing gas pressure relative to each succeeding single volume of developed gas pressure of a single bore wall chamber 56 becoming independently captured at the transitory rear bearing surface as at 54 of the projectile 53 to be relieved sequentially rearward of the projectile, hence the conjoint-action of developing confined gas volume and pressure of the bore wall chambers as at 56, 56A and 56B thereby sequentially conjointly grouped together in captured succession transiently confined to the co-chamber 55 of the in transit projectile will continue to rise in pressure due to maintaining two or more grouped bore wall chamber's charges confined to explosively burn at a time to produce greater volumes of explosive gases confined transiently together under pressure as captured to expand into co-chamber 55 of the projectile 53, relative to the much smaller volume of only one bore wall chamber of high propellant gas pressure as at 56 being eventually sequentially independently captured and then relieved at a time at the rearward end of the projectile's rear bearing surface, as at 54; and with each successive portion of a captured volume of propellant gas pressure thereby relieved from a bore wall chamber at the rear of the projectile having a higher magnitude of propellant gas pressure at the point of relief than a preceding one of said bore wall chambers resulting in successively higher and higher magnitudes of propellant gas pressure at the point of relief at the rear end of the projectile's rear bearing surface as at 54 occurring to gradually effect higher and higher increases in the projectile's forwarded velocity; and with projectiles furnished with helicoidal-heels effecting a gradually gained rotational speed.

The gradual increasing force of said sequentially relieved explosive propellant gases thereby act to accelerate the projectile more gradually and gently in this embodiment to its full velocity at the muzzle; and which manner of projectile acceleration may especially be desirable for the protection of any fragile type payload which may be carried by the projectile not being subjected to deleteriously high adverse initial inertial resistance to projectile acceleration.

The structure of each projectile embodiment can be conformed to interchangeably be used in any of the cartridge-case embodiments, or the cartridge-case structure conformed to the projectile to make up various types of cartridges with various combinations all of which can be used interchangeably with the barrel embodiments, as the barrel embodiments can be interchangeably structurally conformed to be used with any cartridge components combinations, all component embodiments of the barrel, projectiles, cartridge-cases and cartridges can alternately meet a broad range of certain firearm ballistics functions as disclosed in the specification.

For some firearms, reducing muzzle blasts for sake of increased projectile accuracy when the projectile exits the muzzle can be advantageous. And, muzzle blast can be reduced by lowering bore column gas pressure kinetic energy potential along the bore column to the muzzle end behind the projectile before it exits the muzzle.

In this invention lower column gas pressure expansive kinetic forces released at the muzzle can be naturally attained while maintaining, to a degree, interior ballistics coefficient efficiencies to continue to act with intermittent expansive kinetic propellant gas energy conversions of static pressure of the bore column at the projectile into the bore wall chambers used in the bore by allowing early depletion of the projectile's front charge as deployed along the bore leaving a forward series of empty bore wall chambers to act as bore column gas pressure expansion chambers to lower bore column energy efficiently when propellant gases under static pressure in the bore and acting on the rear area of the projectile are subjected to a partial sudden limited relief of static pressure, into a relatively low pressure and temperature captured environment of a pressure relieving expansion chamber opening into the bore wall forwardly of the point of maximum propellant gas pressure, at the instant when the bearing surface of the projectile has initially passed the chamber opening in the bore wall, whereupon the transiently accelerated bore gases are turned by the projectile to which said bore gases give up some of their momentum absorbed from the column of high pressure gases in the bore to thereby effect continuing rotation of the projectile and increases of its forwarded velocity, the gases in the said captured environment thereafter turbulently receding rearwardly of the projectile to become a part again of the column of gases in the bore and the residual energy of the gases in said captured environment not absorbed by the projectile or barrel becoming a part of the total energy that thereby decreases in the column of gases in the bore, the method including the steps of repeating said partial sudden limited relief of column static pressure into subsequent expansion chambers to thereby recycle said residual energy which, together with the energy in the column of gases, cause transitory increases in projectile rotation and forwarded velocity by converting more of the static pressure of the gases in the column into dynamic pressure at the projectile which thereby absorbs and stores kinetic energy from the column of bore gases with projectile velocities below 1.25 miles per second while in the barrel for free flight accuracy purposes correlated with reduction of the magnitude of bore column expansive kinetic energy relief of gases at the muzzle in the form of muzzle blast reduction as the projectile exits the barrel.

It being noted here that the bore wall chambers when used as chargeless expansion chambers work more efficiently with the projectile structural means as shown in FIG. 12 and that at first several empty bore expansion chambers will be used to reduce the high gas pressure of the projectile's co-chamber charged with high pressure gases from the last charge activated bore wall chamber, and after the co-chamber pressure is reduced, expansive column gas pressure will continue to effect the forward and tangential rotational forces to act on the projectile as aforesaid.

And it can be clearly seen as illustrated in the drawing that the projectile will be rotated by its helicoidal heel means to the same direction of rotation by the force of propellant gases flowing either rearwardly or forwardly along the projectile's helicoidal heel area.

In compliance with the statutory requirements, the invention in various embodiments has been described in language more or less specific as to structural features and methods to enable one of skill in this art to practice the invention. It is to be understood, however, that the invention is not limited to the specific features and methods shown and described, since the means and construction herein disclosed comprise preferred forms of putting the invention into effect. The invention is, therefore claimed in any of its forms or embodiments within the legitimate and valid scope of the appended claims.

I claim as my invention:

1. A cartridge system round of ammunition for launching a projectile and pushing a propellant charge at the front of the projectile out of the cartridge and along a bore of a gun barrel, said cartridge system round of ammunition comprising:

a cartridge casing having a casing bore defining a projectile passageway and a casing sidewall having an interior surface, said cartridge casing containing:

(a) a projectile having a rear end and a front end, and a bearing surface defining an interface in association with said casing;

(b) a first propellant charge placed at said rear end of said projectile; and (c) a second propellant charge placed across the frontal area of said projectile forward of said bearing surface, said second charge being disposed in a transverse positional arrangement extending inward from the interior surface of said casing sidewall and nested within said casing bore and directly in the path of said projectile.

2. The system of claim 1 wherein said projectile further includes a front ogive surface.

3. The system of claim 1 wherein the projectile includes a helicoidally structured rear end.

4. The system of claim 1 and further including at least one gas channel extending along said bearing surface of said projectile.

5. The system of claim 1 and further including means for preventing forward movement of said first primer propellant charge along said projectile body.

6. The system of claim 1 and further including means for allowing forward movement of said first primer propellant charge along said projectile body.

7. The system of claim 1 wherein said projectile further includes a chamber opening into said bearing surface.

8. The system of claim 1 wherein said first propellant charge operates as a primer for said second propellant charge.

9. The system of claim 1 wherein said cartridge casing includes a seal between said first and said second propellant charges.

10. The system of claim 1 and further including at least one gas channel extending along said inner surface of the sidewall of said cartridge casing.

11. The system of claim 1 wherein said second propellant charge comprises a plurality of charges selected from the group consisting of layered and stacked charges.

12. The system of claim 1 wherein said second propellant charge comprises a plurality of charges of different compositions.

13. The system of claim 1 wherein said second propellant charge comprises a plurality of charges having differing characteristics selected from the group including differing grain and web characteristics.

14. The system of claim 1 further comprising a recess in said interior surface of the sidewall for primer charging through said chamber opening into the bearing surface of said projectile.

15. A cartridge system round of ammunition for launching a projectile and pushing a propellant charge at the front of the projectile of a cartridge along a bore of a gun barrel, said cartridge system round of ammunition comprising:

a cartridge casing having a casing bore defining a projectile passageway and sealing means and a casing sidewall having an interior surface, said cartridge casing containing:

(a) a projectile having a rear end and a front end, and a bearing surface defining a bearing surface interface in association with said casing, and at least one chamber opening into said bearing surface interface;

(b) a first propellant charge placed at said rear end of said projectile;

(c) a second propellant charge placed across the frontal area of said projectile forward of said bearing surface, said second charge being disposed in a transverse positional arrangement extending inward from the interior surface of said casing sidewall and nested within said casing bore and directly in the path of said projectile; and (d) at least one gas channel extending along said interior surface of the sidewall of said cartridge casing.

16. The system of claim 15 and further including at least one gas channel extending along said obturator surface of said projectile.

17. The system of claim 15 and further including means for preventing forward movement of said first primer propellant charge along said projectile body.

18. The system of claim 15 and further including means for allowing forward movement of said first primer propellant charge along said projectile body.

19. The system of claim 15 wherein said first primer propellant charge operates as a primer charge for said second propellant charge.

20. The system of claim 15 wherein said at least one gas channel extending along said interior surface of said casing sidewall, in association with said casing bore sealing means associated with said interface bearing surface of said projectile, provides an access between said first propellant charge and said second propellant charge for primer-igniting said second propellant charge after it is displaced from said cartridge.

21. The system of claim 15 wherein said at least one gas channel allows primer charging of said chamber opening into the bearing surface of said projectile.

22. A projectile system round of ammunition for launching a projectile and pushing an associated propellant charge from a cartridge system along a gun barrel bore having a plurality of spaced barrel recessed chambers of predetermined length and spaced apart at a predetermined spacing distance therebetween, said round of ammunition comprising;

a) a hollow cartridge casing having a casing bore with a longitudinal axis defining a projectile passageway b) a projectile located in said cartridge casing, said projectile having a longitudinal axis, a rear end, a front end, a rearward obturator bearing surface, a forward obturator bearing surface, and a projectile recessed chamber formed between said rearward and forward obturator bearing surfaces;

c) a seal on said cartridge casing, said seal in contact with said projectile;

d) a first propellant charge positioned in said cartridge casing and rearward of said projectile; and e) a second propellant charge placed across the frontal area of said projectile forward of said bearing surface, said second charge being disposed in a transverse positional arrangement extending inward from the interior surface of said casing sidewall and nested within said casing bore and directly in the path of said projectile.

23. The system of claim 22 wherein said forward obturator surface has a length less than said predetermined length of said spaced barrel recessed chambers of said plurality of recessed chambers of said bore of a gun barrel.

24. The system of claim 22 wherein said forward obturator surface has a length greater than said predetermined length of said spaced barrel recessed chambers of said plurality of recessed chambers of said bore of a gun barrel.

25. The system of claim 22 wherein said rearward obturator surface has a length less than said predetermined length of said spaced barrel recessed chambers of said plurality of recessed chambers of said bore of the gun barrel.

26. The system of claim 22 wherein said rearward obturator surface has a length greater than said predetermined length of said spaced barrel recessed chambers of said plurality of recessed chambers of said bore of the gun barrel.

27. The system of claim 22 wherein said projectile recessed chamber has a length greater than said predetermined distance between said plurality of spaced barrel recessed chambers of said bore of the gun barrel.

28. The system of claim 22 wherein said projectile recessed chamber has a length less than said predetermined distance between said plurality of spaced barrel recessed chambers of said bore of the gun barrel.

29. The system of claim 22 wherein said second propellant charge is larger than said first propellant charge.

30. The system of claim 22 wherein said second propellant charge comprises a plurality of charges selected from the group consisting of layered and stacked charges.

31. The system of claim 22 wherein said second propellant charge comprises a plurality of charges of different compositions.

32. The system of claim 22 wherein said second propellant charge comprises a plurality of charges having differing characteristics selected from the group including differing grain and web characteristics.

33. The method for launching a projectile and propellant charge from a cartridge round of ammunition along a main bore of a gun barrel having a cartridge receiving chamber and a bore wall and a series of spaced recessed bore wall chambers of predetermined length and spacing along said bore wall, said method of launching said projectile and propellant charge comprising the steps of:

a) providing a projectile with a longitudinal axis, a rear end, a front end, a rearward obturator surface, a forward obturator surface, and a recessed projectile chamber recessed between said rearward and forward obturator surfaces;

b) providing a cartridge case having a bore with a longitudinal axis, a sidewall and a case seal in said cartridge case;

c) placing a first propellant charge and locating, said projectile in front of said first propellant charge in said cartridge case, said projectile being in contact with said case seal; and d) placing a second propellant charge in said cartridge case across the frontal area of and in the path of said projectile and securing the front end of said cartridge case;

e) placing said cartridge case in said cartridge receiving chamber of a gun barrel;

f) igniting said first propellant charge;

g) launching said projectile and forward propellant charge; and h) deploying and igniting portions of said second propellant charge along said main bore of said gun barrel and in said series of recessed bore wall chambers of said main bore of said gun barrel.

34. The method of claim 33 and including the step of providing friction-sensitive explosive film lubrication of said main bore of said gun barrel and said projectile, material of said explosive film lubrication being contained in said second propellant charge, said explosive film operating as a primer for said second propellant charge.

35. The method of claim 33 and further including the step of allowing said first propellant charge to travel along the projectile body and ignite said second propellant charge.

36. The method of claim 33 and further including the step of preventing said first propellant charge to travel along said projectile body and ignite said second propellant charge.

37. The method of claim 33 and further including the steps of developing peak pressure of each said portion of second propellant charge in each subsequent said recessed bore wall chamber of a gun barrel of said series of bore wall chambers greater than developed peak pressure of each preceding said bore wall chamber of said series of bore wall chambers.

* * * * *